US011266863B2

(12) United States Patent
Rol

(10) Patent No.: US 11,266,863 B2
(45) Date of Patent: Mar. 8, 2022

(54) FLUID FLOW CONTROL DEVICE

(71) Applicant: Precise Action Plus Pty Ltd, Burleigh Heads (AU)

(72) Inventor: Geoffrey Rol, Burleigh Heads (AU)

(73) Assignee: Precise Action Plus Pty Ltd, Burleigh Heads (AU)

( * ) Notice: Subject to any disclaimer, the term of this patent is extended or adjusted under 35 U.S.C. 154(b) by 289 days.

(21) Appl. No.: 16/479,591

(22) PCT Filed: Feb. 2, 2018

(86) PCT No.: PCT/AU2018/050068
§ 371 (c)(1),
(2) Date: Jul. 20, 2019

(87) PCT Pub. No.: WO2018/141019
PCT Pub. Date: Aug. 9, 2018

(65) Prior Publication Data

US 2019/0344105 A1 Nov. 14, 2019

(30) Foreign Application Priority Data

Feb. 2, 2017 (AU) ..... 2017900309

(51) Int. Cl.
*F04D 25/10* (2006.01)
*F04D 25/16* (2006.01)
(Continued)

(52) U.S. Cl.
CPC ..... *A62C 3/0207* (2013.01); *F04D 19/002* (2013.01); *F04D 25/105* (2013.01); *F04D 25/166* (2013.01); *F04D 29/602* (2013.01)

(58) Field of Classification Search
CPC ..... A62C 3/0207; B01F 3/04042
See application file for complete search history.

(56) References Cited

U.S. PATENT DOCUMENTS 2,109,818 A 3/1938 Colquhoun
6,336,594 B1 1/2002 Bader
(Continued)

FOREIGN PATENT DOCUMENTS

CN 101943174 A 1/2011
CN 102029032 A 4/2011

*Primary Examiner* — Ninh H. Nguyen
*Assistant Examiner* — Jason G Davis
(74) *Attorney, Agent, or Firm* — Fay Sharpe LLP

(57) ABSTRACT

This invention relates in general to a device for controlling the flow of a fluid. The device having a plurality of motor assemblies mounted at equidistant points around a mounting collar. An elongated annular outer casing surrounds and is spaced outwardly from the motor assemblies and defines with the motor assemblies an annular air passage. The outer casing having a central longitudinal axis, an open forward end for receiving ambient air and an open rear end for discharging air forced fluid. The device has a supporting structure on which the outer casing is mounted and a fluid flow assembly. A turntable is coupled to the supporting structure for rotation and an actuating assembly is used for raising and lowering the outer casing, wherein the actuating assembly is coupled between the supporting structure and outer surface of the outer casing.

20 Claims, 31 Drawing Sheets

(51) Int. Cl.

| | |
|---|---|
| ***F04D 29/60*** | (2006.01) |
| ***F04D 19/00*** | (2006.01) |
| ***A62C 3/02*** | (2006.01) |

(56) References Cited

U.S. PATENT DOCUMENTS

| | | | | |
|---|---|---|---|---|
| 6,789,787 | B2 * | 9/2004 | Stutts | F24F 5/0035 261/28 |
| 9,267,698 | B2 * | 2/2016 | Stearns | F24F 7/007 |
| 9,586,068 | B2 * | 3/2017 | Wiley | A62C 3/0207 |
| 2017/0259094 | A1 * | 9/2017 | Sibila | B05B 7/0075 |

* cited by examiner

FLUID FLOW CONTROL DEVICE

FIELD OF THE INVENTION

This invention relates in general to a device for controlling the flow of a fluid. More specifically, the present invention relates to fire fighting equipment using a fluid flow control device which generates high velocity air forced fluid useful in fighting fires.

The invention also relates to a device for effecting controlled dispersal of fluid to achieve specific flow patterns. Such flow patterns are of interest in a wide range of applications, such as dust suppression, positive pressure ventilation, chemical and aerosol spraying, crowd control, industrial cleaning, cooling ambient temperatures, making artificial snow, de-icing aircraft, as a propulsion source for light aircraft or other vehicles and other applications.

While the invention is suitable for any of the applications referred to above, and others, it will be described herein in relation to its application to firefighting. It will be appreciated, however, that the invention is not so limited and aspects of the invention which may need to be modified for its application in other areas will be apparent to those skilled in the art.

BACKGROUND OF THE INVENTION

It should be noted that reference to the prior art herein is not to be taken as an acknowledgement that such prior art constitutes common general knowledge in the art.

A fluid can be defined as a substance, liquid or gas, that is capable of flowing and that changes its shape at a steady rate when acted upon by a force tending to change its shape. For example, this includes such substances as water, air, oxygen and gas.

Fluid dynamics is the study of fluids in motion and corresponding phenomena. A fluid in motion has a velocity, just as a solid object in motion has a velocity. Like the velocity of a solid, the velocity of a fluid is the rate of change of position per unit of time. In fluid dynamics the volumetric flow rate is the volume of fluid which passes per unit time; usually represented by the symbol Q. The SI unit is $m^3/s$ (cubic metres per second). Fluid velocity can be affected by the pressure of the fluid, the viscosity of the fluid, and the cross-sectional area of the container in which the fluid is travelling. These factors affect fluid velocity depending on the nature of the fluid flow.

Fluid dynamics and the flow of fluids are particularly important in fighting fires. The major hazard associated with firefighting operations is the toxic environment created by combustible materials. The four major risks created due to the toxic environment are smoke, oxygen deficiency, elevated temperatures, and poisonous atmospheres. Generally three factors need to come together to start a fire and keep it burning: a combustible material, oxygen and the flashpoint. All firefighting methods are based on depriving fire of one or more of its basic requirements for burning.

In a great number of fires, the firemen are unable to reach the centre of the fire because of the considerable heat, even if they wear heat resistant clothing and use special equipment. This is particularly true if the fire extends over a large area due to the nature or environment of the fire. For example, mine shaft fires, tunnel fires, airport fires or fires generated by toxic and flammable fuels. Typically the centre of the fire is known but it cannot be reached due to heat, smoke, chemicals or the danger of building or structure collapse.

It is also the case that in petrol or chemical fires, the fire's intensity is so great that the water or chemicals used in fighting the fires can evaporate or disintegrate before reaching the core of the fire. No matter how the fire retardant is applied they do little to put out the fire. Furthermore, most fire fighting methods are designed only to extinguish the flames and not to stop the forward progress of the fire. By simply dousing the fire with water or chemicals will not stop a fire's progress. In forest or bush fires which are quickly spreading the dousing of the fire is often ineffective in stopping a quickly spreading fire.

Over the years a number of different methods and equipment have been devised in an attempt to effectively fight all types of fires. Various vehicles are known for use in fire fighting, such as aerial platform trucks, ladder trucks, pumpers and tankers. Conventional methods of propelling water for the purpose of fire fighting consist of pumping it under pressure through a nozzle. An example of these conventional methods is the use of monitors mounted on the vehicle or extending from platforms or ladders. Firefighting monitors are used to control the flow of fluid, such as water, from an outlet mounted to a nozzle and an inlet connected to a supply of fluid. Typically pipe sections are connected together to form a curved fluid passageway and mounted to allow articulation of the pipe sections so that the position of the outlet can be varied. They may be controlled manually or may be driven by motors, which are either hardwired or connected for wireless transmission to a controller. The monitors may be moveable with electric, hydraulic, or pneumatic actuator systems.

The propelling distances attained by this method are limited when it comes to fighting fires. Wind resistance quickly breaks up the stream of water into droplets, to which the wind offers even greater resistance. Where comparatively long distances of propelling water have been attained it has been by pumping the water at a very high rate and pressure. Even then, the distances attained are not great, and the rate at which the water is used is questionable especially in conditions or environments when water supply is limited.

Some fire-fighting devices have been developed in an attempt to increase the propelling distance by incorporating an air blower with a mist generating device. In this example, a large scale positive pressure ventilation machine providing a powerful blower with water spray nozzles has been designed to deliver a large volume of air into a structure to force smoke and hazardous gasses out through different openings. However, these fire-fighting devices have proven to still be problematic due to their inability to control the displacement of air and hence the mist generation.

Fire-fighting in certain environments also provide significant problems for the current known devices and methods of depriving fire of one or more of its basic requirements for burning. For example, industrial fires and explosions cost companies and governments billions of dollars every year, not to mention the loss of life, which can't be described in monetary terms. Chemical plant explosions are devastating and point to the need for improved methods and devices in the need for fighting fires that are caused by flammable substances.

Conventional methods of fighting these fires are limited by the nature and ability to contain and suppress the fire. This is also relevant to fighting fires in tunnels where intense heat and smoke can prevent the suppression of fire. There is a need for a fire-fighting device which can quickly and safely suppress and extinguish fires to protect lives and to prevent the destruction of property and of the environment.

Clearly it would be advantageous if a device for controlling the flow of a fluid could be devised that helped to at least ameliorate some of the shortcomings described above. In particular, it would be beneficial to provide such a device which decreases the fireman's peril, as well as to increase the pressure and quantity of water passing through a nozzle.

SUMMARY OF THE INVENTION

In accordance with a first aspect, the present invention provides a fluid flow control device comprising: a plurality of motor assemblies mounted at equidistant points around a mounting collar; an elongated annular outer casing surrounding and spaced outwardly from the motor assemblies and defining with the motor assemblies an annular air passage, the outer casing having a central longitudinal axis, a substantially open forward end for receiving ambient air and a substantially open rear end for discharging an air forced fluid; a supporting structure on which the elongated annular outer casing is mounted; a fluid flow assembly having a fluid inlet attached adjacent the supporting structure, and a fluid outlet located adjacent the central longitudinal axis and within the open rear end of the elongated annular outer casing; a turntable coupled to the supporting structure to allow the supporting structure to be rotated in a circular arc; and an actuating assembly for raising and lowering the annular outer casing, the actuating assembly being coupled between the supporting structure and an outer surface of the elongated annular outer casing.

Preferably, the fluid flow control device can be used for any one or more of the following applications: a) fire fighting; b) dust suppression; c) positive pressure ventilation; d) chemical and aerosol spraying; e) an area denial weapon for crowd control; f) industrial cleaning; g) cooling ambient temperatures; h) making artificial snow; i) de-icing aircraft; or j) a propulsion source for light aircraft or other vehicles.

Preferably, the plurality of motor assemblies may be powered by any one of a) an electric current; b) a hydraulic fluid pressure; c) a pneumatic pressure; or d) a high pressure fluid. The electric current may be either a DC or an AC electric current.

Preferably, the elongated annular outer casing may be a cylindrical tube shaped casing designed to concentrate the flow of air through and from the fluid flow control device or the outer casing may be an aerodynamic annular casing used as a chamber to concentrate the flow of air through and from the fluid flow control device. The open forward end of the outer casing may have a rear housing flange positioned to encompass an inlet flange of each one of the plurality of motor assemblies. The open rear end of the outer casing may have a front housing flange positioned to encompass an outlet of the air delivery housing of each one of the plurality of motor assemblies.

Preferably, the supporting structure may comprise a pair of spaced uprights defining a recess for receiving a mounting assembly of the elongated annular outer casing and a supporting base, the elongated annular outer casing being pivotally connected to the uprights by a rotational member interposed between each upright and the mounting assembly of the outer casing. Preferably, the rotational member may comprise a bearing assembly coupled to each upright at opposing sides of the mounting assembly and a rotational shaft passing through both bearing assemblies and the mounting assembly. The bearing assembly may comprise a journal bearing in each upright of the supporting structure to support the mounting assembly of the elongated annular outer casing for pivotal movement. Alternatively, the rotational member may comprise a journaled shaft passing through an aperture in each upright and a corresponding aperture in the mounting assembly to support the mounting assembly of the elongated annular outer casing for pivotal movement.

Preferably, the motor assemblies mounting collar may be adapted to fit within the outer casing, the collar having a plurality of circumferentially spaced apart struts extending radially from a central hub to the collar for supporting the plurality of motor assemblies. The struts may be evenly spaced around the collar such that the plurality of motor assemblies are equidistantly spaced and supported around the collar.

Preferably, the turntable coupled to the supporting structure may be mounted or mountable on a surface. The turntable may be coupled to the supporting structure to allow the fluid flow control device to be rotated in a circular arc, the turntable comprising: a first plate mounted or mountable to the surface; a second plate mounted or mountable to the supporting base of the supporting structure; a rotating means mounted between the first and second plates which allows the fluid flow control device to be rotated in the circular arc; a turntable drive assembly mounted to the rotating means to allow the turntable to be driven both clockwise and anti-clockwise; and a limit switch assembly to limit the rotational movement of the turntable.

Preferably, the turntable drive assembly may be powered by any one of an electric current, a hydraulic fluid pressure, a high pressure fluid, or a pneumatic pressure. The electric current may be either a DC or an AC electric current.

Preferably, the actuating assembly further may comprise an actuator connected between the support base of the supporting structure and a mounting arm on the outer surface of the elongated annular outer casing to allow the actuating assembly to move the outer casing vertically up and down to adjust an angular position of the outer casing with respect to the supporting structure.

Preferably, the actuator may be a linear actuator with an extending screw rod, a first end of the actuator is pivotally connected to the support base and an end of the extending screw rod is attached to the mounting arm on the outer casing such that upon extension or retraction of the screw rod will adjust the vertical angular position of the outer casing of the fluid flow control device in relation to the supporting structure. The actuating assembly may further comprise at least one limit switch to limit the vertical movement of the outer casing of the fluid flow control device.

Preferably, the actuator may be powered by any one of an electric current, a hydraulic fluid pressure, a high pressure fluid, or a pneumatic pressure. The electric current may be either a DC or an AC electric current.

Preferably, each motor assembly may comprise in serial flow communication about a longitudinal centre axis, a fan assembly and an air delivery assembly.

Preferably, the fan assembly may comprise a fan motor driving on a common shaft a fan rotor having a plurality of circumferentially spaced apart fan blades, and an outer fan housing surrounding the fan motor and fan blades.

Preferably, the air delivery assembly may comprise: an annular outer housing formed around the longitudinal centre axis of the motor assembly, the annular outer housing having a substantially open first end for receiving the fan assembly and a substantially open second end for discharging the portion of the ambient air which is compressed by the fan blades; a central body extending along the longitudinal centre axis of the annular outer housing; a plurality of circumferentially spaced struts extend radially between the annular outer housing and the central body; and wherein the annular outer housing, the central body and the struts are shaped to concentrate the air compressed by the fan blades of each one of the motor assemblies to provide the forced air supply for the fluid flow control device.

Preferably, the annular outer housing may comprise a first cylindrical body having a first end and a second end; a cylindrical air directing housing having an input end and an output end; and wherein the first end of the first cylindrical body is adapted to abut against an end of the fan assembly and the second end is adapted to be received within the input end of the air directing housing.

Preferably, the central body may comprise: a first cylindrical shaped body portion having a first end and a second end, the first body portion extends along the longitudinal centre axis of the motor assembly between the input end and the output end of the air directing housing; a first conical shaped end extends a distance from the first end of the first body portion to an apex; and a second output end extends a distance from the second end of the first body portion to form a rounded semi-spherical end.

Preferably, the first conical shaped end may extend into the first cylindrical body, such that the apex of the first conical end is located adjacent the fan assembly. The rounded semi-spherical end may extend to a point located externally of the open second end of the annular outer housing.

Preferably, the plurality of circumferentially spaced struts may have a leading edge spaced apart from a trailing edge, the leading edge and the trailing edge being formed at an angle with respect to the longitudinal centre axis of each motor assembly. The angle which the leading and trailing edges may be formed with respect to the longitudinal centre axis of each motor assembly is in the range of 20 degrees to 90 degrees. Alternatively, the angle which the leading and trailing edges are formed with respect to the longitudinal centre axis of each motor assembly may be approximately 60 degrees.

Preferably, the fluid flow assembly may further comprise at least one nozzle attached to the fluid outlet. Alternatively, the fluid flow assembly may further comprise a plurality of nozzles attached to the fluid outlet.

Preferably, the nozzles may be positioned so as to supply a spray of fluid from the fluid outlet and when combined with an air flow in the open rear end produces a concentrated stream of spray mist of fluid, or a dispersion of large droplets of fluid or any other dispersion combination achieved through the mixture of the concentrated high thrust air and fluid.

Preferably, the fluid flow assembly may further comprise a fluid supply manifold, the manifold comprising at least one fluid container configured to hold a fluid and a first pump mechanically coupled to the at least one fluid container and configured to at least partially pump the fluid from the at least one container into the fluid inlet at a first pressure.

Preferably, the air forced fluid dispersed by the fluid flow control device may be any substance which continually deforms, either liquid or gas substance, such as, any one of water, water-based fire retardant foam, chemical based fire-fighting products, carbon dioxide, halon, or sodium bicarbonate.

Preferably, the fluid flow control device may further comprise a controller for providing remote operation of the fluid flow control device. The controller may be either a wired or a wireless controller. The controller may be designed to provide remote operation of the turntable drive assembly, the actuating assembly, the motor assembly, and the fluid flow assembly.

Preferably, the controller may further comprise: a microcontroller having a central processing unit, a memory, at least one serial port and at least one digital programmable input and output and at least one analog programmable input and output; and a master control panel remotely connected to the microcontroller, the master controller having at least one user interface, and a display configured to present at least one defined parameter used to operate or control the fluid flow control device.

Preferably, the controller may further comprise a separate control device for controlling each one of: i) a motor speed of each or all motor assemblies; ii) an angular position of the annular outer casing with respect to the supporting structure by controlling the actuating assembly; iii) a rotational position of the fluid flow control device by controlling the turntable drive assembly; and iv) a flow rate of fluid by controlling the first pump of the fluid flow assembly.

Alternatively, the controller may further comprise a single control device programmed using the microcontroller to control each one of: i) a motor speed of each or all motor assemblies; ii) an angular position of the annular outer casing with respect to the supporting structure by controlling the actuating assembly; iii) a rotational position of the fluid flow control device by controlling the turntable drive assembly; and iv) a flow rate of fluid by controlling the first pump of the fluid flow assembly.

Preferably, each one of the motor assemblies may further comprise a temperature sensor mounted adjacent the fan motor to monitor the motor temperature. The temperature sensor may further comprise a shutoff system connected to the controller to prevent over-temperature operation of the motor assemblies.

Preferably, when the turntable drive assembly, the actuating assembly, the motor assembly, and the fluid flow assembly are powered by hydraulic fluid pressure, the fluid flow device may further comprise a hydraulic pump in fluid communication with a hydraulic fluid reservoir. The hydraulic pump may be powered by any one of an electric motor or a prime mover.

Preferably, when used in the applications for fire fighting, dust suppression, positive pressure ventilation, chemical and aerosol spraying, an area denial weapon for crowd control, industrial cleaning, cooling ambient temperatures, or making artificial snow, the fluid flow control device may be mounted on a platform on a moveable boom which is attached to a vehicle.

In accordance with a further aspect, the present invention provides a method of controlling a fluid flow control device comprising the steps of: a) providing a fluid flow control device comprising any one of the features of the first aspect; b) providing a power source for the fluid flow control device, wherein the power source is chosen from any one or more of an electric current, a hydraulic fluid pressure, a high pressure fluid, or a pneumatic pressure; c) providing a controller which is designed to provide remote operation of the turntable drive assembly, the actuating assembly, the motor assembly, and the fluid flow assembly; d) energising the motors; e) operating a speed control switch on the controller to gradually increase the speed of each one of the plurality of motors; f) stabilising the speed of each motor to produce an air flow from the open forward end ambient air input region to the open rear end air discharge region; g) adjusting the turntable drive assembly to rotate the fluid flow control device in a clockwise or an anti-clockwise direction;

h) adjusting the actuating assembly to raise and lower the annular outer casing to adjust the vertical position of the fluid flow control device; and i) energising a first pump mechanically coupled to at least one fluid container and configured to at least partially pump a fluid from the at least one container into the fluid inlet at a first pressure to provide the fluid to a fluid outlet located adjacent a centreline and within the open rear end air discharge region of the fluid flow control device to produce an output from the fluid flow device which combines and concentrates an air flow produced from the thrust of the motor assemblies and fluid from the fluid outlet.

In accordance with a still further aspect, the present invention provides a fluid flow control device comprising: a plurality of motors mounted at equidistant points around a housing, the housing comprising: an outer cowling substantially covering the plurality of motors, the outer cowling having an air input region and an air output region; and a motor mounting frame located within and extending around an axis passing through the centreline of the outer cowling; a base assembly supporting the housing and the plurality of motors; a fluid conduit having a fluid inlet attached adjacent the base assembly, and a fluid outlet located adjacent the centreline and within the air output region of the outer cowling; a turntable coupled to the base assembly to allow the fluid flow control device to be rotated in a circular arc around a vertical axis; and an actuating assembly coupled to the base assembly for allowing the fluid flow control device to be tilted up or down over a horizontal axis.

Preferably, the base assembly may further comprise a pivoting mounting assembly attached between the housing and the turntable to allow the actuating assembly to move the housing vertically up and down to adjust the angular position with respect to the turntable.

Preferably, the pivoting mounting assembly may comprise: a first base portion fixed to the turntable; and a second base portion pivotally mounted to the first base portion. The second base portion may be pivotally mounted to the first base portion through a pivot shaft and bearing assemblies mounted towards either end of the first and second base portions.

Preferably, the actuating assembly may be mounted between the first and second base portions to adjust the vertical angular position of the fluid flow control device in relation to the turntable. The actuating assembly may comprise an actuator with an extending screw rod, a first end of the actuator is fixed to the first base portion and one end of the extending screw rod is attached to the second base portion such that upon extension or retraction of the screw rod will adjust the vertical angular position of the fluid flow control device in relation to the turntable.

Preferably, the actuator may be a linear actuator. Preferably, the actuating assembly may further comprise at least one limit switch to limit the vertical movement of the fluid flow control device. Preferably, the actuator may be powered by any one of an electric current, a hydraulic fluid pressure, a high pressure fluid, or a pneumatic pressure. The electric current may be either a DC or an AC electric current.

Preferably, the actuating assembly may further comprise a controller for providing the remote operation of the actuating assembly. The controller may be either wired or a wireless controller. Alternatively, the turntable and the actuating member controllers may be housed within a single remote control for controlling both the turntable and the actuating assembly.

Preferably, the motor controller further comprises: a microcontroller having a central processing unit, a memory, at least one serial port and both a digital and an analog programmable inputs and outputs; and a master control panel remotely connected to the microcontroller. The master controller may further comprise at least one user interface, and a display configured to present at least one defined parameter used to operate or control the fluid flow control device.

Preferably, each of the plurality of motors may further comprise a temperature sensor mounted adjacent the motor to monitor the temperature of the motor. The temperature sensor may further comprise a shutoff system connected to the controller to prevent over-temperature operation of the motors.

Preferably, when used in the applications for fire fighting, dust suppression, positive pressure ventilation, chemical and aerosol spraying, an area denial weapon for crowd control, industrial cleaning, cooling ambient temperatures, or making artificial snow, the fluid flow control device may be mounted on a platform on a moveable boom which is attached to a vehicle.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

DETAILED DESCRIPTION OF THE INVENTION

Figure 1:
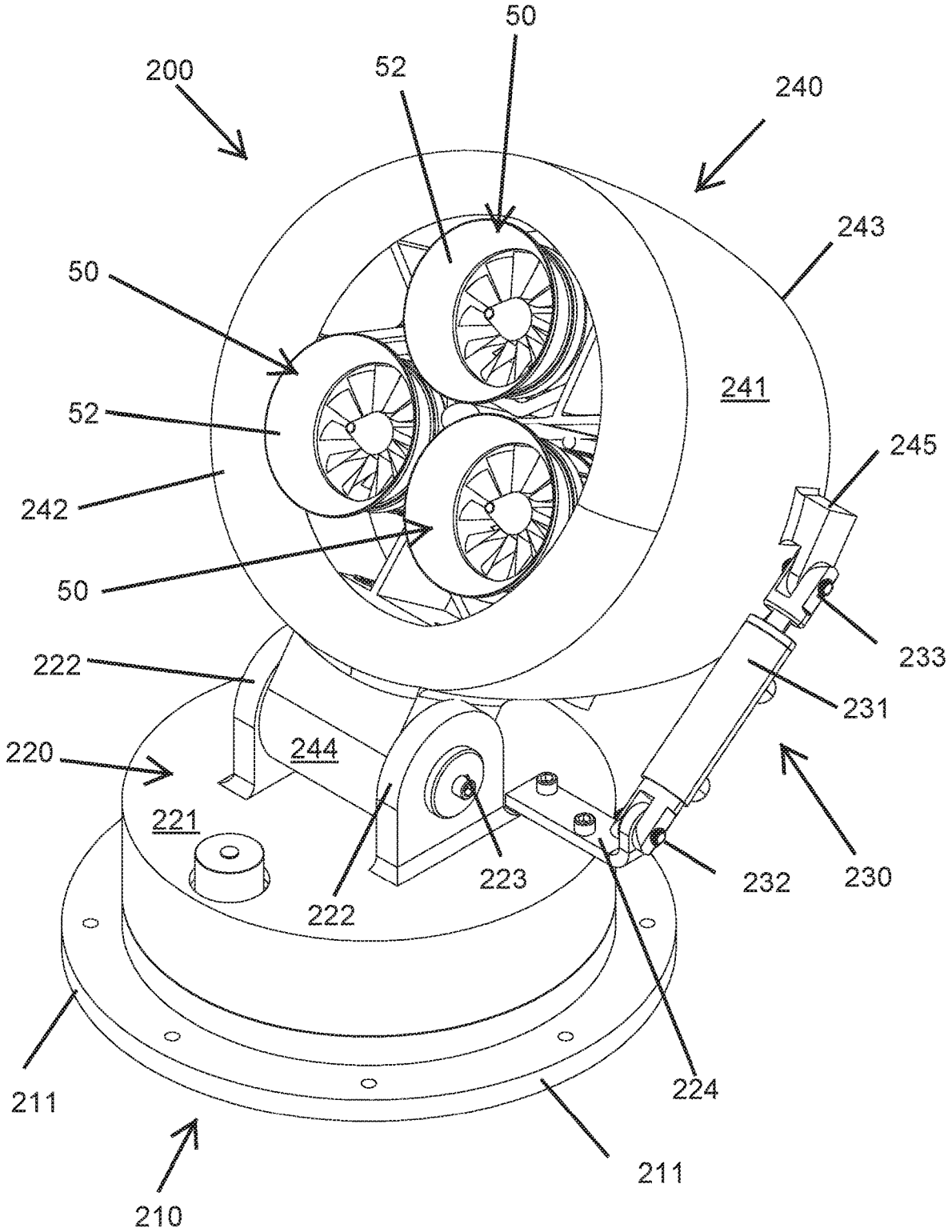
FIG. 1 shows an air input end perspective view of the fluid flow control device in accordance with an embodiment of the present invention.

The following description, given by way of example only, is described in order to provide a more precise understanding of the subject matter of a preferred embodiment or embodiments.

The present invention will be described and illustrated in relation to a fluid flow control device for fighting fires. It should however be understood that the present invention has a wide number of applications and is by no way only limited to a fluid flow control device for fighting fires.

In one form the present invention provides a fluid flow control device 200 for controlling the flow of an air forced fluid for fighting fires which provides an output which has a variable concentrated flow with increased pressure. The device 200 has three motor assemblies 50 mounted at equidistant points around the motor mounting collar 70 and housed within an elongated annular outer housing 240. The annular outer housing 240 is designed to surround and be spaced outwardly from the motor assemblies 50 and as such defines with the motor assemblies 50 an annular air passage. The outer housing 240 has a central longitudinal axis 'A', a substantially open forward end 242 for receiving ambient air and a substantially open rear end 243 for discharging an air forced fluid. The motor assemblies 50 and the annular outer housing 240 are mounted for rotational and vertical movement to a supporting structure 220. A fluid flow assembly 80 has a fluid inlet 84 and a fluid outlet 82. The fluid inlet 84 is attached adjacent the supporting structure 220 and the fluid outlet 82 is located adjacent the central longitudinal axis 'A' and within the open rear end 243 of the elongated annular outer housing 240. A turntable 210 is coupled to the supporting structure 220 to allow the supporting structure 220, the motor assemblies 50 and the annular outer housing 240 to be rotated in a circular arc. An actuating assembly 230 is used for raising and lowering the annular outer casing 240 and motor assemblies 50 to provide the vertical movement. The actuating assembly 230 is coupled between the supporting structure 220 and an outer surface 241 of the elongated annular outer housing 240.

The motor assemblies 50 have been strategically mounted in the mounting collar 70 to optimise the thrust direction of the fluid flow control device 200. The outer housing 240 has both an air input region at the open forward end 242 and an air output region at the open rear end 243. The air input region is defined by the rear housing flange and the air output region is defined by the front cowl. The motor mounting frame 70 is located within and extending around the longitudinal centre axis 'A' passing through the centreline of the outer housing 240.

Figure 2:
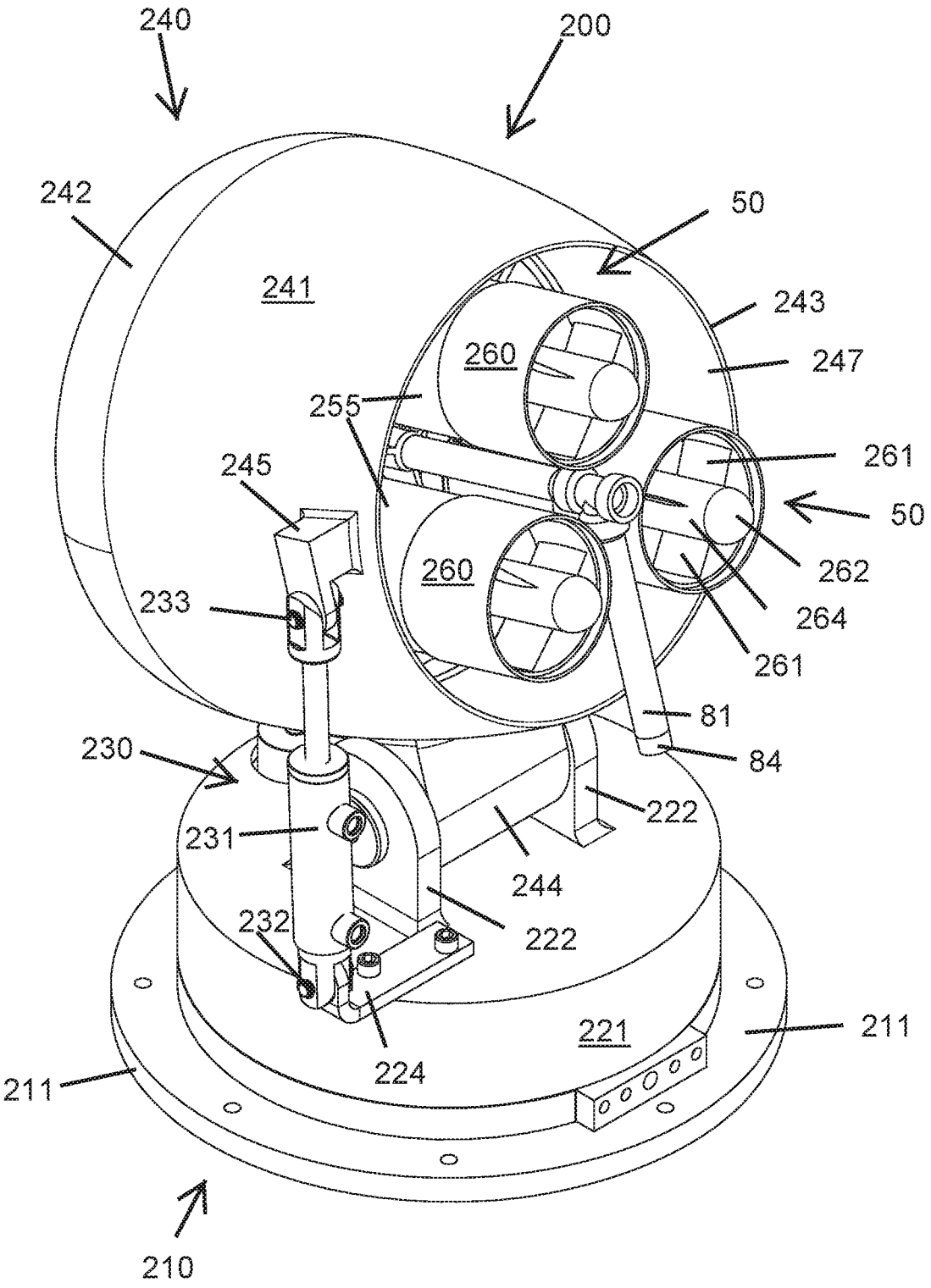
FIG. 2 shows an output end perspective view of the fluid flow control device of FIG. 1.

FIGS. 1 and 2 show both the fluid flow control device 200 from the ambient air input region at the open forward end 242 (FIG. 1) and the air forced fluid output region at the open rear end 243 (FIG. 2). The fluid flow control device 200 has three motor assemblies 50 mounted such that the motor assemblies 50 are equally spaced around the motor mounting collar 70. As illustrated a centre line passing through the centre of each motor assembly 50 is equally spaced around the collar 70 at an angle of 120 degrees between each centre line. While the current angular displacement around the collar 70 is 120 degrees it will be realised that other combinations can be utilised and each combination is largely dependent upon the number of motor assemblies 50 utilised and the particular application to which the fluid flow control device 200 is applied.

Each motor assembly 50 has a fan rotor or impeller 51 which drags ambient air through a fan inlet flange 52 on each motor assembly 50. Each fan inlet flange 52 is located adjacent the ambient air inlet region at the open forward end 242 of the fluid flow control device 200 and bordering the rear housing flange. The motor assemblies 50 are mounted within the motor mounting collar 70 and the annular outer housing 240 is mounted around the motor mounting collar 70. The mounting collar 70 is mounted against the internal surface 247 and towards the open air inlet region at the open forward end 242 of the annular outer housing 240. The outer housing 240 is a cylindrical tube shaped housing designed to concentrate the flow of air through and from the fluid flow control device 200. Alternatively, the outer housing 240 or nacelle 240 is aerodynamically shaped annular housing used as a chamber to concentrate the flow of air through and from the fluid flow control device 200.

The outer housing 240 has a mounting assembly 244 extending from the lower outer surface 241 for pivotally mounting the outer housing 240 and the motor assemblies 50 to the upright supports 222 of the support structure 220. The upright supports 222 are spaced apart on the support base 221 and define a recess therebetween for receiving the mounting assembly 244 of the outer housing 240. A rotational shaft 226 (FIG. 6) is inserted through bearing assemblies mounted in apertures 228 in each upright 222 and through the aperture 246 in the mounting assembly 244 to allow the outer housing and the motor assemblies 50 to be pivoted up and down. The shaft 226 is secured in place by locking device 223. Alternatively, the rotational shaft 226 may be a journaled shaft 226 passing through an aperture 228 in each upright 222 and a corresponding aperture 246 in the mounting assembly 244 to support the mounting assembly 244 of the elongated annular outer housing 240 for pivotal movement.

To provide the pivotal motion to the outer housing 240 and the motor assemblies 50 an actuating assembly 230 is connected between the outer housing 240 and the supporting structure 220. The actuating assembly 230 comprises a linear actuator 231 with an extending screw rod and mounting brackets 232, 233. Mounting bracket 232 is pivotally mounted to bracket 224 on the support base 221 of the support structure 220. Mounting bracket 233 is mounted to the end of the extending screw rod and is pivotally mounted to bracket 245 located on the outer surface 241 of the outer housing 240. Operation of the actuator 231 and extension or retraction of the extending screw rod will cause the vertical angular position of the fluid flow control device 200 to be adjusted up or down to suit the required position for operation.

While a hydraulic actuator 231 has been illustrated and described, it should also be understood that other types of actuator 231 could be utilised. For example, an electric actuator or a pneumatic actuator and associated components could also be used to extend or retract the extending screw rod to cause the vertical angular position of the fluid flow control device 200 to be adjusted up or down to suit the required position for operation.

Figure 3:
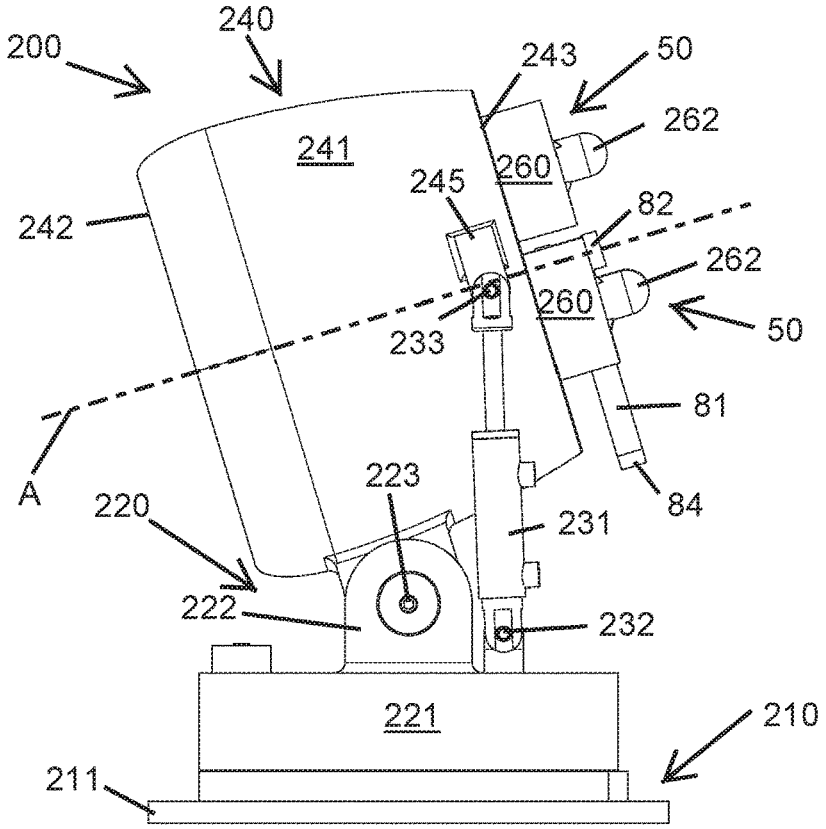
FIGS. 3 and 4 illustrate the vertical displacement of the fluid flow control device of FIG. 1.
Figure 4:
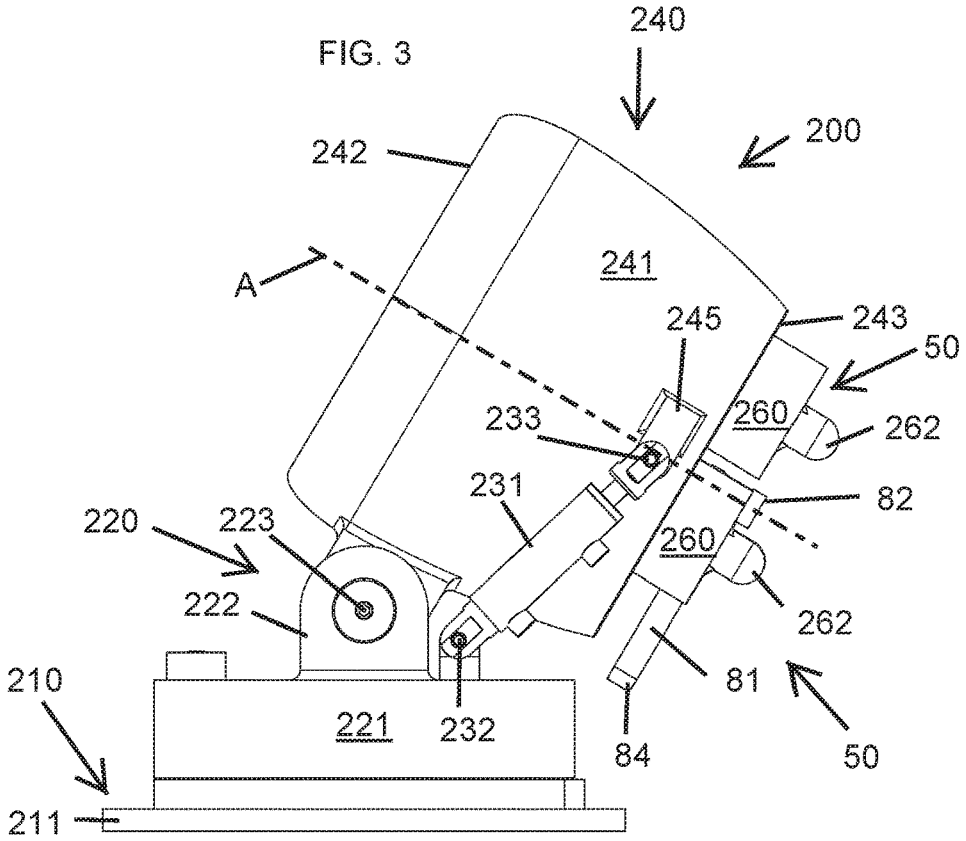

FIGS. 3 and 4 illustrate the rotation of the outer housing 240 around the shaft 226 of the support structure 220. The central axis 'A' passing through the centre of the outer housing 240 shows the tilting action of the outer housing 240 when the actuator 231 and extension or retraction of the extending screw rod will cause the vertical angular position of the fluid flow control device 200 to be adjusted up or down to suit the required position for operation. FIG. 3 shows the outer casing positioned up and the centre axis 'A' makes an angle of approximately 40 degrees with the left side of the supporting structure 220. FIG. 4 shows the outer casing positioned down and the centre axis 'A' makes an angle of approximately 40 degrees with the right side of the supporting structure 220. The fluid flow control device 200 is capable of moving the outer housing 240 and the motor assemblies 50 through an arc in the range of approximately 40 to 80 degrees.

Finally in order to rotate the fluid flow control device 200 around the circular arc the turntable 210 consists of a fixed base portion 211 which can be mounted or is mountable to a support surface and a rotatable portion fixed to the support base 221 of the support structure 220. The turntable 210 allows the fluid flow control device 200 to move both clockwise and anti-clockwise around a vertical axis of the fluid flow control device 200.

FIG. 2 illustrates the forced air and fluid outlet end 243 of the fluid flow control device 200. From this end the air delivery housing 260 is shown attached to one end of the motor assembly 50. Each motor assembly 50 has in in serial flow communication about a longitudinal centre axis, a fan assembly 97 and an air delivery assembly 250. The fan motor end outer housing 255 attaches to the fan assembly 97 and connects in line with the air delivery housing 260 to direct and concentrate fan forced air from each motor assembly 50. Also shown in FIG. 2 is the fluid delivery manifold 80 which comprises the fluid inlet 84 joined by the fluid inlet pipe 81 to the T-junction 83 and fluid outlet 82.

Figure 5:
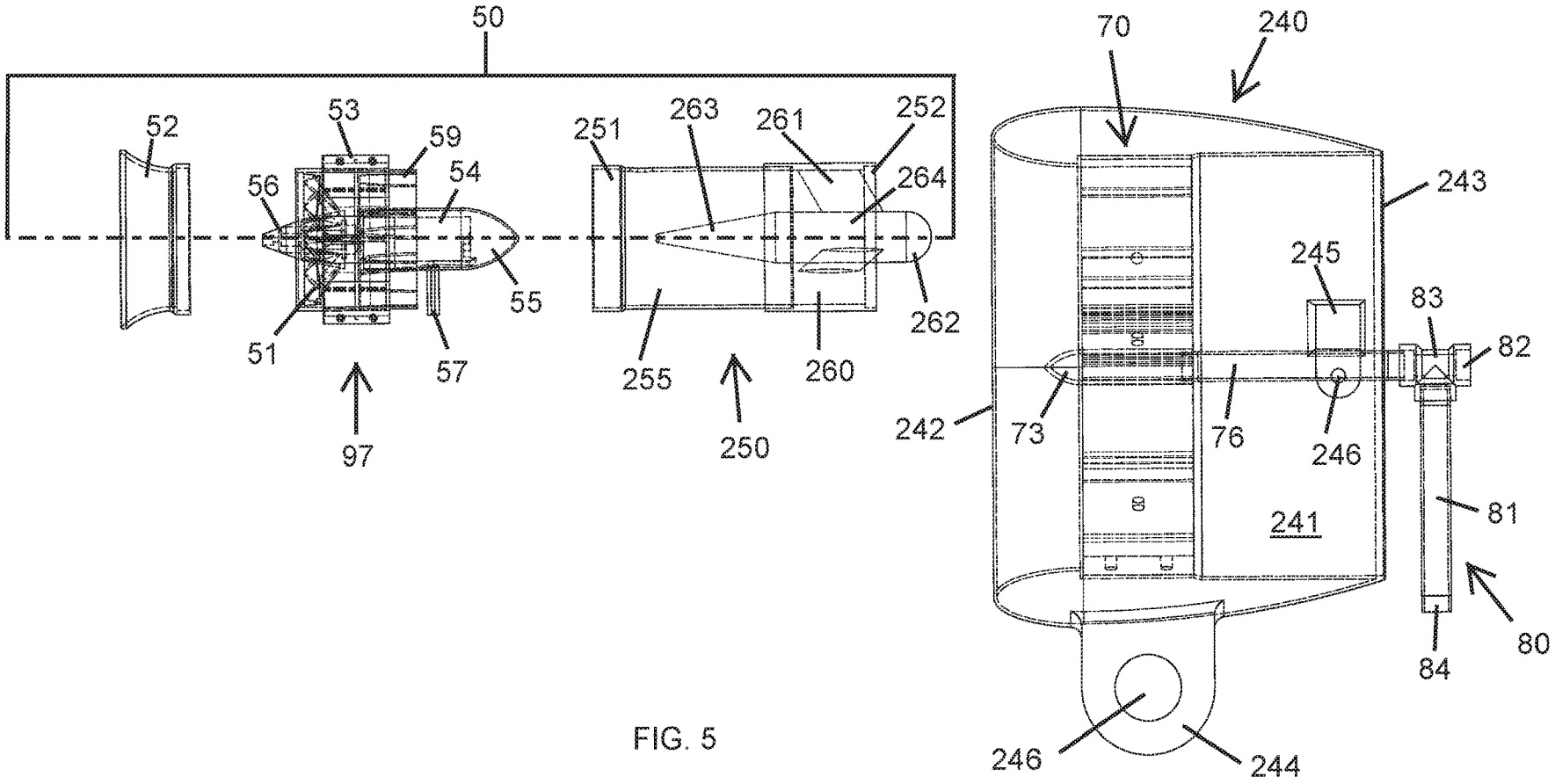
FIG. 5 shows a detailed side view of the fluid flow control device of FIG. 1 showing one motor assembly drawn in an exploded view showing the main components of the motor assembly.

FIG. 5 illustrates a more detailed view of the fluid flow control device 200 showing one of the motor assemblies 50 in an exploded view and for clarity purposes the support structure 220, actuating assembly 230 and the turntable 210 have been removed.

Each motor assembly 50 has a fan inlet flange 52, a fan assembly 97 and an air delivery assembly 250. The fan inlet flange 52 is designed to direct an air stream into the fan assembly 97. The fan inlet or intake 52 is horn shaped to bring free stream air or ambient air into the fan assembly 97. The inlet or intake 52 sits upstream of the fan assembly 97 and, while the inlet 52 does no work on the flow, inlet performance has a strong influence on motor net thrust. The fan assembly 97 has a common shaft to which the fan motor 54 drives the fan rotor 51 having a plurality of circumferentially spaced apart fan blades.

The fan assembly 97 includes the rotor cone 56, the fan rotor or impeller 51, the fan motor 54, the ducted fan housing 59 and the tail or aft cone 55. The rotor cone 56 and fan inlet flange 52 keep the airflow laminar, or smooth, as it enters the fan 51. This increases the efficiency of the ducted fan unit. The rotation of the fan rotor 51, or impeller, is what drives the air through the fan assembly 97. The ducted fan housing 59 is what contains and directs the airflow towards the air directional assembly 250. The profile or shape of this housing is critical to the efficiency of the ducted fan assembly 97. The ducted fan housing 59 also contains stators or stationary fan blades 91 inside the ducted fan housing 59 that straightens the air flow as it passes the stator blades 91. When a fan assembly 97 is housed in a shroud, the rotation of the fan blades 51 will cause the air to move radially as well as axially. This rotation of the air would cause turbulence which would reduce the efficiency of the ducted air fan assembly 97. The stator or stationary fan blades 91 are designed to centralise the fan rotor blades 51 with minimum blade to housing clearance and provide an inside diameter to maximise output thrust. The stator or stationary fan blades 91 also help to reduce the turbulence.

The fan motor 54 is what provides the torque to turn the fan rotor 51. While a hydraulic fan motor 54 is illustrated it will be appreciated, however, that the fan motor 54 is not so limited to only hydraulic power. Other forms of powering and types of fan motor 54 include for example, an electric motor or an air fan motor driven by pneumatic pressure. Alternatively, the fan motor 54 may be driven by high pressure fluid. For example, water-driven radial inflow turbines at the front end of the shaft driving an axial fan. The fan motor 54 can be driven by either AC or DC electric current. The aft cone 55 reduces or minimises turbulence caused by the air passing over the fan motor 54.

Each motor assembly 50 is mounted or mountable by the bracket 53 which is attached to either side of the fan assembly 97 and is retained in the motor mounting collar 70 by mounting bolt 58. The three motor assemblies 50 are all retained in the same manner around the motor mounting collar 70. The motor mounting collar 70 is mounted to the support structure 220 through the mounting assembly 244.

The air delivery assembly 250 directs the air produced by the fan assembly 97 out through the air outlet or open rear end 243 and into the air output region. The air delivery assembly 250 has one end 251 mounted to our abutting the rear end of the fan assembly 97 and an opposing end 252 which forms the air outlet end on each motor assembly 50 and is located within and adjacent the cowl or open rear end 243 of the outer housing 240. The air delivery assembly 250 consists of the fan motor end housing 255 and the air delivery housing 260. One end 251 of the fan motor end housing 255 abuts against the fan assembly 97 and the opposing end 258 is received within the end 266 of the air delivery housing 260. The fan motor end housing 255 is a longitudinally extending annular housing with a substantially uniform cross-sectional shape. The housing 255 encloses and directs the air flow from the fan assembly 97 towards the air delivery housing 260.

The air delivery housing 260 of each motor assembly 50 is an annular outer housing 260 formed around the longitudinal centre axis of each motor assembly 50. The annular outer housing 260 having a substantially open first end 266 for receiving the fan motor end housing 255 and a substantially open second end 252 for discharging the portion of the ambient air which is compressed by the fan blades 51. A central body 262, 263, 264 extends along the longitudinal centre axis of the annular outer housing 260 and is supported by a plurality of circumferentially spaced struts 261 which extend radially between the annular outer housing 260 and the central body 262, 263, 264.

Also shown in FIG. 5 at the air outlet or open rear end 243 of the outer housing 240 is the fluid flow assembly 80 positioned to allow the fluid to be influenced by the air thrust from the motor assemblies 50. The fluid flow assembly 80 is comprised of fluid inlet 84, piping 81, T-junction piece 83 and the fluid outlet 82. The fluid outlet 82 and the T-junction piece 83 are substantially aligned with the centreline axis passing through the centre of the outer housing 240. The opposing end of the T-junction 83 to the outlet 82 is secured to the centre support 76 of the motor mounting collar 70. The inlet 84 is fixed to a bracket (not shown) mounted to the support structure 220 or is simply attached to a hose which is connected to the fluid reservoir. The fluid flow assembly 80 may include a universal pivot attachment fixed to the fluid inlet 84 that is designed to retract and release a fluid hose (not shown) while the fluid flow control device 200 is being manoeuvred into position.

Figure 6:
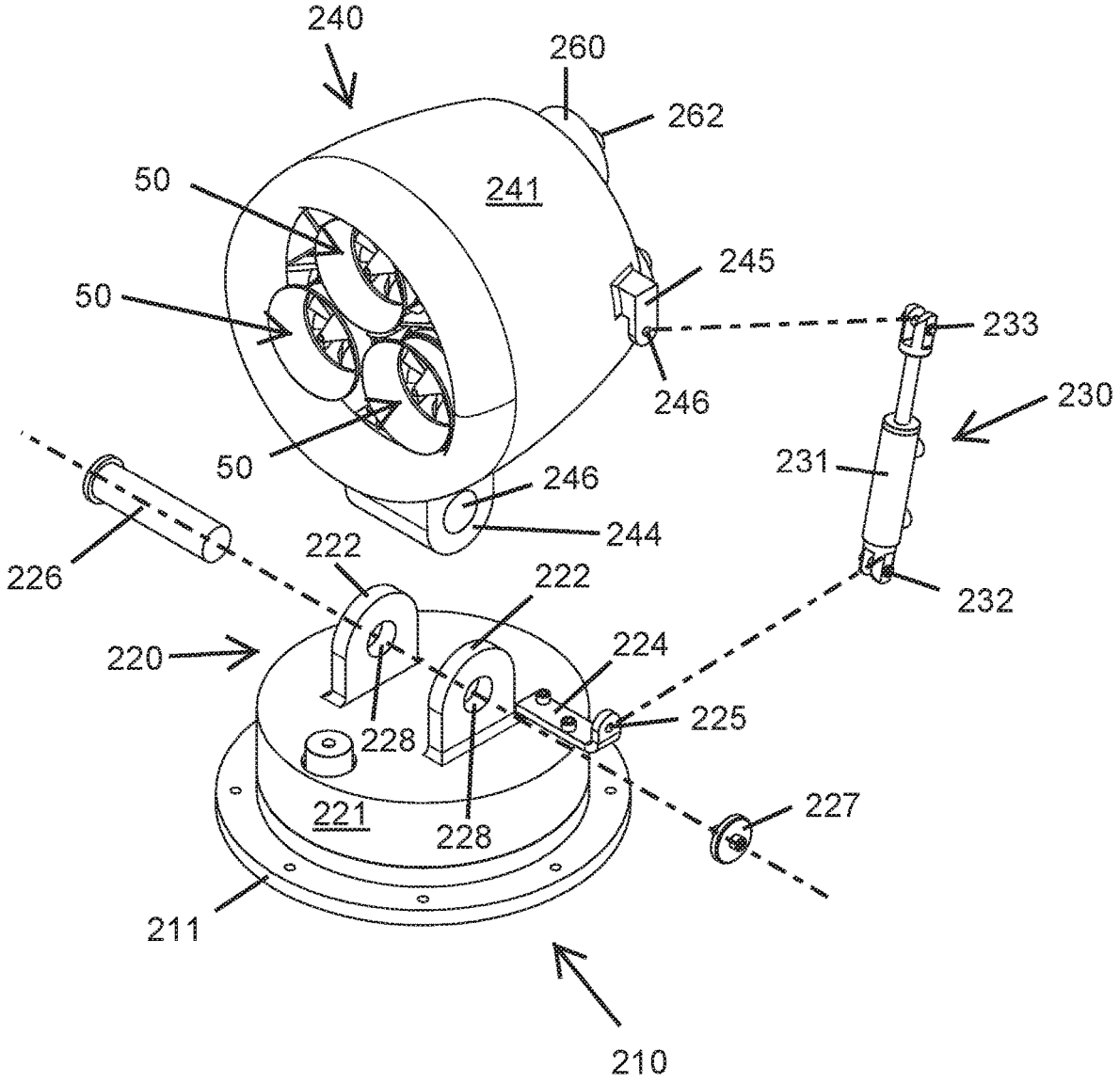
FIG. 6 shows an exploded perspective view of the displacement components of fluid flow control device of FIG. 1.

FIG. 6 shows an exploded view of the main components of the fluid flow control device 200. Shown are the motor assemblies 50 housed within the outer housing 240, the support structure 220 and turntable 210 and the actuating assembly 230 for moving the motor assemblies 50 and the outer housing 240 vertically up or down. As discussed above the outer housing 240 is pivotally mounted to the support structure 220 by the combination of the pivoting shaft 226 which extends through the apertures 228 in the uprights 222 of the support structure 220 and the mounting assembly 244 extending from the base or bottom of the outer housing 240. The support base 221 has two upright lug shaped mounting arms 222 which house the apertures 228 for receiving the shaft 226 or bearings. The shaft 226 acts as a journal bearing or as a simple shaft or journal rotating in a bearing. The shaft 226 rotates in the bearing with a layer of lubricant separating the two parts. In this embodiment the bearings (not shown) would be mounted within the apertures 228 of the support structure uprights 222. The shaft 226 is retained within the uprights 222 by a retaining device 227. The retaining device 227 is screwed or otherwise fastened within the end of the shaft 226.

Also mounted to one side of the support base 221 is the attachment arm 224 for mounting one end of the actuating assembly 230. The attachment arm 224 is fixed to the support base 221 by any well-known device or method, such as by screws or bolted through the support base 221. Extending from one end of the attachment arm 224 is mounting lug 225 with an aperture for receiving a locking device for retaining the pivoting mount 232 of the actuator 231 on the mounting lug 225. The other end of the actuator 231 and attached to the extending screw rod is pivoting mount 233 which attaches to the mounting arm 245 on the outer housing 240. The mounting arm 245 extends from one side of the outer surface 241 of the outer housing 240 and has the mounting lug 246 with an aperture for receiving a locking device for retaining the pivoting mount 233 of the actuator 231 on the mounting lug 245.

Figure 7:
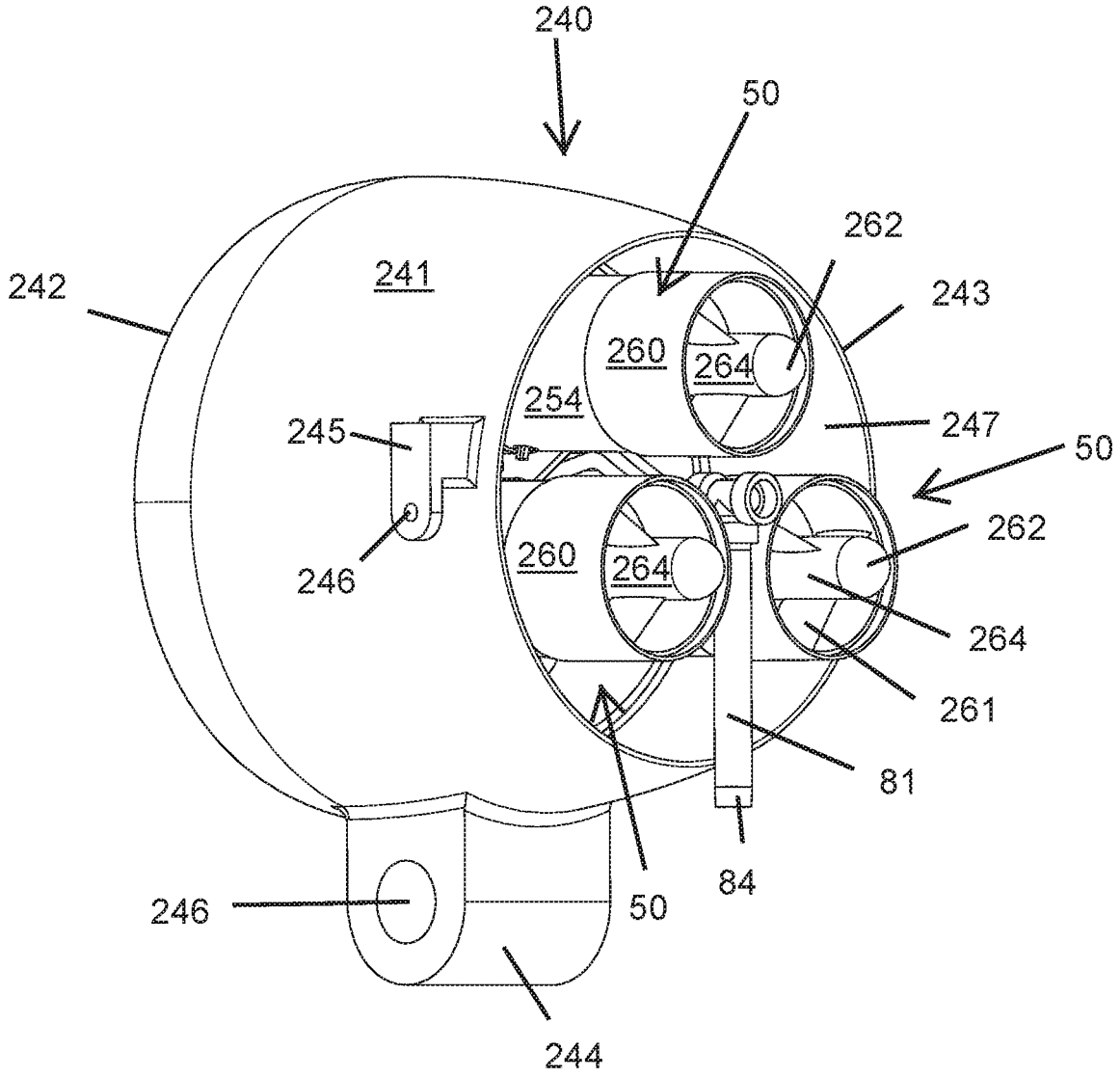
FIG. 7 illustrates an output end perspective view of the outer housing and motor assemblies of FIG. 1.

FIG. 7 shows the outer housing 240 with the motor assemblies 50 mounted within and the supporting structure 220, turntable 210 and actuating assembly 230 removed for clarity. In particular, the mounting assembly 244 with the aperture 246 for receiving the pivoting shaft 226 is shown. Also shown is more detail is the mounting arm 245 extends from one side of the outer surface 241 of the outer housing 240 and has the mounting lug 246. The outer housing 240 has an outer surface 241 extending around the circumference of the outer housing 240 and likewise an internal surface 247. The outer housing 240 is designed in a similar way to that of an aircraft engine nacelle. The design of the outer housing 240 requires attention to both the external shape and the inlet internal geometry. Basically the outer housing 240 is the aerodynamic structure that surrounds the motor assemblies 50. The outer curvature of the cowl rear housing flange at the open forward end 242 is as important as the inner contour shape. The outer cowl rear housing flange at the open forward end 242 is located forward of the fan rotor or impeller 51 and is secured to the outer housing body 241 which surrounds and is substantially coextensive with the motor assemblies 50. Each fan inlet flange 52 extends past the outer cowl rear housing flange at the open forward end 242 such that the fan inlet flange 52 sits in alignment with or outside of the outer cowl rear housing flange at the open forward end 242 and the outer housing 240. The fan inlet flanges 52 and the three motor assemblies 50 are located in the collar 70 to form a largely triangular shape drawn around the three fan inlet flanges 52. The positioning of the fan inlet flange 52 in relation to the outer cowl rear housing flange at the open forward end 242 is important to avoid uneven air pressure that could cause cavitation. The outer housing 240 defines an axially extending annular duct which terminates at the air discharge plane or front cowl at the open rear end 243 upstream of the core motor discharge plane or the end 252 of the air delivery assembly 250.

Figure 8:
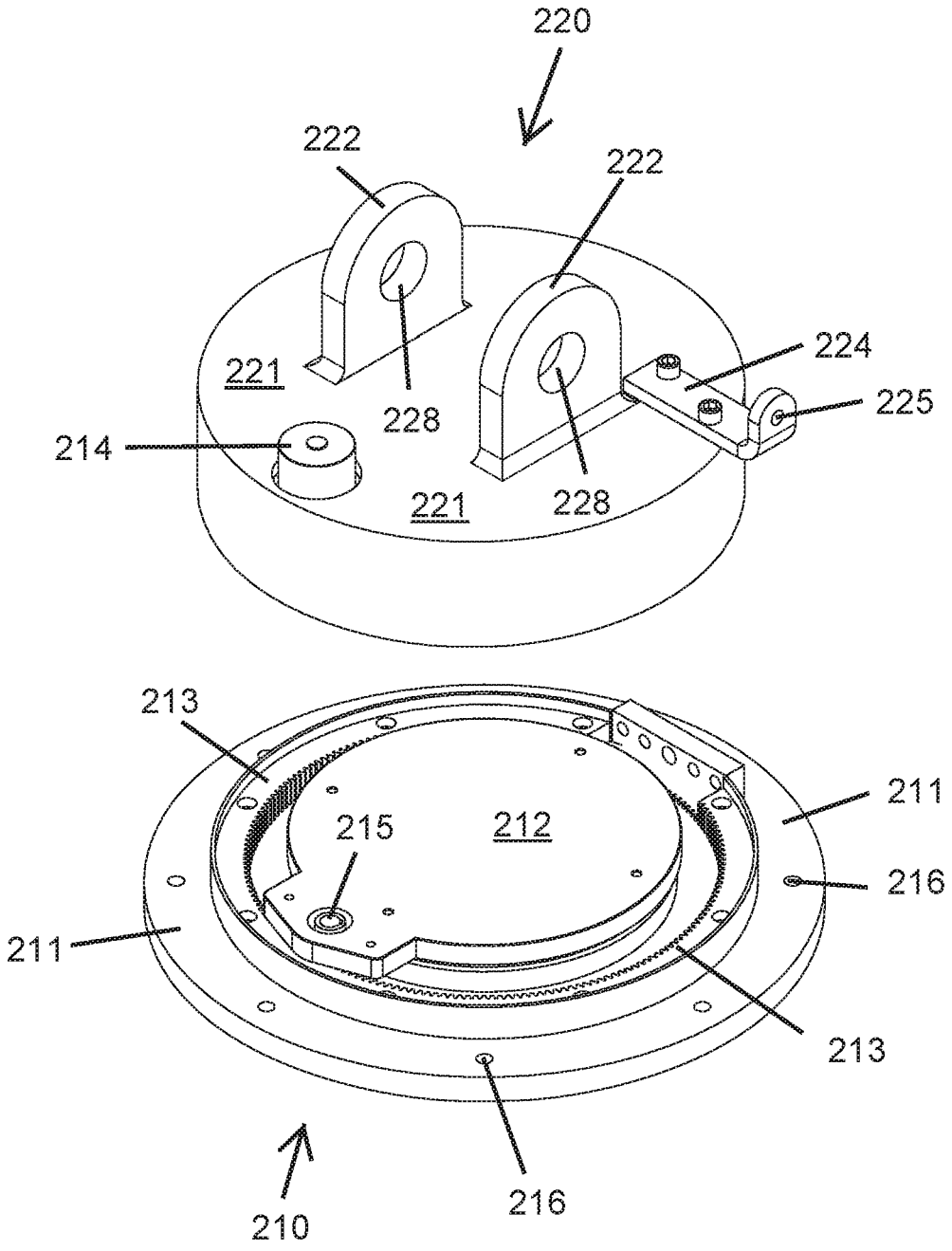
FIG. 8 shows a perspective view of the base and turntable of the fluid flow control device of FIG. 1.

FIG. 8 shows the turntable 210 and the support structure 220 to which the turntable 210 is rotatably mounted. The turntable 210 has a fixed base portion 211 which is mounted or mountable to a surface (not shown). The fixed base portion 211 has a plurality of mounting apertures 216 located around the periphery of the base 211 for receiving a securing device for mounting the turntable 210 to a surface. The surface may be on a vehicle with an extension boom or ladder or may simply be a fixed platform. The platform type is mainly dependent upon the application for which the fluid flow control device 200 is being utilised. The turntable 210 also has a rotating section which is the support base 221 of the supporting structure 220. In order to rotate around the circular arc the fixed base portion 211 and the rotating base portion or support base 221 are separated by a rotating means such as bearing assembly 212 which allows the rotating base portion or support base 221 to rotate both clockwise and anti-clockwise around the fixed base portion 211.

The turntable 210 also has a drive assembly 213, 214, 215 which is mounted to the rotating means 212 to allow the turntable 210 to be driven both clockwise and anti-clockwise. The drive assembly is a hydraulic motor 214 which drives a sprocket or pinion 215 attached to the rotating means 212 around the gear 213. The sprocket or pinion 215 engages on the gear 213 which is securely held in a circular path around the fixed base portion 211 on the turntable 210. The turning of the sprocket or pinion 215 causes the rotating means 212 and subsequently the rotating base portion or support base 221 to turn. While the power to rotate the turntable 210 is described above as being hydraulic fluid power other powering means are not excluded. For example, the power to rotate the turntable 210 may be provided by an electric motor that drives a sprocket or drive belt through a reduction gearbox. Alternatively the motor may be driven by a high pressure fluid or a pneumatic pressure.

The turntable 210 also has limit switches (not shown) to restrict the rotational movement of the fluid flow control device 200. Typically electrical limit switches are positioned on the fixed base portion 211 and can be set to limit the total rotation of the rotating base portion or support base 221 and the fluid flow control device 200 to a pre-determined angular rotation. For example, the fluid flow control device 200 may be limited to movement both clockwise and anti-clockwise, in an arc of approximately 180 degrees to prevent over-rotation of the turntable 210. Alternatively, mechanical limit switches could also be utilised which are fixed to the turntable 210 to limit the rotation of the turntable 210.

Figure 9:
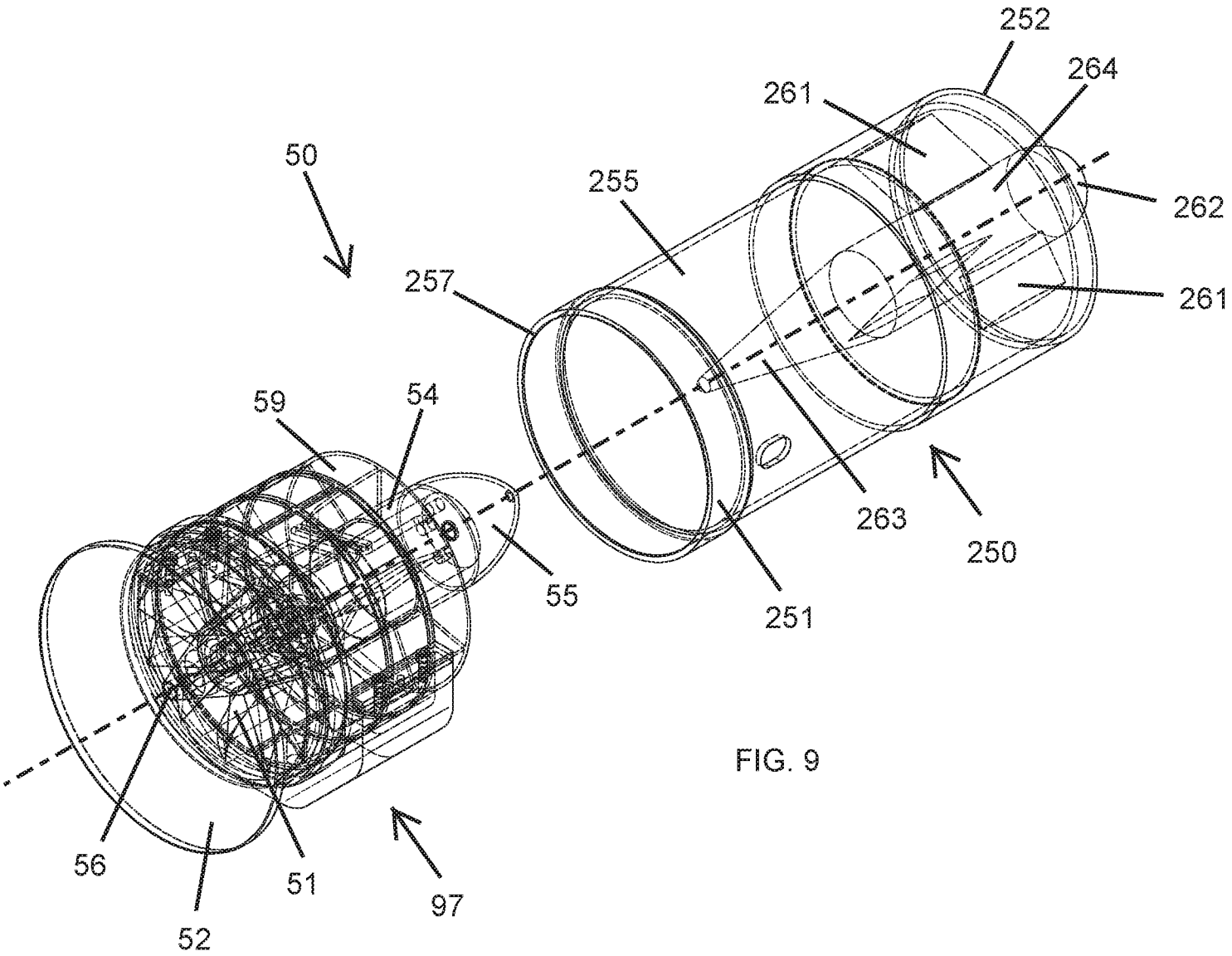
FIG. 9 illustrates a perspective exploded view of one of the motor assemblies of the fluid flow control device of FIG. 1.
Figure 10:
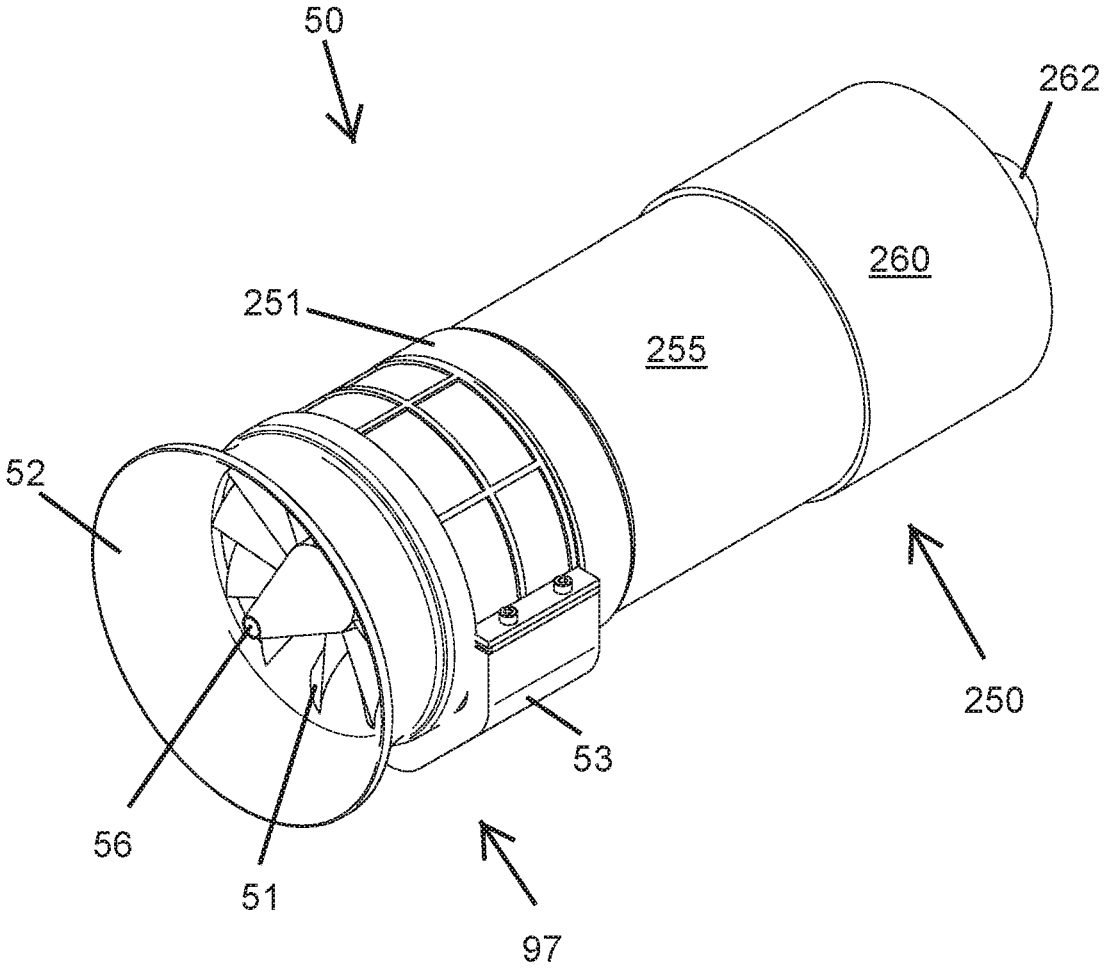
FIG. 10 shows the motor assembly of FIG. 9 in an assembled state prior to installation in the mounting collar of the fluid flow control device of FIG. 1.
Figure 11:
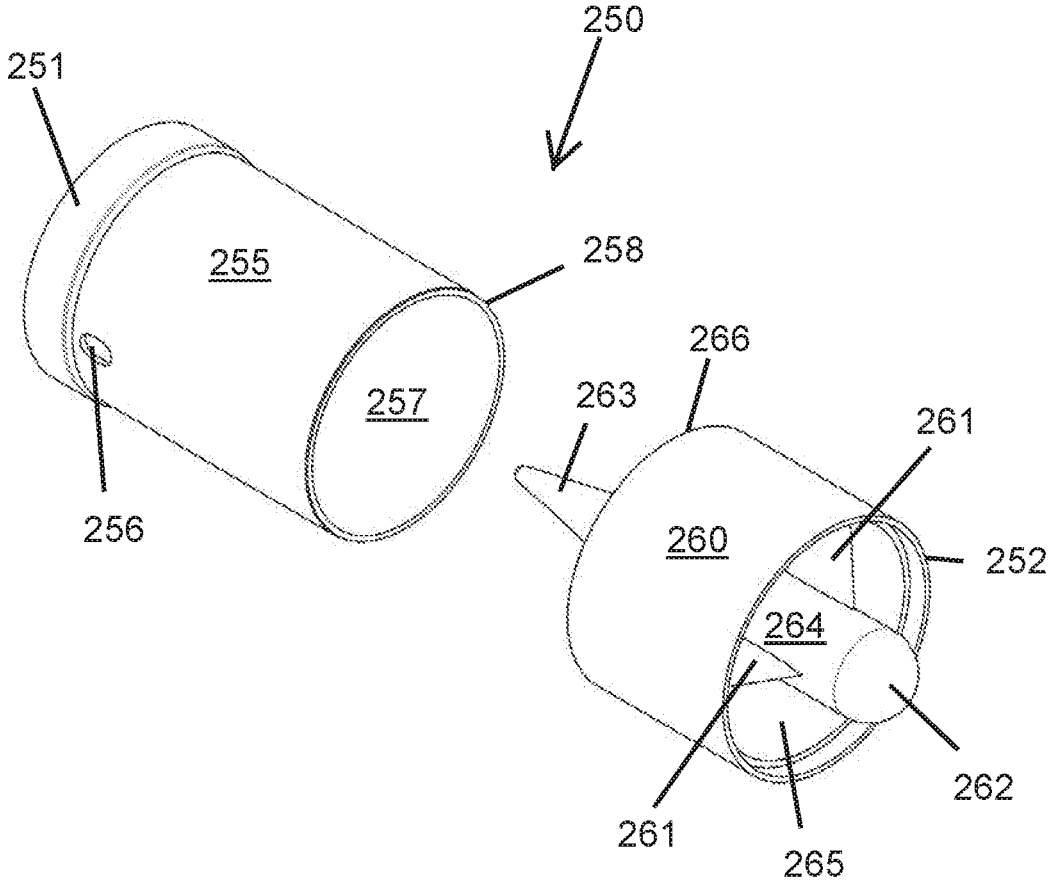
FIG. 11 shows an exploded view of the air directional housing of the motor assembly of FIG. 9.
Figure 12:
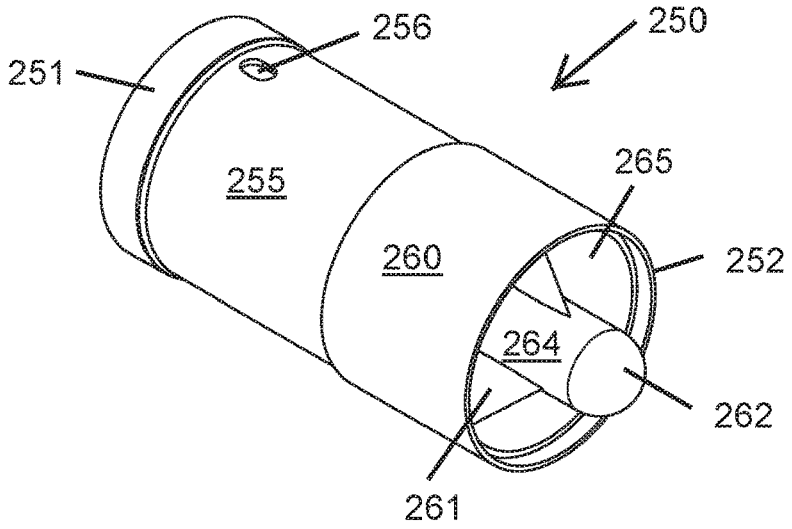
FIG. 12 illustrates an assembled view of the air directional housing of FIG. 11.
Figure 13:
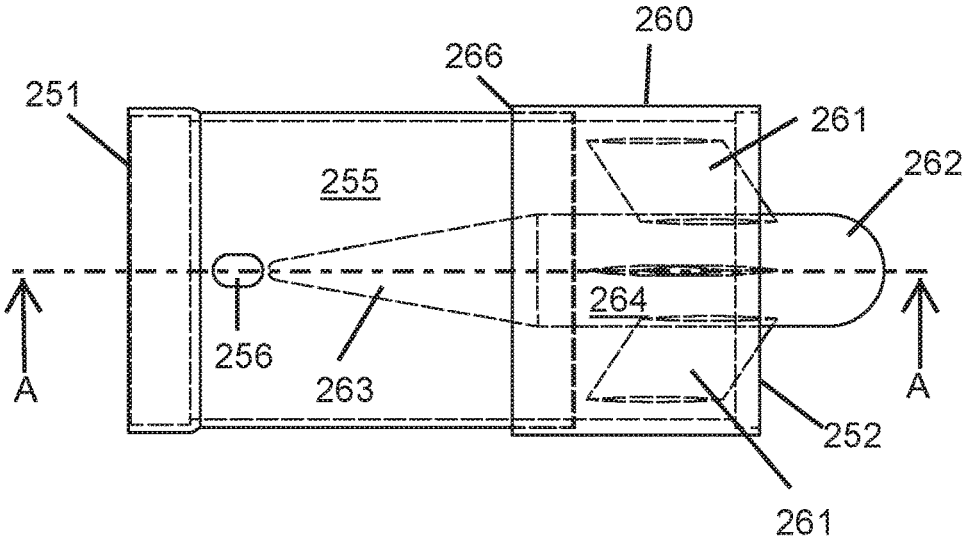
FIG. 13 shows a plan view of the air directional housing of FIG. 12.
Figure 14:
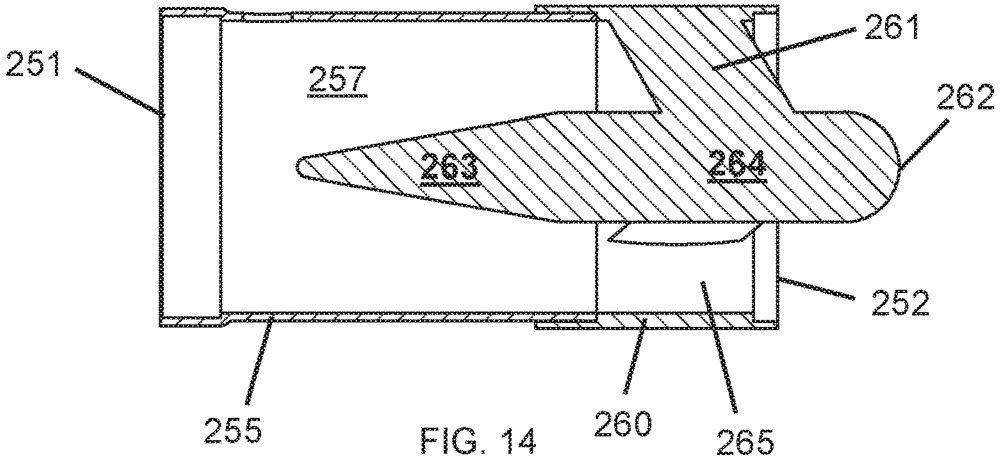
FIG. 14 shows a sectional view taken along line A-A of FIG. 13.
Figure 32:
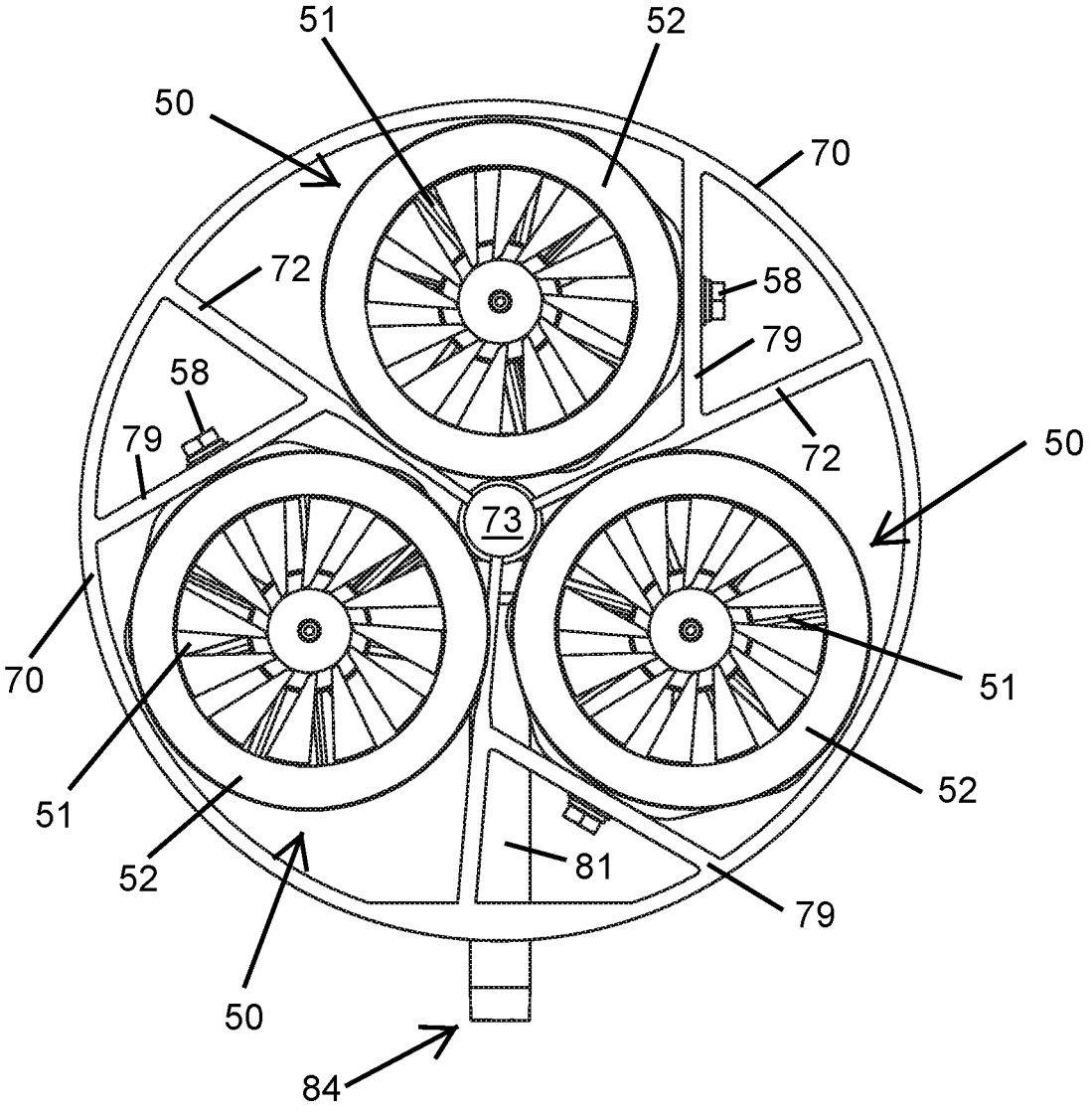
FIG. 32 shows an end view of the motor assemblies mounted in the collar of the fluid flow control device of FIG. 1.

FIGS. 9 to 14 show the motor assemblies 50 broken down into their component parts. FIG. 9 shows an exploded view of the fan assembly 97 and the air delivery assembly 250 and FIG. 10 shows the assembled motor assembly 50. The fan assembly 97 and fan inlet flange 52 are identical to those described in relation to FIGS. 28 to 30 below and will not be repeated here. Likewise the mounting of each motor assembly 50 to the motor mounting collar 70 is the same as that described below but is also shown in FIG. 32. For example, the mounting bracket 53 at either end is mounted or mountable to the fan housing 59 to mounting brackets 65 and is retained in position by fasteners 66. The ends of the brackets 53 have threaded apertures for receiving the fasteners 66 to secure the motor mounting bracket 53 to the fan housing 59. The three motor assemblies 50 are all retained in the same manner around the motor mounting collar 70.

The air delivery assembly 250 directs the air produced by the fan assembly 97 out through the air outlet or open rear end 243 and into the air output region. The air delivery assembly 250 has one end 251 mounted to our abutting the rear end of the fan assembly 97 and an opposing end 252 which forms the air outlet end on each motor assembly 50. The air delivery assembly 250 consists of the fan motor end housing 255 and the air delivery housing 260. One end 251 of the fan motor end housing 255 abuts against the fan assembly 97 and the opposing end 258 is received within the end 266 of the air delivery housing 260. The fan motor end housing 255 is a longitudinally extending annular housing with a substantially uniform cross-sectional shape. The housing 255 encloses and directs the air flow from the fan assembly 97 towards the air delivery housing 260.

The air delivery housing 260 of each motor assembly 50 is an annular outer housing 260 formed around the longitudinal centre axis of each motor assembly 50. The annular outer housing 260 having a substantially open first end 266 for receiving the fan motor end housing 255 and a substantially open second end 252 for discharging the portion of the ambient air which is compressed by the fan blades 51. A central body 262, 263, 264 extends along the longitudinal centre axis of the annular outer housing 260 and is supported by a plurality of circumferentially spaced struts 261 which extend radially between the annular outer housing 260 and the central body 262, 263, 264. The annular outer housing 260, the central body 262, 263, 264 and the struts 261 are shaped to concentrate the air compressed by the fan blades 51 of each one of the motor assemblies 50 to provide the forced air supply for the fluid flow control device 200.

The circumferentially spaced struts 261 extending radially from the annular outer housing 260 mount the central body portions 262, 263, 264 in a position extending along the central axis of each of the motor assemblies 50. The central body is formed from three components which are designed to concentrate the flow of air through and from each motor assembly 50. A first cylindrical shaped body portion 264 extends for the substantial length of the annular outer housing 260 and along the longitudinal centre axis of the motor assembly 50 between the open first end 252 and the open second end 266 of the annular outer housing 260.

A conical shaped portion 263 extends longitudinally away from the first end of the first body portion 264 and tapers along its length to an apex. When assembled, the apex of the conical shaped portion 264 is located adjacent the fan motor end of the fan assembly 97. In this embodiment the apex has a rounded shape, however other shaped apexes are not excluded. On the opposing end of the first body portion 264 a rounded semi-spherical body 262 is mounted and extends away from the first body portion 264. The rounded end 262 extends to a point located externally and a distance from the open second end 252 of the annular outer housing 260. The body 262 extends outwardly a distance from the open second end 252 and continues along the longitudinally extending centre axis of each motor assembly 50.

While the components of the central body have been described as both cylindrical, conical and semi-spherical other shapes could also be utilised above for each of the central body components 262, 263, 264.

The struts 261 which mount the central body portions 262, 263, 264 from the annular outer housing 260 have a leading edge and a spaced apart trailing edge. The leading edge of the struts 261 is the edge contacted first by the forced air or compressed air from the fan assembly 97. Likewise the trailing edge of the struts 261 is the edge located towards the outlet end 252 of the annular outer housing 260. Both the leading and trailing edges of the sturts 261 are formed at an angle with respect to the longitudinal centre axis passing through the centre of each motor assembly 50. Preferably, the angle of the leading and trailing edges is in the range of 10 degrees to 90 degrees. More preferably, the leading and trailing edges of the sturts 261 are formed at an angle of between 30 to 60 degrees with respect to the longitudinal centre axis passing through the centre of each motor assembly 50.

While the struts 261 have been illustrated showing three struts 261, more or less struts 261 may be used provided they support the central body 262, 263, 264 from the outer collar 260.

In another form and as illustrated in FIGS. 15 to 31, shows a fluid flow control device 10 comprises a plurality of motor assemblies 50 mounted at equidistant points around the housing 16. The motor assemblies 50 have been strategically mounted in the housing 16 to optimise the thrust direction of the fluid flow control device 10. The housing 16 has an outer cowling 40 substantially covering the plurality of motor assemblies 50. The outer cowling 40 has both an air input region and an air output region. The air input region is defined by the rear housing flange 41 and the air output region is defined by the front cowl 42. The motor mounting frame 70 is located within and extending around an axis 35 passing through the centreline of the outer cowling 40.

A base assembly 20 supports the housing 16 and the plurality of motor assemblies 50. A fluid flow assembly 80 has a fluid inlet 84 attached adjacent the base assembly 20, and a fluid outlet 82 located adjacent the centreline 35 and within the air output region of the outer cowling 40. Turntable 18 is coupled to the base assembly 20 to allow the fluid flow control device 10 to be rotated in a circular arc around the vertical axis. An actuating assembly 19 is coupled to the base assembly 20 for adjusting an angular position of the fluid flow control device 10 in relation to the turntable 18.

Figure 15:
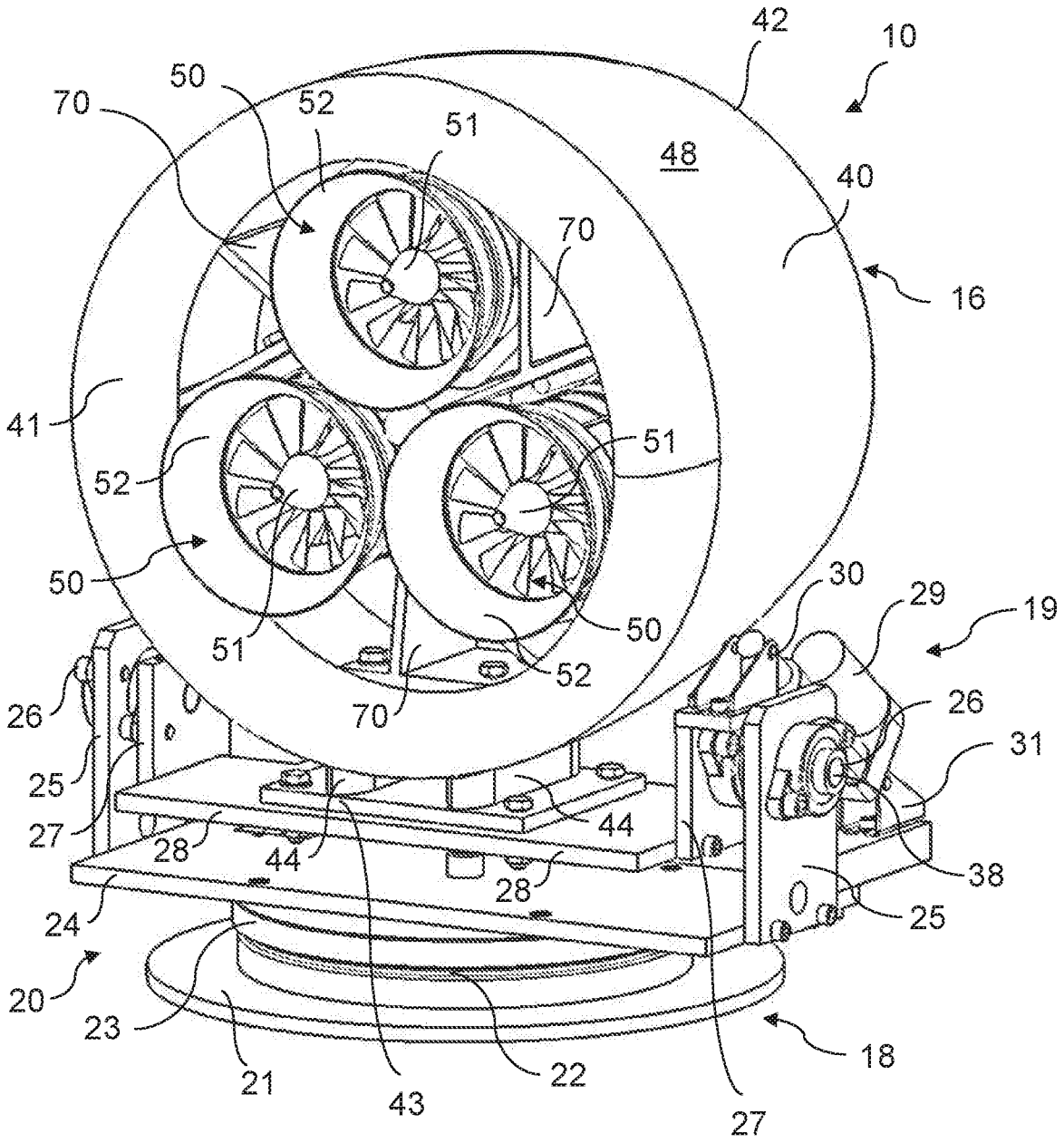
FIG. 15 illustrates an air input end perspective view of the fluid flow control device in accordance with an embodiment of the present invention.
Figure 17:
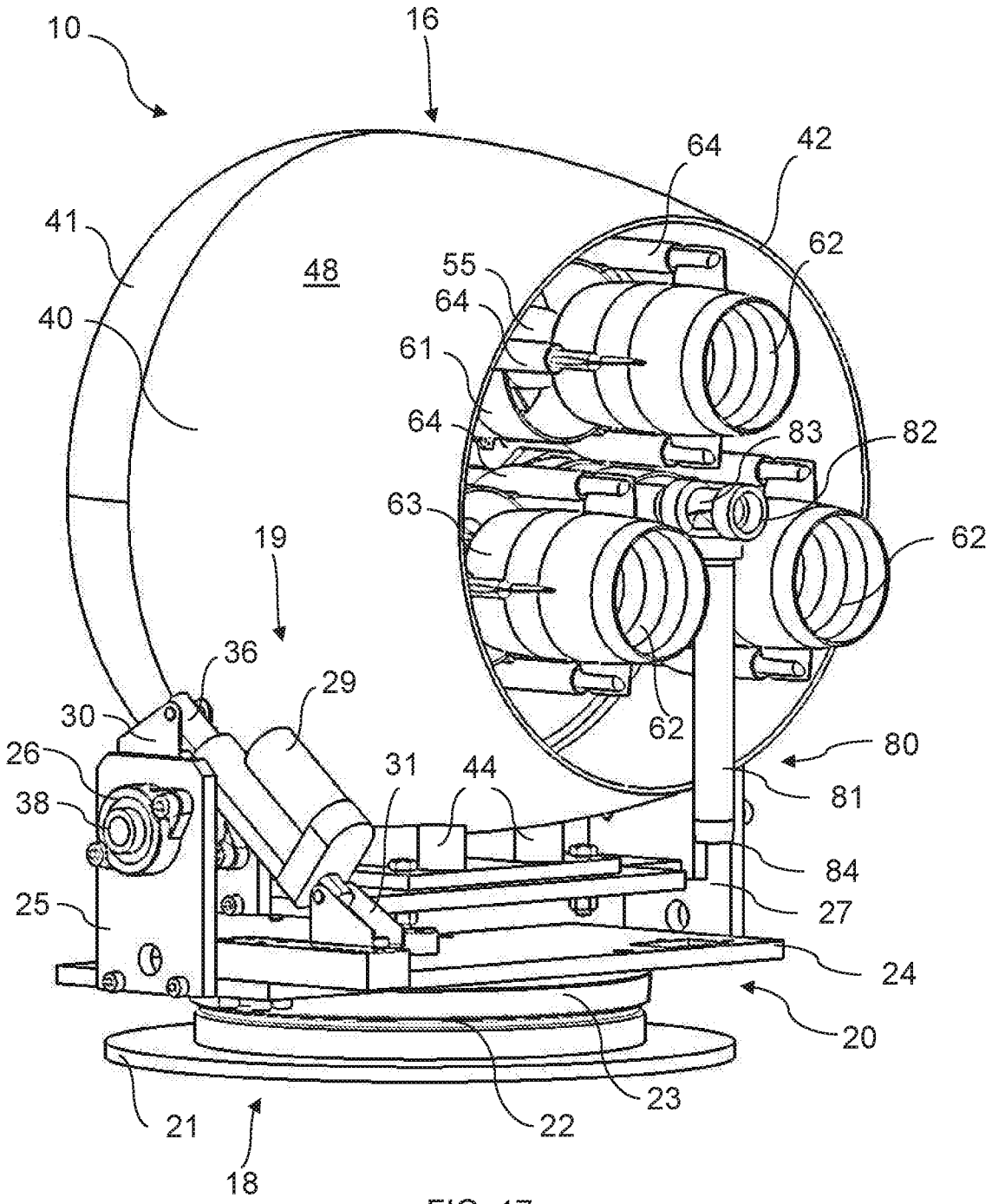
FIG. 17 shows an output end perspective view of the fluid flow control device of FIG. 15.

FIGS. 15 and 17 illustrate both the air input end or rear and output or front perspective views of the fluid flow control device 10 showing three motor assemblies 50 mounted such that the motor assemblies 50 are equally spaced around the motor mounting collar 70. As illustrated a centre line passing through the centre of each motor assembly 50 is equally spaced around the collar 70 at an angle of 120 degrees between each centre line. While the current angular displacement around the collar 70 is 120 degrees it will be realised that other combinations can be utilised and each combination is largely dependent upon the number of motor assemblies 50 utilised and the particular application to which the fluid flow control device 10 is applied.

The present application as illustrated is particularly useful in the application of fighting fires. Each motor assembly 50 has a fan rotor or impeller 51 which drags air through a fan inlet flange 52 on each motor assembly 50. Each fan inlet flange 52 is located adjacent the air inlet region of the fluid flow control device 10 and bordering the rear housing flange 41. The motor assemblies 50 are mounted within the motor mounting collar 70 and the outer cowl 40 is mounted around the motor mounting collar 70. The outer cowl 40 is a cylindrical tube shaped cowling designed to concentrate the flow of air through and from the fluid flow control device 10. Alternatively, the outer cowl or nacelle 40 is aerodynamically shaped annular cowling used as a chamber to concentrate the flow of air through and from the fluid flow control device 10. The outer cowl 40 has two fan cowl supports 44 which are mounted to the outer cowl connector base 43 which is bolted to the base 20. The fan cowl supports 44 have apertures 47 within for receiving the collar mounting brackets 71 and mounting bolts 45 connected through the cowl connector base 43 for mounting the motor assemblies 50 and the outer cowling 40 to the base 20 and turntable 18.

The base assembly 20 consists of a number of components which allow the base to be pivoted or tilted up and down. The base assembly 20 has a pivoting mounting assembly attached between the housing and the turntable 23. The actuating assembly 19 moves the housing 16 up and down to adjust the angular position with respect to the turntable 18. The pivoting mounting assembly has a first base portion 24, 25, 26 fixed to the turntable 18 and a second base portion 26, 27, 28 pivotally mounted to the first base portion 24, 25, 26. The first base portion has a mounting plate 24 which is fixed to the top of the turntable 18. Mounted at either end of the mounting plate 24 are two vertical upright brackets 25. Each bracket 25 contains a bearing assembly 26 and a pivoting shaft 38 which is used to pivotally mount the second base portion to the first base portion. The bearing assembly 26 is a self-aligning bearing assembly and forms half of a twin bearing assembly 26 with the other half of the twin bearing mounted in the second base portion 27, 28.

The second base portion 26, 27, 28 has a motor assembly base support 28 with two vertical tilt brackets 27 located at either end of the base support plate 28. The motor assembly base support 28 and the two vertical tilt brackets 27 are pivoted around a bearing assembly 26 located within the vertical tilt brackets 27. The pivot shaft 38 is located within each bearing assembly 26 on either end of the base assembly 20. The self-aligning bearing assembly 26 may consist of self aligning ball bearings, spherical roller bearing or spherical roller thrust bearing. Self-aligning ball bearings are constructed with the inner ring and ball assembly contained within an outer ring that has a spherical raceway. This construction allows the bearing to tolerate a small angular misalignment resulting from shaft or housing deflections or improper mounting. The spherical roller bearing is a rolling-element bearing that permits rotation with low friction, and permits angular misalignment. Typically these bearings support a rotating shaft in the bore of the inner ring that may be misaligned in respect to the outer ring. The misalignment is possible due to the spherical internal shape of the outer ring and spherical rollers. The spherical roller thrust bearing is a rolling-element bearing of thrust type that permits rotation with low friction, and permits angular misalignment. The bearing is designed to take radial loads, and heavy axial loads in one direction.

In order to move the second base portion around the bearing assemblies 26 and the pivot shaft 38 an actuating assembly 19 is mounted between the first and second base portions to adjust the vertical angular position of the fluid flow control device 10 in relation to the turntable 18. The actuating assembly 19 has a linear actuator 29 with an extending screw rod 36. The extending screw rod 36 is fixed to the top of the vertical tilt bracket 27 via a tilt mount 30 and the opposite end of the actuator 29 is fixed to the base support 28 via a fixed end bracket 31. Operation of the actuator 29 and extension or retraction of the extending screw rod 36 will cause the vertical angular position of the fluid flow control device 10 to be adjusted up or down to suit the required position for operation. While an electric actuator 29 has been illustrated and described, it should also be understood that other types of actuator 29 could be utilised. For example, a hydraulic actuator or a pneumatic actuator and associated components could also be used to extend or retract the extending screw rod 36 to cause the vertical angular position of the fluid flow control device 10 to be adjusted up or down to suit the required position for operation.

Finally in order to rotate the fluid flow control device 10 around the circular arc the turntable 18 consists of a fixed base portion 21 which can be mounted or is mountable to a support surface and rotatable base portion 23. Between the fixed base portion 21 and rotatable base portion 23 is a rotating means such as bearing 22 which allows the fluid flow control device 10 to move clockwise or anti-clockwise around the vertical axis.

Figure 16:
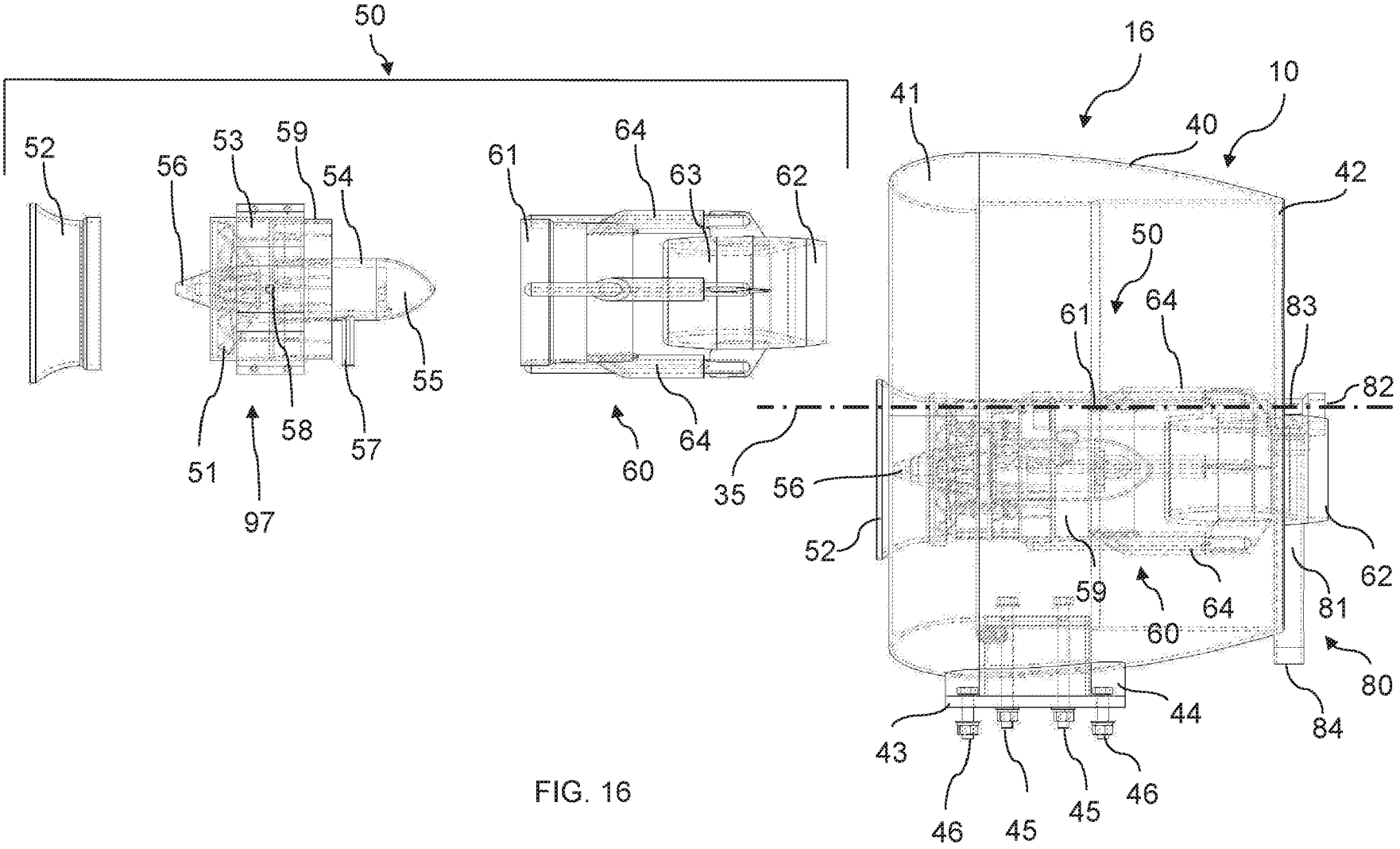
FIG. 16 shows a detailed side view of the fluid flow control device of FIG. 15 showing one motor assembly drawn in an exploded view showing the main components of the motor assembly.

FIG. 16 illustrates a more detailed view of the fluid flow control device 10 showing one of the motor assemblies 50 in an exploded view and for clarity purposes the base assembly 20 and the turntable 18 have been removed.

Each motor assembly 50 is comprised of a fan inlet flange 52, a fan assembly 97 and a fan air directional cowl 60. The fan inlet flange 52 is designed to direct an air stream into the fan assembly 97. The fan inlet or intake 52 is horn shaped to bring free stream air into the fan assembly 97. The inlet or intake 52 sits upstream of the fan assembly 97 and, while the inlet 52 does no work on the flow, inlet performance has a strong influence on motor net thrust.

The fan assembly 97 includes the rotor cone 56, the fan rotor or impeller 51, the fan motor 54, the ducted fan housing 59 and the tail or aft cone 55. The rotor cone 56 and fan inlet flange 52 keep the airflow laminar, or smooth, as it enters the fan 51. This increases the efficiency of the ducted fan unit. The rotation of the fan rotor 51, or impeller, is what drives the air through the fan assembly 97. The ducted fan housing 59 is what contains and directs the airflow. The profile or shape of this housing is critical to the efficiency of the ducted fan assembly 97. The ducted fan housing 59 also contains stators or stationary fan blades 91 inside the ducted fan housing 59 that straightens the air flow as it passes the stator blades 91. When a fan assembly 97 is housed in a shroud, the rotation of the fan blades 51 will cause the air to move radially as well as axially. This rotation of the air would cause turbulence which would reduce the efficiency of the ducted air fan assembly. The stator or stationary fan blades 91 are designed to centralise the fan rotor blades 51 with minimum blade to housing clearance and provide an inside diameter to maximise output thrust. The stator or stationary fan blades 91 also help to reduce the turbulence.

The fan motor 54 is what provides the torque to turn the fan rotor 51. While an electric fan motor 54 is illustrated it will be appreciated, however, that the fan motor 54 is not so limited. Other forms of powering and types of fan motor 54 include for example, a hydraulic motor driven by hydraulic fluid pressure, or an air fan motor driven by pneumatic pressure. Alternatively, the fan motor 54 may be driven by high pressure fluid. For example, water-driven radial inflow turbines at the front end of the shaft driving an axial fan. The fan motor 54 can be driven by either AC or DC electric current. The aft cone 55 reduces or minimises turbulence caused by the air passing over the fan motor 54.

The fan air directional cowl 60 directs the air produced from the fan assembly 97 out through the front cowl or air outlet 42 and into the air output region. The fan air directional cowl 60 has one end 61 mounted to our abutting the rear end of the fan assembly 97 and an opposing end 62 which forms the air outlet and is located within and adjacent the front cowl 42. Located forward and abutting the end 62 is housing 63. The housing 63 is attached to the end 61 via connector arms 64. The connector arms 64 are adapted to allow the housing 63 to be moveable or longitudinally extended towards and away from the end 61. This effectively controls the specific air flowing through or from each motor assembly 50 and allows the user to further refine the air stream flowing out of the air output region defined by the front cowl 42. The housing 63 can therefore be extended or retracted automatically by actuators (not shown) located on the connector arms 64 to a position determined in relation to the requirements or application of the fluid flow control device 10. Alternatively, the housing 63 can be completely detached from the connector arms 64 and the fan air directional cowl 60 should the need arise for a particular application. For example, to enhance fluid saturation at moderate distances.

Each motor assembly 50 is mounted or mountable by the bracket 53 which is attached to either side of the fan assembly 97 and is retained in the motor mounting collar 70 by mounting bolt 58. The three motor assemblies 50 are all retained in the same manner around the motor mounting collar 70. The motor mounting collar 70 is mounted through the outer cowl supports 44 by mounting brackets 71 which pass through apertures 47 in the outer cowl 40 and are fixed to the motor base connector plate 43 by bolts 45. The motor base connector plate 43 would then be secured to the motor assembly base support 28 by bolts 46.

Also shown in FIG. 16 at the front or air outlet end of the housing 16 is the fluid flow assembly 80 positioned to allow the fluid to be influenced by the air thrust from the motors assemblies 50. The fluid flow assembly 80 is comprised of fluid inlet 84, piping 81, T-junction piece 83 and the fluid outlet 82. The fluid outlet 82 and the T-junction piece 83 are substantially aligned with the centreline axis 35 passing through the housing 16. The opposing end of the T-junction to the outlet 82 is secured to the centre support 76 of the motor mounting collar 70. The inlet 84 is fixed to a bracket (not shown) mounted to the base assembly 20. The fluid flow assembly 80 may include a universal pivot attachment fixed to the fluid inlet 84 that is designed to retract and release a fluid hose (not shown) while the fluid flow control device 10 is being manoeuvred into position.

Figure 18:
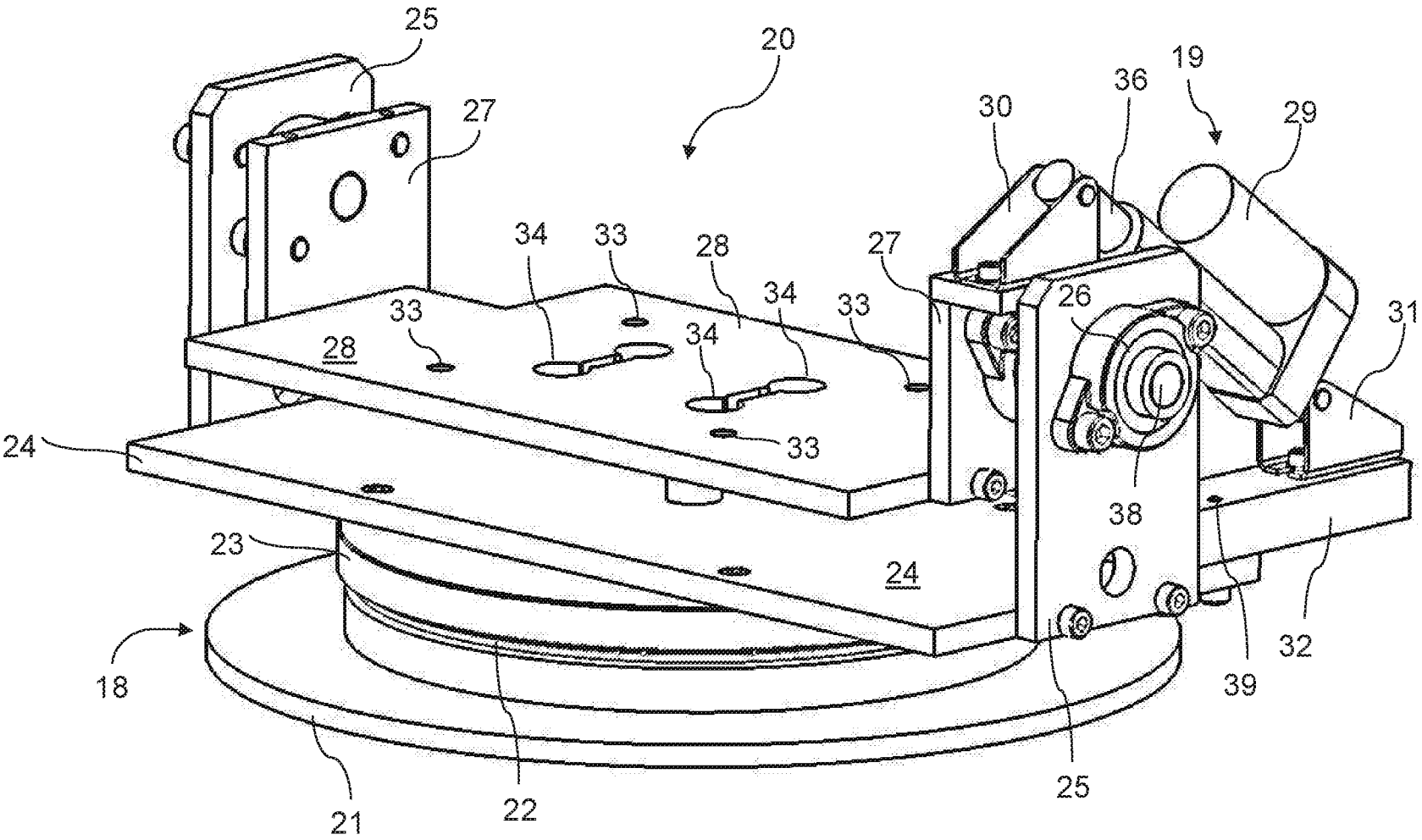
FIG. 18 shows a perspective view of the base and turntable of the fluid flow control device of FIG. 15.

FIG. 18 shows the base assembly 20, the turntable 18 and the actuating assembly 19. The turntable 18 has a fixed base portion 21 which is mounted or mountable to a surface (not shown). The surface may be on a vehicle with an extension boom or ladder or may simply be a fixed platform. The platform type is mainly dependent upon the application for which the fluid flow control device 10 is being utilised. The turntable 18 also has a rotating base portion 23 which is mounted to the mounting plate 24. In order to rotate around the circular arc the fixed base portion 21 and the rotating base portion 23 are separated by a rotating means such as bearing assembly 22 which allows the rotating base portion 23 to rotate both clockwise and anti-clockwise around the fixed base portion 21.

The turntable 18 also has a drive assembly (not shown) which is mounted to the rotating means 22 to allow the turntable to be driven both clockwise and anti-clockwise. Typically the power to rotate the turntable 18 is provided by an electric motor that drives a sprocket or drive belt through a reduction gearbox. The sprocket or drive belt engages on a chain or track which is securely held in a circular path around the rotating base portion 23 on the turntable 18. The turning of the sprocket or the drive belt causes the rotating base portion 23 to turn. Alternatively, the electric motor may simply drive a gear attached to the bearing assembly 22 which provides the rotation of the turntable 18.

The drive motor may be driven as described above by an electric current either AC or DC or alternatively the motor may be driven by hydraulic fluid pressure, a high pressure fluid or a pneumatic pressure. The turntable 18 also has limit switches (not shown) to restrict the rotational movement of the fluid flow control device 10. Typically electrical limit switches are positioned on the fixed base portion 21 and can be set to limit the total rotation of the rotating base portion 23 and the fluid flow control device 10 to a pre-determined angular rotation. For example, the fluid flow control device 10 may be limited to movement both clockwise and anti-clockwise, in an arc of approximately 180 degrees to prevent over-rotation of the turntable 18. Alternatively, mechanical limit switches could also be utilised which are fixed to the turntable 18 to limit the rotation of the turntable 18.

The base assembly 20 as described above is comprised of two components, a pivoting mounting assembly and the turntable 18. The pivoting mounting assembly has a first base portion 24, 25, 26 fixed to the turntable 18 and a second base portion 26, 27, 28 pivotally mounted to the first base portion 24, 25, 26. FIG. 18 shows a detailed view of the first base portion with the mounting plate 24 fixed to the top of the rotating base portion 23 of the turntable 18. The second base portion 26, 27, 28 is pivotally mounted to the first base portion by the pivot shaft 38 and the bearing assemblies 26 which allow the second base portion and the fluid flow control device 10 to be moved up and down in a vertical plane. The base support plate 28 shows a number of mounting apertures 33, 34 which are utilised to mount the motor collar 70 and the outer cowling 40 to the base support plate 28. The four apertures 33 are adapted to receive bolts 46 which secure the fan cowl connector base 43 to the base support plate 28. The four apertures 34 are adapted to receive bolts 45 which secure motor collar 70 and the motor assemblies 50 to the base support plate 28. Pairs of the apertures 34 are joined by a slot in the base support plate 28 of the motor collar 70 and receive the bolts 45 to centralise and secure the fluid flow control device 10. The slots between the apertures 34 are utilised for the connection of the power for each fan motor 54. For example in the case of an electric current powered device wiring may be routed through the slots and into the collar 70 to power each fan motor 54 respectively.

FIG. 18 also illustrates the actuating assembly in more detail. As described above in order to move the second base portion around the bearing assemblies 26 and the pivot shaft 38 the actuating assembly 19 is mounted between the first and second base portions to adjust the vertical angular position of the fluid flow control device 10 in relation to the turntable 18. The linear actuator 29 is fixed to the base support 28 via a fixed end bracket 31 and the actuator base plate 32. The base plate 32 is fixed to base support plate 28 by mounting screws 39 and the fixed end bracket 31 is then fixed to the base plate 32. This secures one end of the actuator 29 and the opposite end or the extending screw rod end 36 is mounted to the top of the vertical tilt bracket 27 via a tilt mount 30. Operation of the actuator 29 and extension or retraction of the extending screw rod 36 will cause the vertical angular position of the fluid flow control device 10 to be adjusted up or down to suit the required position for operation. The actuating assembly 19 moves the housing 16 vertically up and down to adjust the angular position with respect to the turntable 18. The actuating assembly 19 may also include limit switches either electrical or mechanical to limit the extension of the actuator 29.

Figure 19:
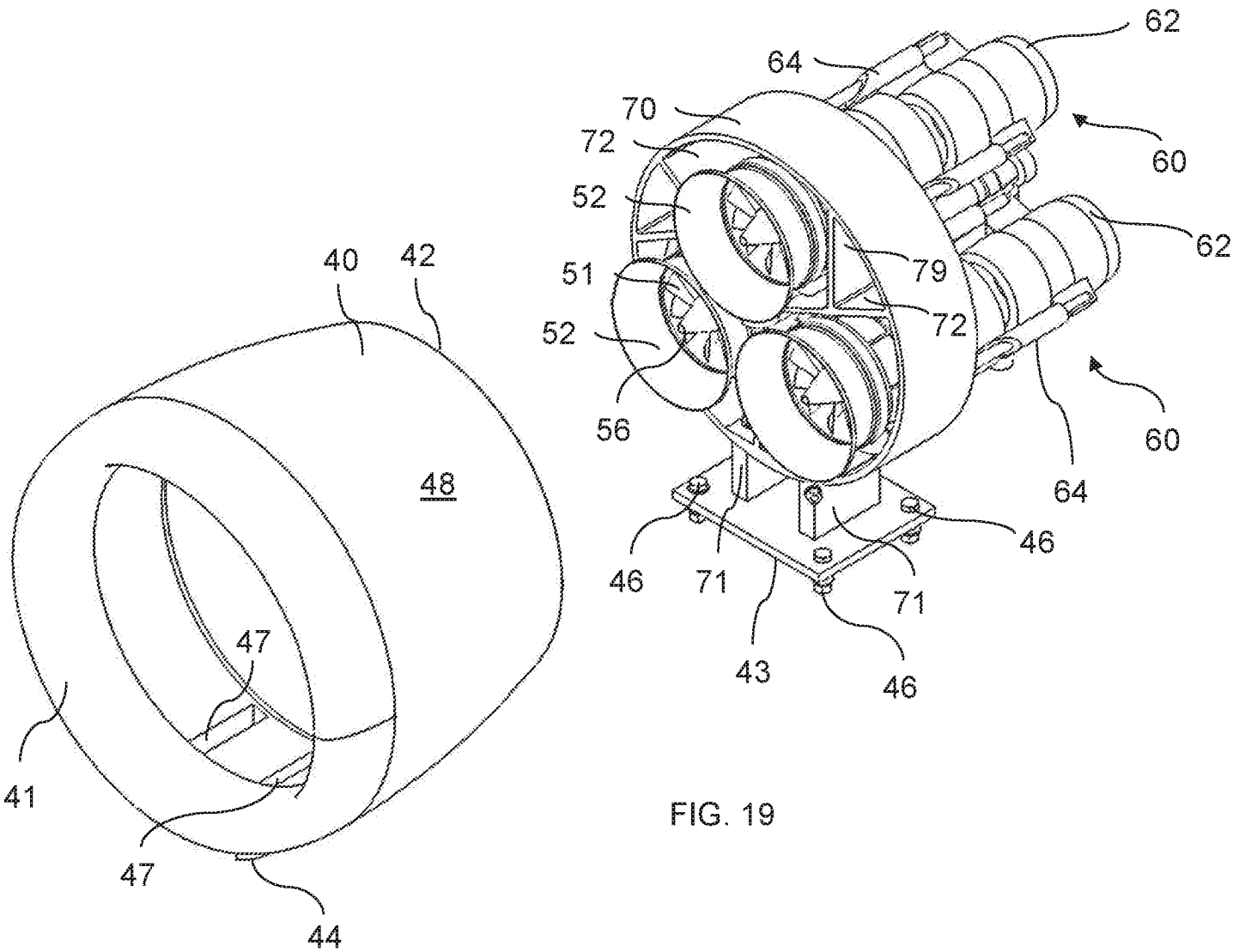
FIG. 19 shows an exploded view of the motor assemblies mounted in the collar and the outer cowling of the fluid flow control device of FIG. 15.
Figure 20:
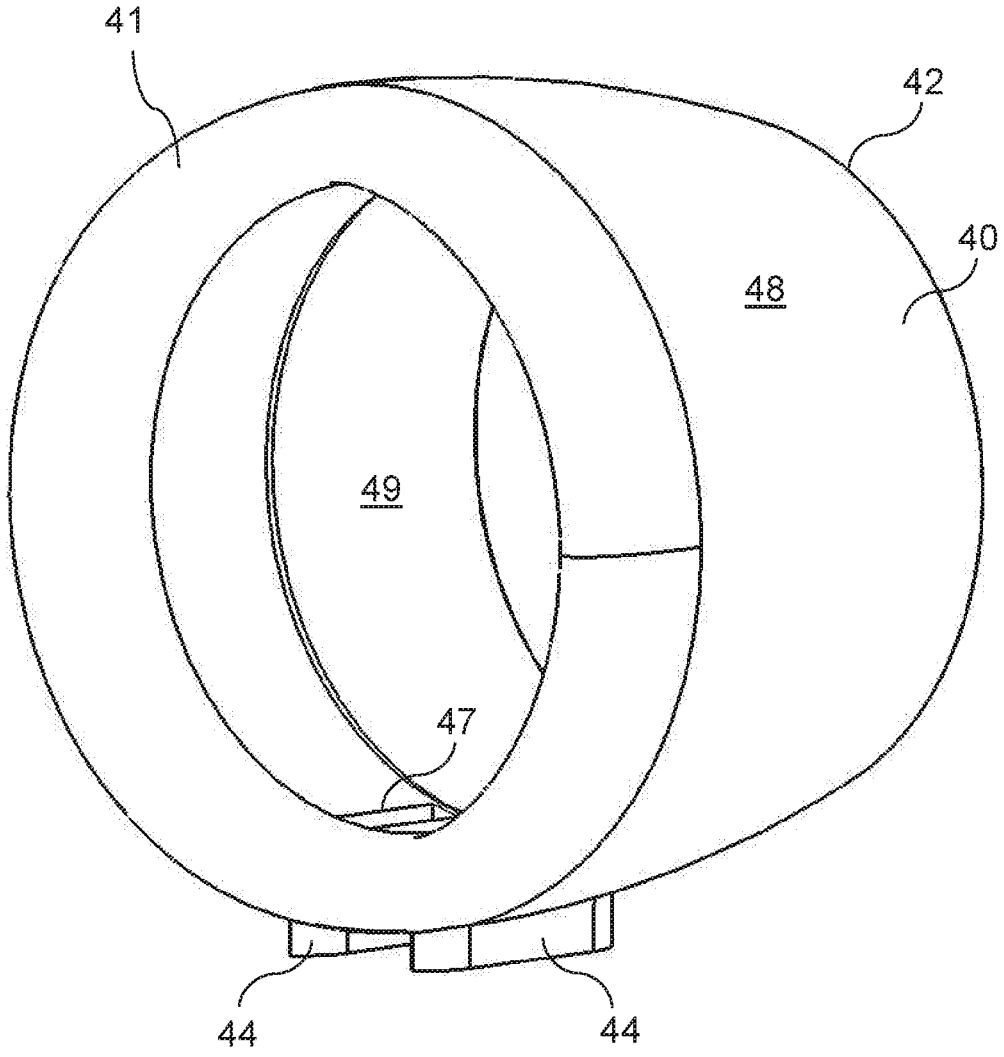
FIG. 20 shows a perspective view of the outer cowling of the fluid flow control device of FIG. 15.

FIGS. 19 to 25 illustrate in more detail the motor collar 70, the motor assemblies 50 and the outer cowling 40. In FIGS. 19 and 20 the outer cowling 40 has an outer surface 48 extending around the circumference of the cowling 40 and likewise an internal surface 49. The outer cowling 40 is designed in a similar way to that of an aircraft engine nacelle. The design of the outer cowling 40 requires attention to both the external shape and the inlet internal geometry. Basically the outer cowl 40 is the aerodynamic structure that surrounds the motor assemblies 50. The outer curvature of the cowl rear housing flange 41 is as important as the inner contour shape. The outer cowl rear housing flange 41 is located forward of the fan rotor or impeller 51 and is secured to the outer cowl body 48 which surrounds and is substantially coextensive with the motor assemblies 50. Each fan inlet flange 52 extend past the outer cowl rear housing flange 41 such that the fan inlet flange 52 sits in alignment with or outside of the outer cowl rear housing flange 41 and the outer cowling 40. The fan inlet flanges 52 and the three motor assemblies 50 are located in the collar 70 to form a largely triangular shape drawn around the three fan inlet flanges 52. The positioning of the fan inlet flange 52 in relation to the outer cowl rear housing flange 41 is important to avoid uneven air pressure that could cause cavitation. The outer cowl 40 defines an axially extending annular duct which terminates at the air discharge plane or front cowl 42 slightly upstream of the core motor discharge plane or end 62 of the fan air directional cowl 60.

The outer cowl 40 has two slotted apertures 47 for receiving the motor collar mounting brackets 71 and associated mounting bolts 45. The apertures 47 extend through the outer cowl 40 from the inner surface 49 to the outer surface 48. The fan cowl supports 44 extend from the bottom surface of the outer cowl 40 and are aligned with the apertures 47 at the bottom of the outer cowl 40. The collar mounting brackets 71 and the mounting bolts 45 extend through the apertures 47 so that the collar 70 can be mounted or is mountable to the fan cowl connector base 43.

Figure 21:
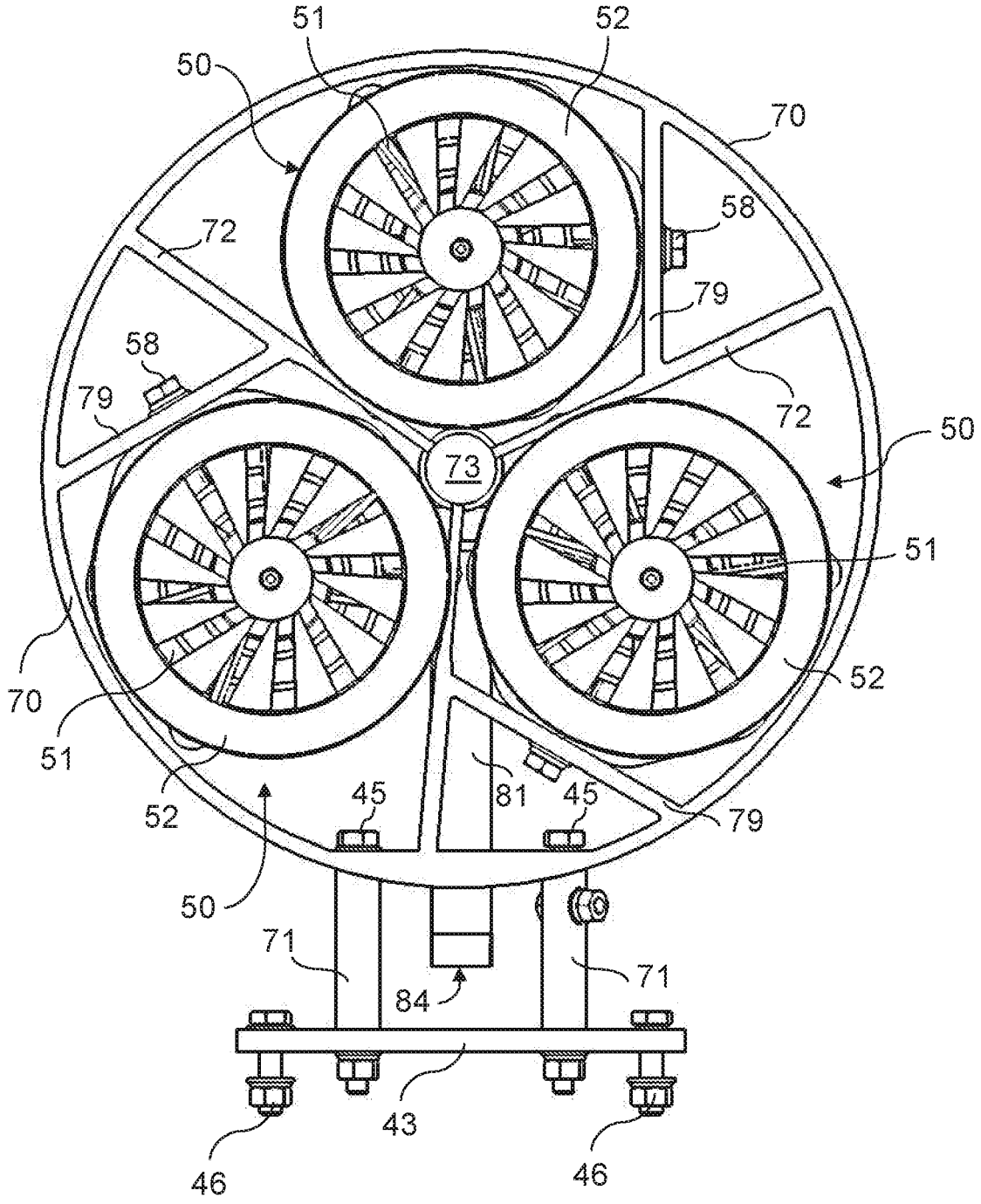
FIG. 21 shows an end view of the motor assemblies mounted in the collar of the fluid flow control device of FIG. 15.
Figure 22:
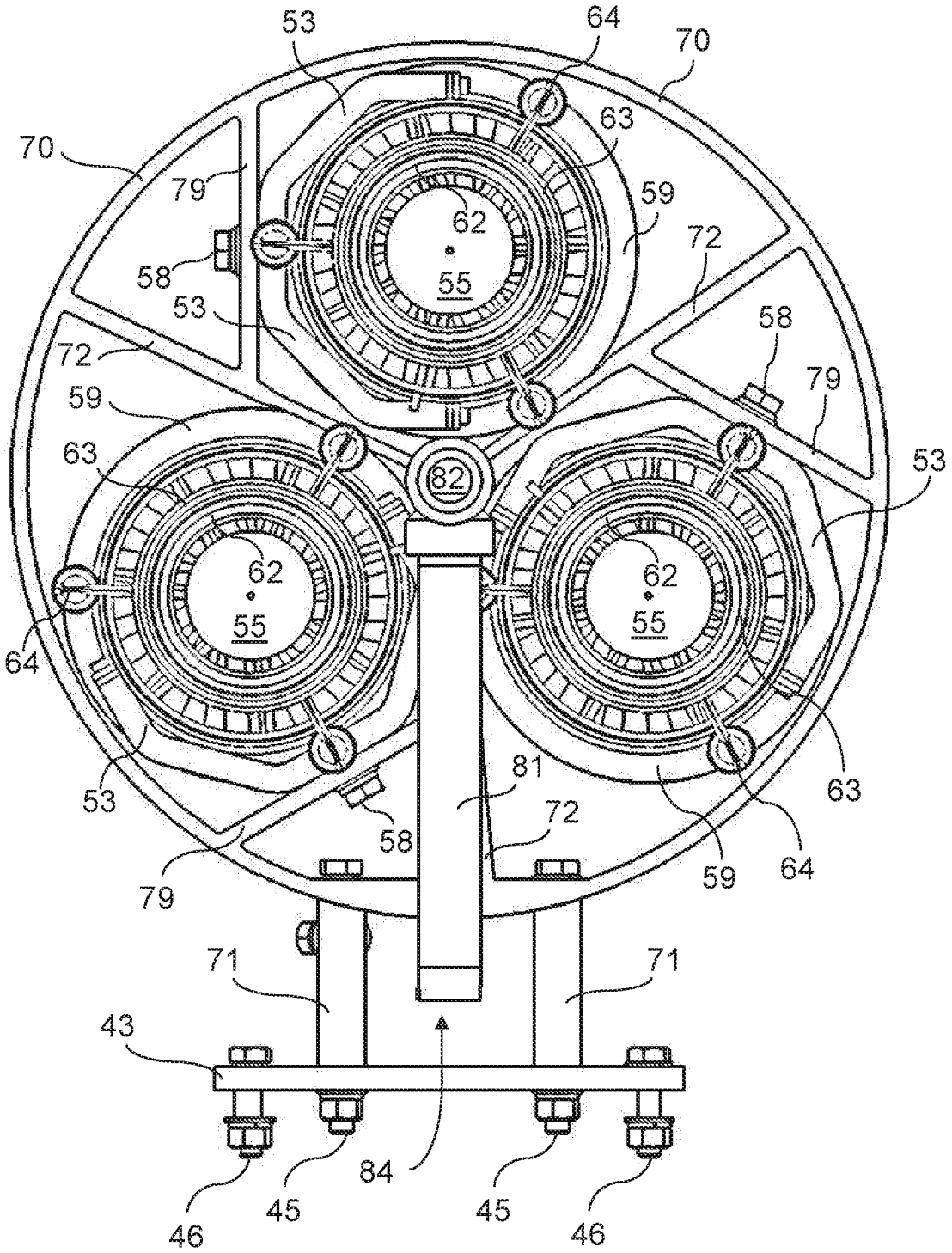
FIG. 22 illustrates another end view of the motor assemblies mounted in the collar of the fluid flow control device of FIG. 15.

FIGS. 21 and 22 show a rear and front views of the collar 70 with the motor assemblies 50. The collar 70 has a central core support 76 from which three collar motor mounting arms 72 extend outwardly from the centre to the collar inner surface 74. Extending from the collar motor mounting arms 72 are motor brace arms 79 to which the motor assemblies 50 are secured. The motor brace arms 79 are fixed at one end to a collar motor mounting arm 72 and at the other end to the inner surface 74 of the collar 70. Each motor assembly 50 is supported on or by the collar inner surface 74, at least one of the collar motor mounting arms 72, centre core support 76 and a motor brace arm 79. At the rear end of the motor collar 70 a cone 73 is placed over the end of the centre core support 76 to provide a streamlined entry for any air passing through and around the centre of the collar 70.

FIG. 22 shows the front or air outlet end of the collar 70 with the motor assemblies 50 mounted equidistantly around the collar 70. The motor assemblies 50 are mounted to the motor brace arms 79 by mounting arms 53 which extend a distance around the outside of each motor assembly 50. A bolt 58 secures the motor assembly 50 and the mounting arm 53 to the motor brace arm 79. Also from this end the fluid flow assembly 80 is located in the centre of the collar 70 and mounted at one end to the centre core support 76. The fluid inlet 84 is located approximate the base assembly 20 and the fluid inlet pipe 81 extends upwardly towards the centre of the collar 70. A T-junction piece 83 is mounted on the end of the fluid inlet pipe 81 with one end of the T-junction piece 83 extending towards the fluid outlet 82 and the other end mounted to the centre core support 76.

A nozzle or nozzles (not shown) can be mounted on the fluid outlet end 82 to control the direction or characteristics of the fluid flow as it exits the fluid outlet 82. Typically a nozzle is simply a pipe or tube of varying cross sectional area, and used to direct or modify the flow of a fluid (liquid or gas). Nozzles are frequently used to control the rate of flow, speed, direction, mass, shape, and/or the pressure of the stream that emerges from the nozzle. The present invention can be used with or without a nozzle in the end of the fluid outlet 82. The use of a nozzle is dependent upon the application for which the fluid flow control device 10, 200 is being utilised. For example, when used in the application of fire-fighting a nozzle would be used to disperse a fire-fighting fluid to extinguish flames. The nozzle in combination with the thrust from the motor assemblies provides a high velocity fluid stream which is extremely useful in fighting fires where it is somewhat impossible for the fire-fighting unit to get close enough to extinguish the fire due to high temperatures and intense flames. The nozzle or nozzles may also be remotely controlled to vary the fluid stream exiting the nozzle. Nozzles can also be interchangeable for different application to suit the required output of fluid. For example, a foam nozzle may be used in fire fighting applications.

Figure 23:
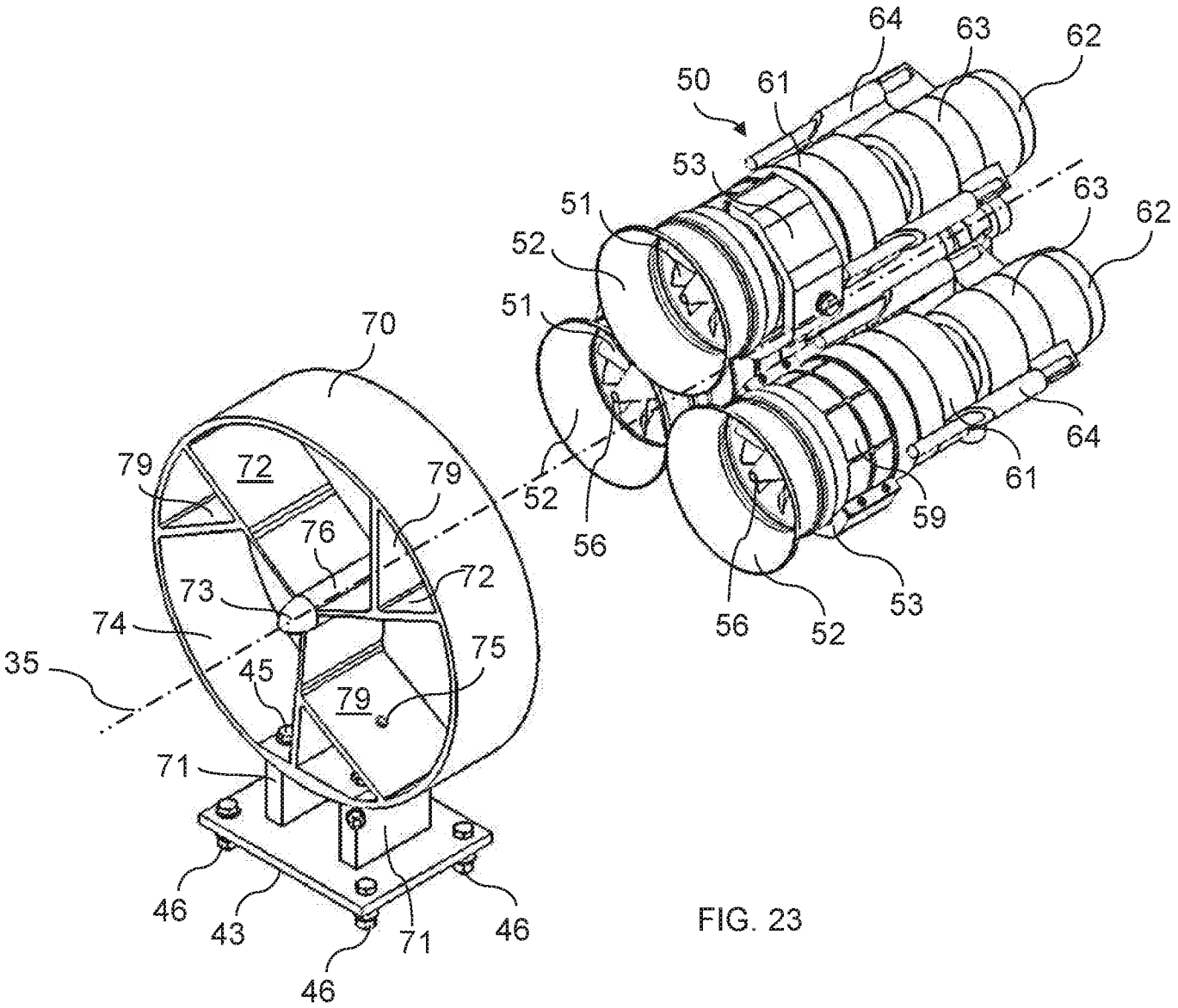
FIG. 23 shows an exploded view of the motor assemblies and collar of FIG. 21.
Figure 24:
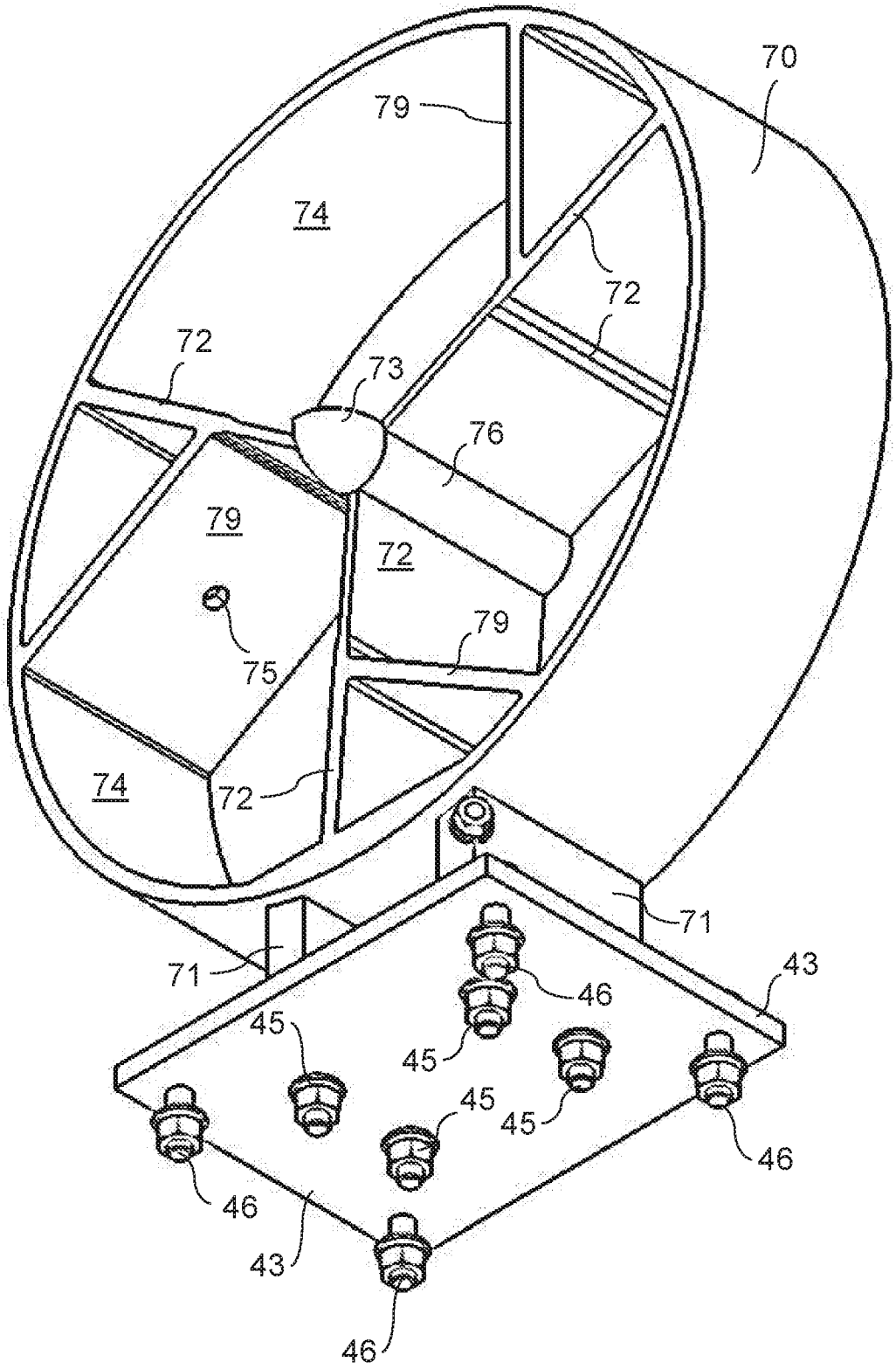
FIG. 24 shows a perspective view of the collar with the motor assemblies removed for clarity of the underlying structure.

FIG. 23 shows an exploded perspective view of the motor collar 70 and the three motor assemblies 50. With the motor assemblies 50 removed from the collar 70, the mounting apertures 75 are shown through which the bolt 58 secures the motor assembly 50 and the mounting arm 53 to the motor brace arm 79. This is further illustrated in FIGS. 24 and 25 in which the collar 70 is shown.

Figure 25:
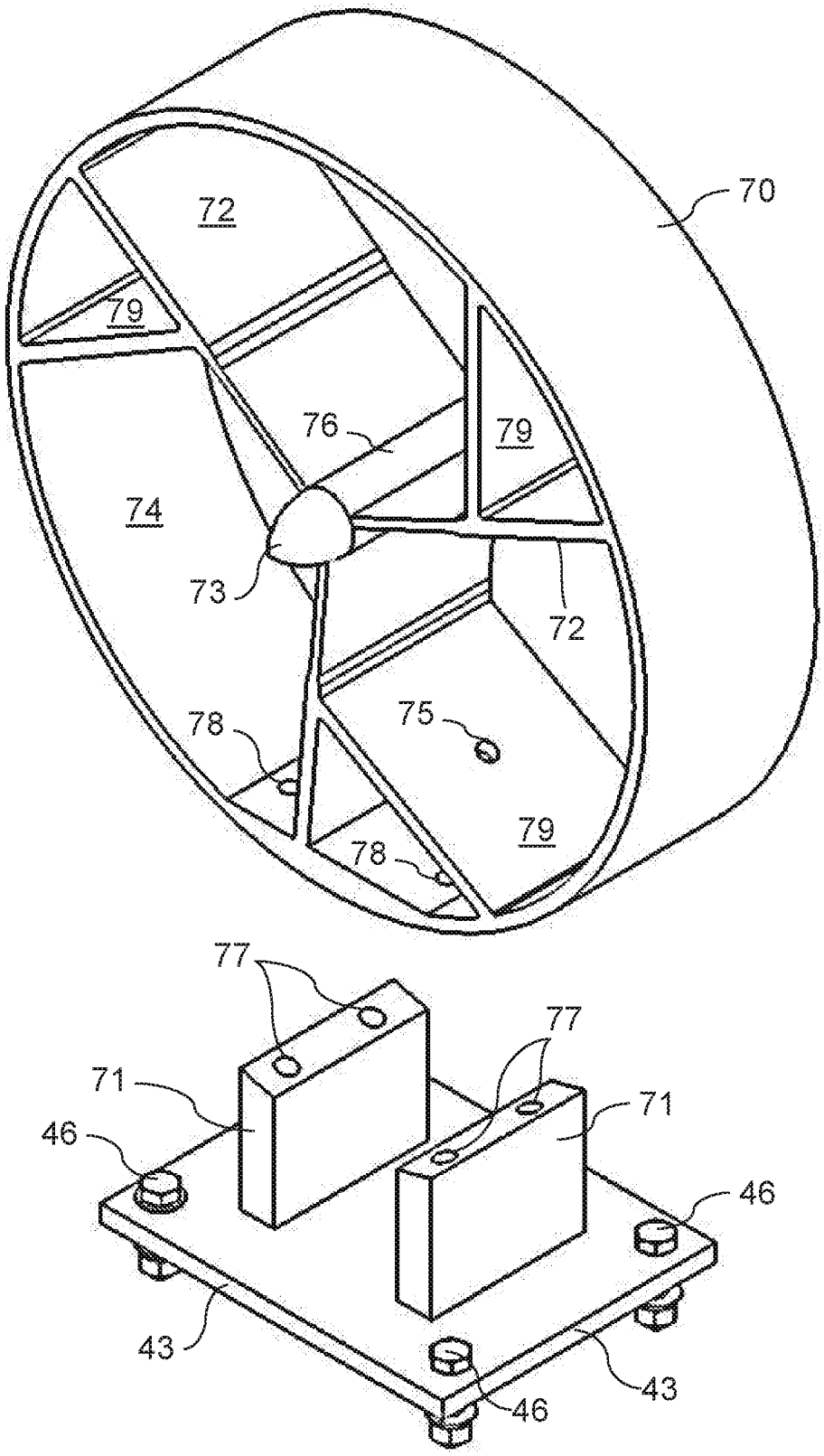
FIG. 25 shows the collar of FIG. 24 removed from the collar base.

Also shown in FIG. 25 is the collar mounting brackets 71 removed from the bottom of the collar 70. The collar mounting brackets 71 have apertures 77 passing through the brackets 71 from top to bottom for receiving the bolts 45. The mounting bolts 45 extend through the apertures 77 and corresponding apertures 78 in the collar 70 so that the collar 70 can be mounted or is mountable to the fan cowl connector base 43.

Figure 26:
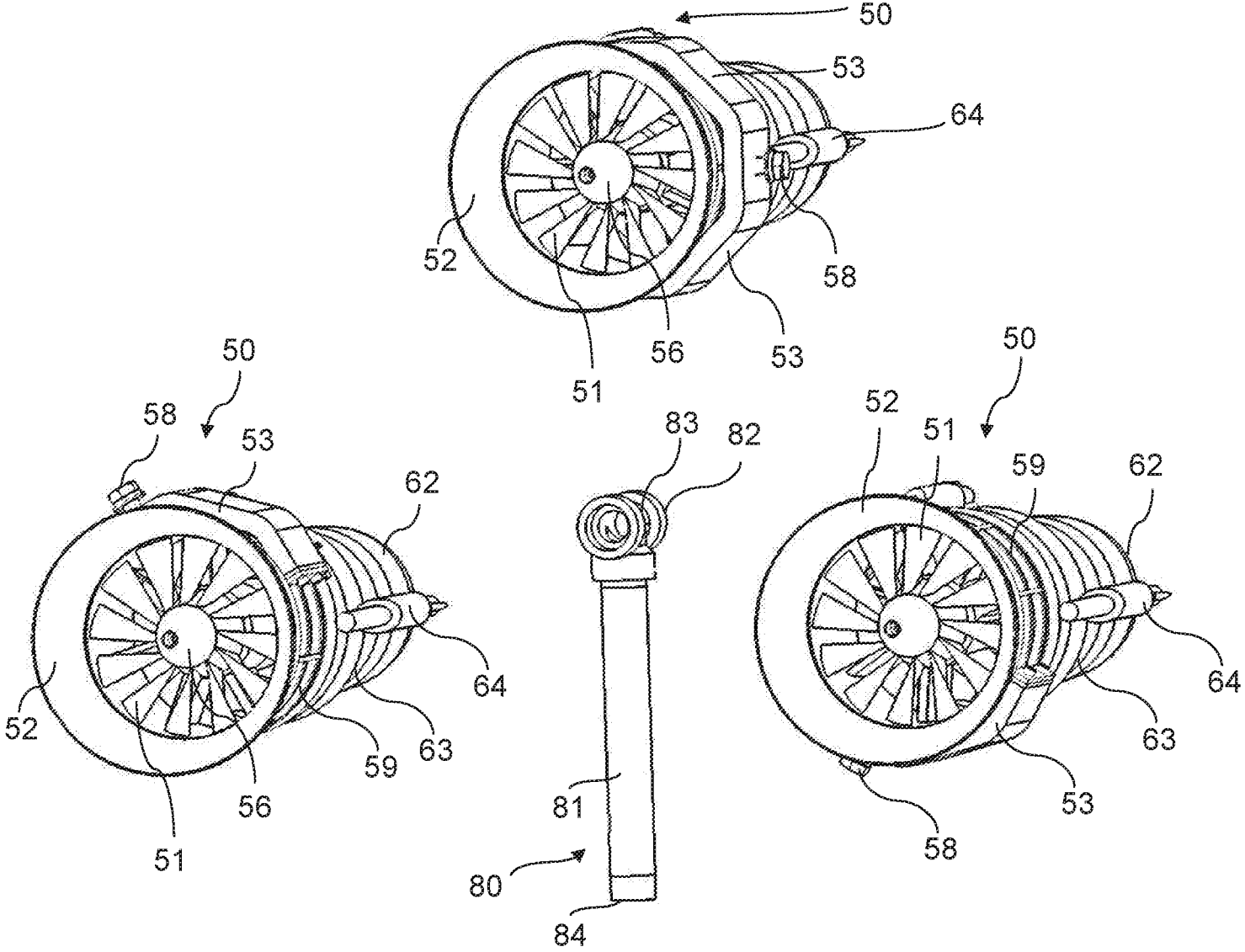
FIG. 26 illustrates a perspective view of the motor assemblies and the fluid conduit with all other structures removed for clarity.

FIGS. 26 to 31 show the motor assemblies 50 broken down into their component parts. FIG. 26 shows the three motor assemblies 50 detached from the motor mounting collar 70. Also shown in FIG. 26 are the fluid flow assembly 80 and its component parts including the fluid inlet 84, inlet pipe 81, T-junction piece 83 and the fluid outlet 82. As described above the T-junction piece 83 is mounted on the end of the fluid inlet pipe 81 with one end of the T-junction piece 83 extending towards the fluid outlet 82 and the other end mounted to the centre core support 76.

Figure 27:
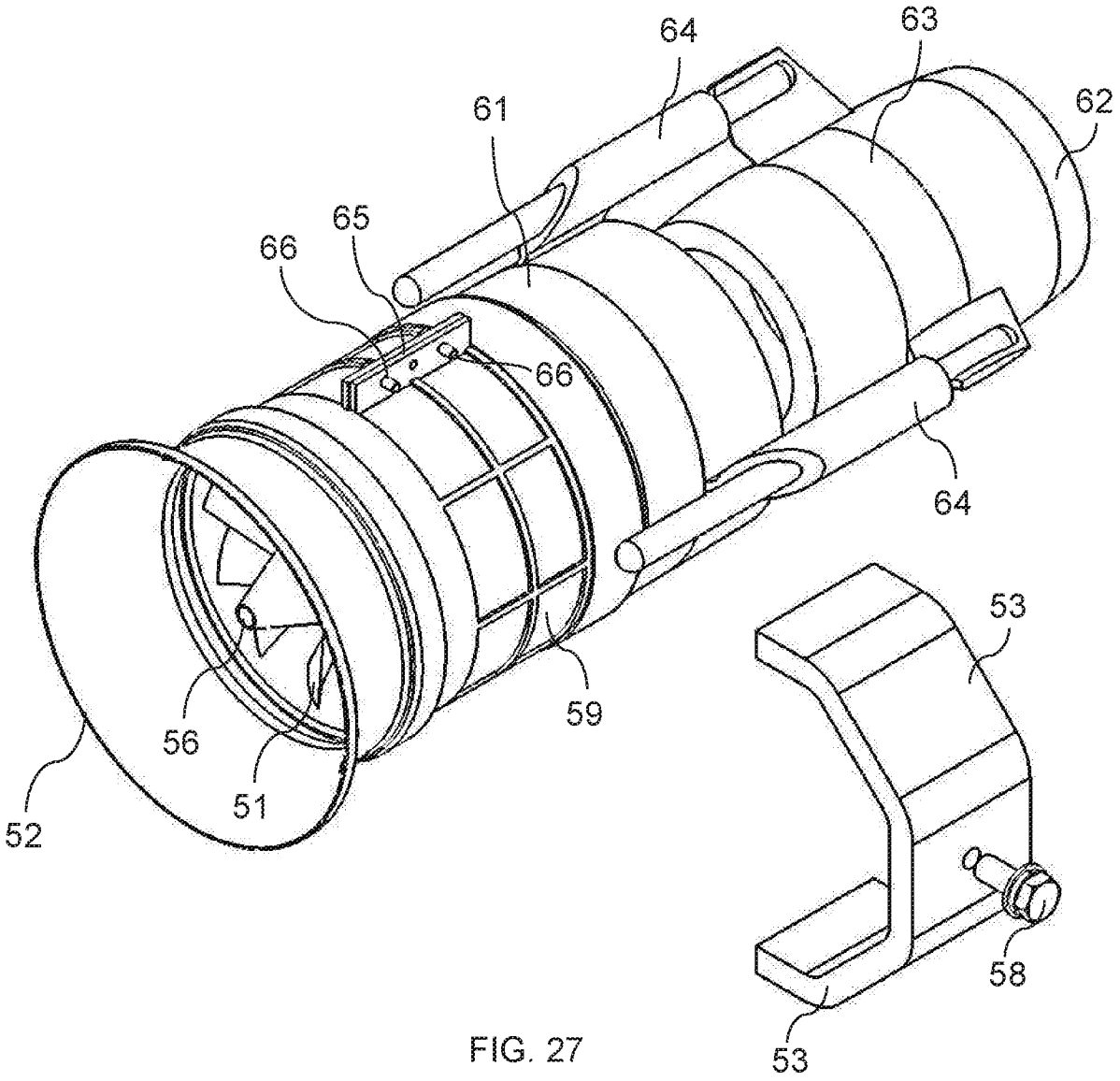
FIG. 27 illustrates a perspective view of a single motor assembly and the motor mounting bracket of the fluid flow control device of FIG. 15.

Each motor assembly 50 comprises a fan inlet flange 52, a fan assembly 97 and a fan air directional cowl 60. The fan inlet flange 52 is designed to direct an air stream into the fan assembly 97. FIG. 27 shows the bracket 53 which is attached to either side of the fan assembly 97 and is retained in the motor mounting collar 70 by mounting bolt 58 through apertures 69. The mounting bracket 53 at either end is mounted or mountable to the fan housing 59 to mounting brackets 65 and is retained in position by fasteners 66. The ends of the brackets 53 have threaded apertures for receiving the fasteners 66 to secure the motor mounting bracket 53 to the fan housing 59. The three motor assemblies 50 are all retained in the same manner around the motor mounting collar 70.

Figure 28:
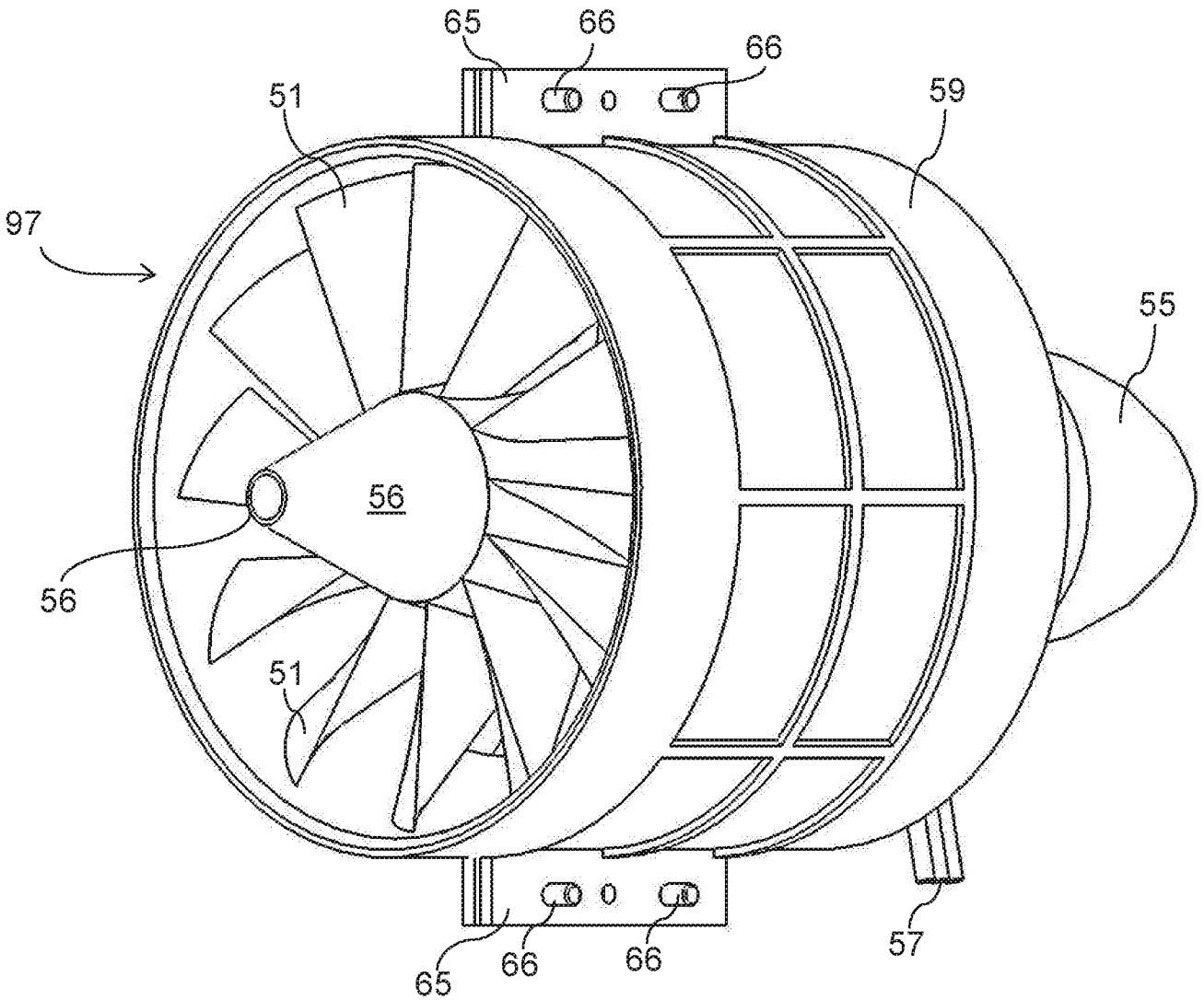
FIG. 28 shows a perspective view of a fan motor assembly of the fluid flow control device.
Figure 29:
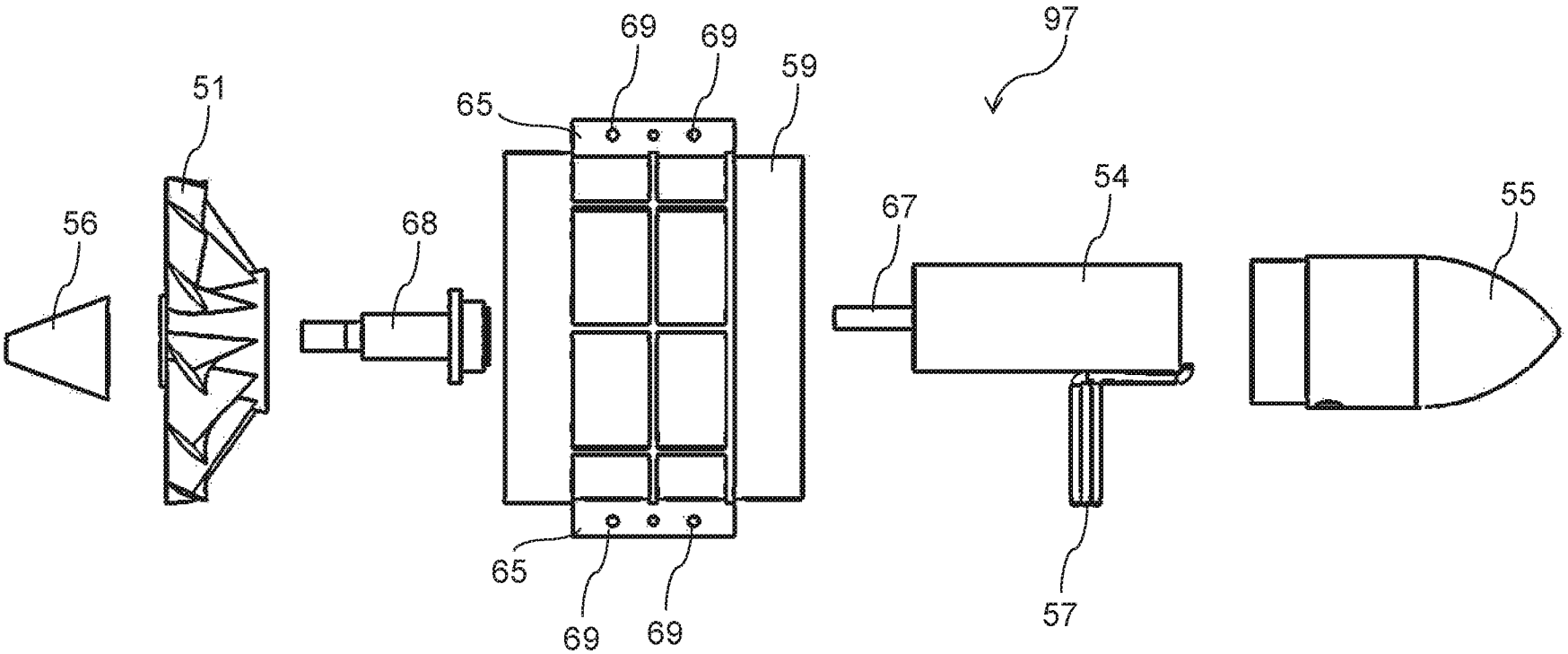
FIG. 29 shows a an exploded view of the main components of the fan motor assembly of FIG. 28.

FIGS. 28 and 29 show a perspective side view and an exploded side view of the fan assembly 97 utilised in the fluid flow control device 10, 200. The fan assembly 97 includes the rotor cone 56, the fan rotor or impeller 51, the fan motor 54, the ducted fan housing 59, the tail or aft cone 55, the mounting brackets 65 and fasteners 66. The rotor cone 56 and fan inlet flange 52 keep the airflow laminar, or smooth, as it enters the fan 51. Also shown in FIGS. 28 and 29 is the power inlet 57 for powering the fan motor 54. When a hydraulic or other form of drive source is used the inlet would be the corresponding hose or airline inlet 57. The rotation of the fan rotor 51, or impeller, is what drives the air through the fan assembly 97. The fan motor 54 is what provides the torque to turn the fan rotor 51. The fan motor drive shaft 67 extends from the front end of the fan motor 54. The drive shaft 67 passes through the fan housing 59 and is located within the impeller drive coupling 68 which is attached to the impeller or fan 51. The rotor cone 56 is secured to the front end of the impeller drive coupling 68 to secure the fan 51 to the fan motor drive shaft 67.

While an electric fan motor 54 is illustrated it will be appreciated, however, that the fan motor 54 is not so limited. Other forms of powering the motor 54 include for example, by hydraulic fluid pressure, by water pressure or by pneumatic pressure. The fan motor 54 can be driven by either AC or DC electric current. The aft cone 55 reduces or eliminates turbulence caused by the air passing over the fan motor 54.

Figure 30:
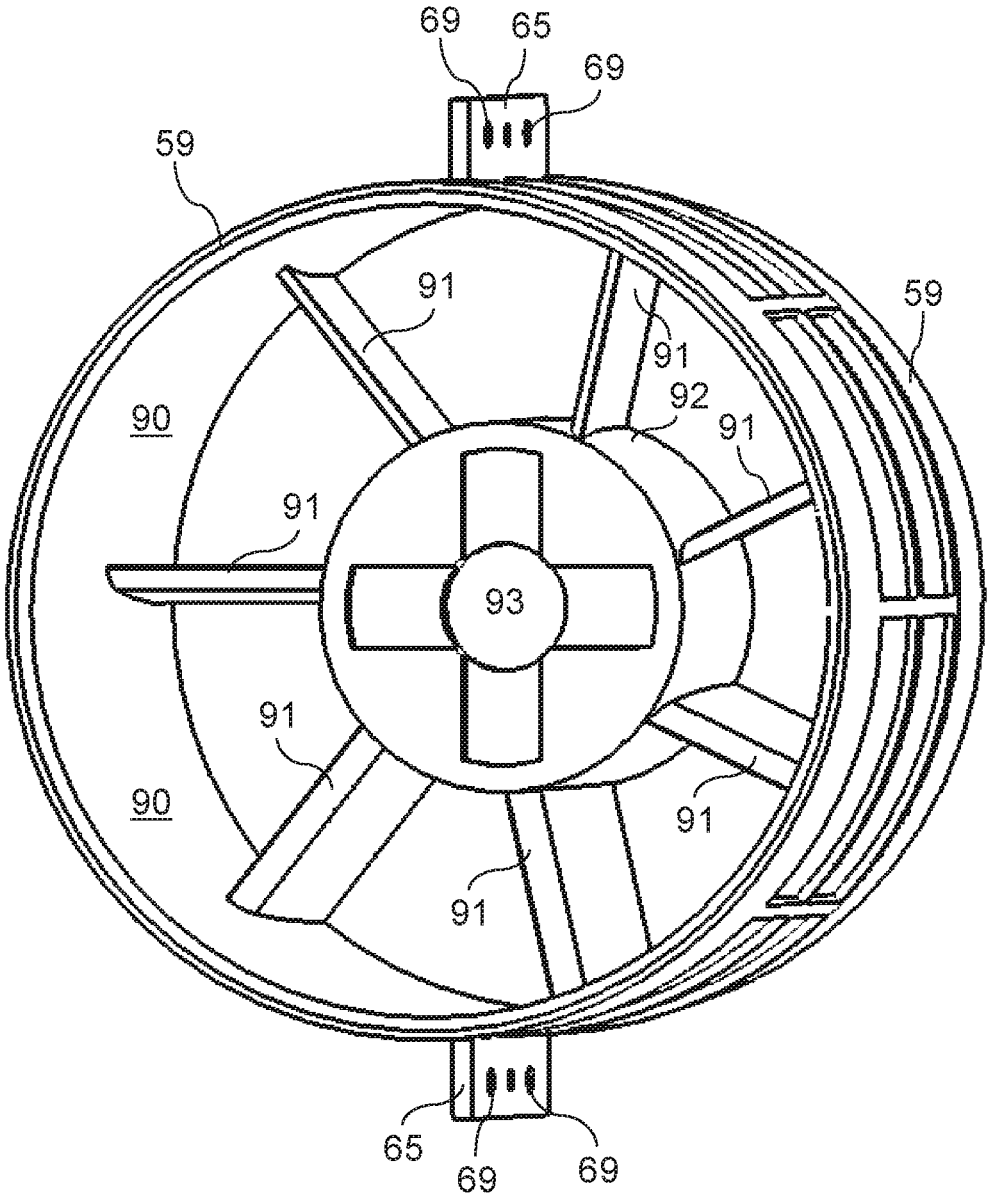
FIG. 30 shows a perspective view of a ducted fan housing of the fan motor assembly of FIG. 28.

FIG. 30 shows the ducted fan housing 59 that contains and directs the airflow through the motor assembly 50. The profile or shape of this housing is critical to the efficiency of the ducted fan assembly 97. The ducted fan housing 59 also contains stators or stationary fan blades 91 inside the ducted fan housing 59 that straighten the air the air flow as it passes. When a fan assembly 97 is housed in a shroud, the rotation of the fan blades 51 will cause the air to move radially as well as axially. This rotation of the air would cause turbulence which would reduce the efficiency of the ducted air fan assembly. The stator or stationary fan blades 91 help to reduce the turbulence. The fan stator blades 91 are retained at one end to the ducted fan housing inner surface 90 and at the opposite end to a centre support 92. The centre support 92 also has the aperture 93 in the centre of the housing 59 for receiving the fan motor drive shaft 67 from one side and from the opposite side the impeller drive coupling 68.

Figure 31:
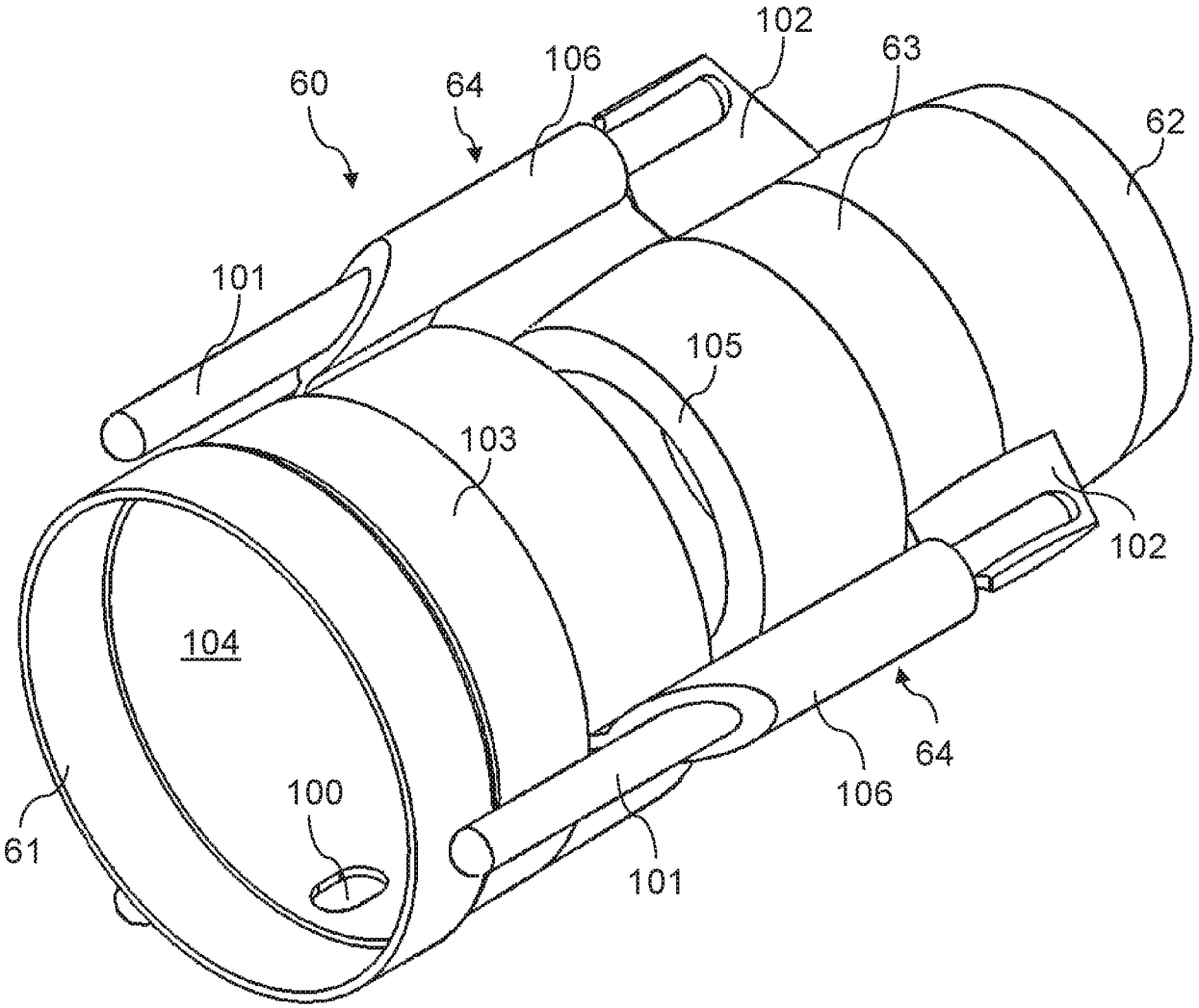
FIG. 31 illustrates a perspective view of a directional air housing of the motor assembly of FIG. 27.

FIG. 31 shows the fan air directional cowl 60 which directs the air produced from the fan assembly 97 out through the front cowl or air outlet 42 and into the air output region of the fluid flow control device 10. The fan air directional cowl 60 has one end 61 mounted to and abutting the rear end of the fan assembly 97 and an opposing end 62 which forms the air outlet and is located within and adjacent the front cowl 42. Located forward and abutting the end 62 is housing 63. The housing 63 is attached to the end 61 abutting the rear end of the fan assembly 97 via connector arms 64. The end 105 is spaced apart a distance from the air flow fan cover 103 such that there is a gap between the housing 63 and the air flow fan cover 103. As described above the connector arms 64 are adapted to allow the housing 63 to be moveable or longitudinally extended towards and away from the end 61.

The connector arms 64 are mounted to the housing 63 by arms 102.

The arms 102 have longitudinally extending members 101 extending towards and mounted to the air flow fan cover 103. Sleeves 106 are mounted to the air flow fan cover 103 for receiving the longitudinally extending members 101 to join and secure the housing 63 with the end 105 located a distance from the air flow fan cover 103 to form the fan air directional cowl 60. Actuators (not shown) allow the housing 63 to be remotely operated to automatically extend towards and away from the end 61. The actuators can be located either on the connector arms 64 or on the air flow fan cover 103. Preferably, the actuators are mounted between the sleeves 106 and the extending members 101 to allow the housing 63 to extend towards and away from air flow fan cover 103. This therefore automatically varies the distance between the end 105 of the housing 63 and the air flow fan cover 103 of the fan air directional cowl 60. The variation in the distance and the position of the housing 63 is an important factor in controlling the air stream from the motor assemblies 50 and how that air stream interacts with and controls the dispersion of the fluid from the fluid flow control device 10. This is particularly important to control the specific delivery of water and retardants with stable air shafts at distance for firefighting.

Likewise, the housing 63 can be completely detached from the connector arms 64 and the fan air directional cowl 60 should the need arise for a particular application. For example, to enhance fluid saturation at moderate distances. Also, a Kevlar composite material barrier (not shown) can be wrapped around the outside of the air flow fan cover 103 to capture blade fragments in the event of a blade separation.

The inner surface 104 of the air flow fan cover 103 has an aperture 100 which passes through the air flow fan cover 103. The aperture 100 is utilised to allow the power cable, hose or conduit to pass through the fan air directional cowl 60 and into the fan motor 54.

As illustrated the FIG. 31 assembly in essence high-pressure air will pass over the outside of the housing 63 and through the centre respectively to cause a deferential in air pressure to concentrate a tight column of air over a distance.

Figure 33:
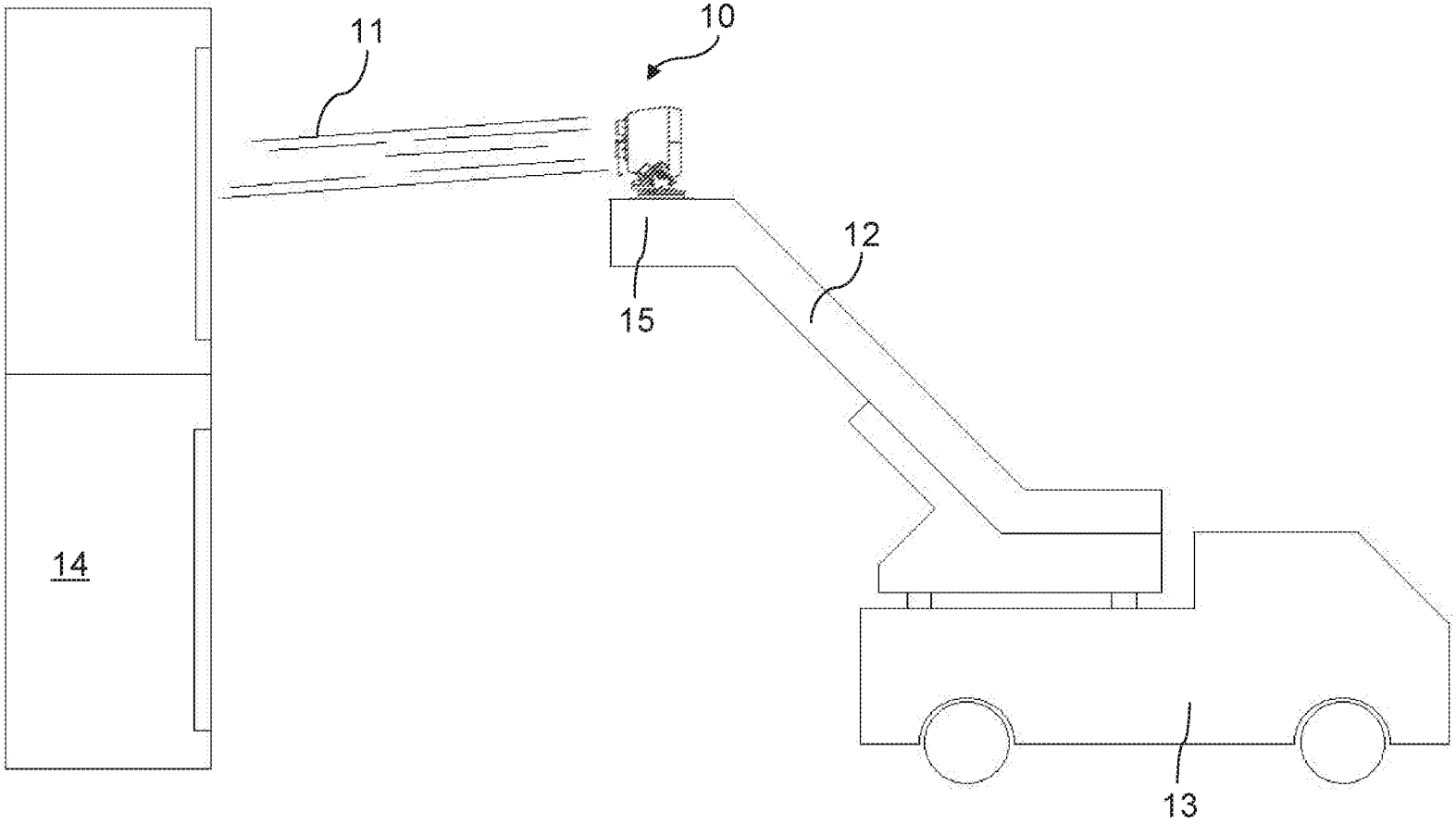
FIG. 33 illustrates an exemplary use of a fluid flow control device in accordance with an aspect of the present invention.

FIG. 33 illustrates an exemplary use of the fluid flow control device 10, 200. The fluid flow control device 10, 200 is used for fire-fighting and as illustrated for fighting a fire in a building 14. The fluid flow control device 10, 200 is mounted on a platform 15 which is attached at one end to an articulated arm 12. Typically the articulated arm 12 is attached to a vehicle or tanker 13. The fluid flow control device 10, 200 disperses a concentrated fluid stream 11 at a high velocity towards the fire in the building 14. As previously described the fluid flow control device 10, 200 can be remotely controlled to rotate vertically around a circular arc around the platform 15 and to move up and down vertically so as to position the air forced fluid stream 11 to the correct position to extinguish the fire.

The vehicle 13 while described as a tanker 13 may take the form of a number of different vehicles 13. A vehicle 13 is taken to mean any means in or by which someone travels or something is carried or conveyed. For example, this could include any land, air or water vehicle and the vehicle could be manned or unmanned. For example, when unmanned the fluid flow control device 10, 200 may be mounted on a remote controlled vehicle and an operator could control the device remotely from a safe location through the use of closed-circuit television are a similar device. Closed-circuit television (CCTV), is the use of video cameras to transmit a signal to a specific place, on a limited set of monitors. The remote controlled vehicle has a chassis with crawler tracks or similar devices mounted on opposite sides and motors mounted within the chassis for independently advancing the crawler tracks or similar devices.

Figure 34:
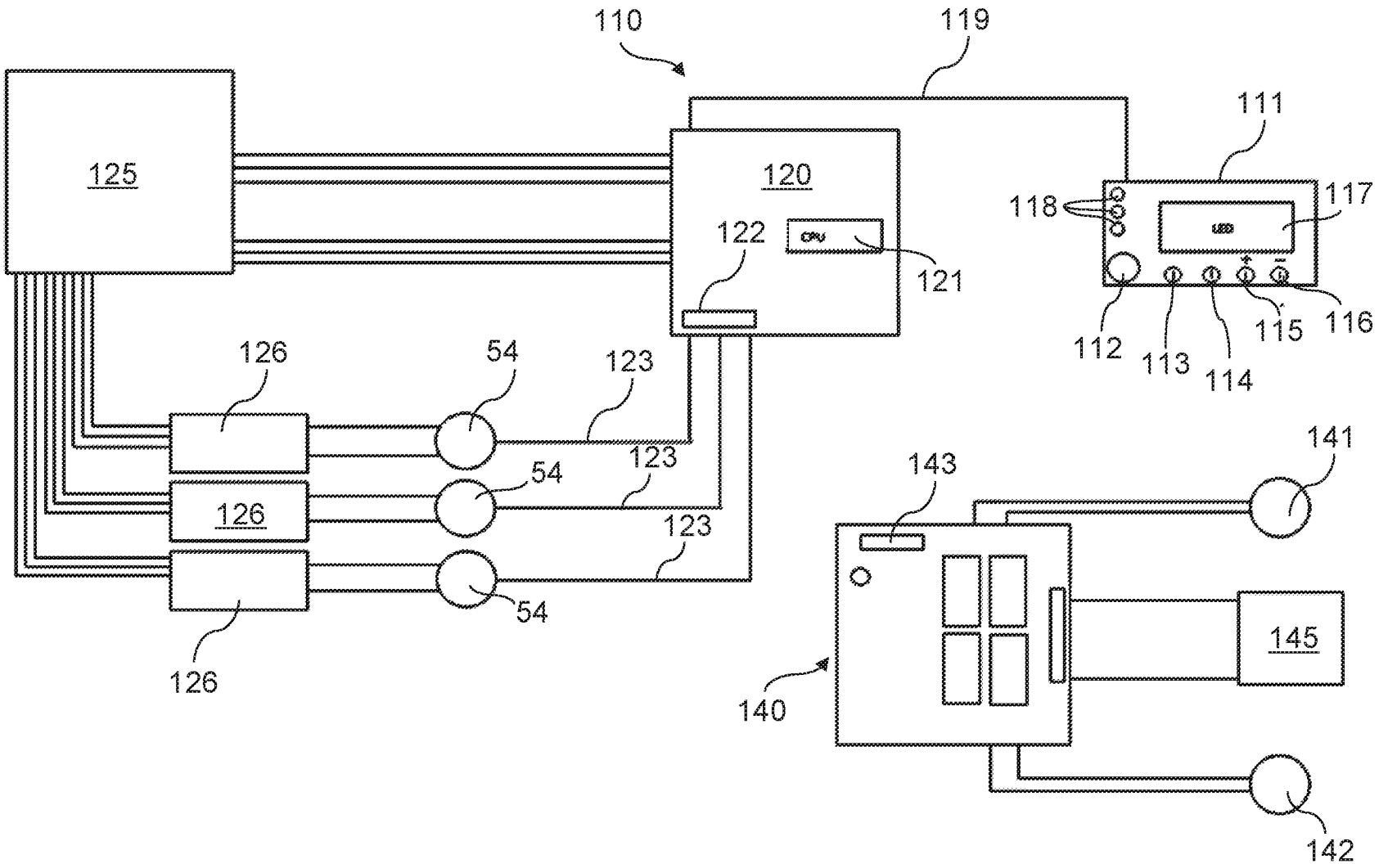
FIG. 34 shows a block diagram schematic of the control system for the fluid flow control device of the present invention.

FIG. 34 shows a schematic block diagram of the fluid flow control system 110 designed to control all of the controllable attributes of the fluid flow control device 10, 200. The heart of the system is the microcontroller 120 which is simply a small computer on a single integrated circuit. The microcontroller 120 includes a central processing unit (CPU) 121 which provides the electronic circuitry within the microcontroller 120 that carries out the instructions of a computer program by performing the basic arithmetic, logical, control and input/output (I/O) operations specified by the instructions. The microcontroller 120 also contains memory and programmable input/output peripherals. Alternatively the microprocessor 120 may be replaced by a computer 120 which performs exactly the same duties as the microcontroller but is not a single integrated circuit. The computer 120 consists of a number of individual circuits so joined to form a computer 120.

One of the input/output peripherals of the microcontroller 120 is the temperature sensing circuit 122. The temperature sensing circuit 122 consists of inputs/outputs connected to temperature sensors 123 located proximal to each fan motor 54. The temperature sensing circuit 122 includes a shut off circuit designed to shut down the fan motors 54 should a maximum operating temperature be exceeded. Another input/output is to the main control panel 111 which is connected to the microcontroller 120 by cable 119. Alternatively, the cable 119 may be replaced by using wireless communication technology integrated into both the microcontroller 120 and the main control panel 111. Wireless communication is the transfer of information or power between two or more points that are not connected by an electrical conductor. The most common type of wireless communication being but not only limited to is radio communication.

The main control panel 111 consists of a number of components which control the operation of the fan motors 54. These include the master on 113 and master off 114 switches which control the main power for the fluid flow control device 10, 200. Fan motor on/off switches 118 including one for each fan motor 54 which can control each fan motor 54 individually. The motor speed controls switch 112 which is a rotary switch for controlling the speed of each motor individually or controlling all three fan motors 54 together. The motor control switch 112 controls the motor controllers 126 which for an electric fan motor 54 controls the voltage and/or current delivered to each one of the fan motors 54 from the power supply 125. The mode select switch 115 which can be used to select or deselect various functions including the control of each motor 54. The PGS 116 is used to initiate the start sequence from the main controller 111. This basically confirms that all the electronic circuits are talking or communicating with each other and the fluid flow control system 110 is ready to run each fan motor 54.

The main control panel 111 also has an LED flat panel display 117, which uses an array of light-emitting diodes as pixels for a video display. This provides a visual display of, but not only limited to such control items or parameters as the speed of each fan motor 54, a power on indicator and the temperature of each one of the fan motors 54.

Also as illustrated in FIG. 34 the fluid flow control system 110 also includes a separate direction control unit 140. Alternatively, the directional control unit 140 may be included on the main control panel 111. The direction control unit 140 includes controls to operate the turntable motor 141, 214, the tilt table motor 142 and the actuators or air directional cowl actuators which allow the housing 63 to be remotely operated to automatically extend towards and away from the end 61. For the flow control device 200, the direction control unit 140 also controls the actuating assembly 230 to raise and lower the outer housing 240 and motor assemblies 50. The turntable motor 141, 214 is formed within the turntable 18, 210 and operates to control the drive of the turntable 18, 210 both clockwise and anti-clockwise around the circular arc. The tilt table motor 142 is located within the linear actuator 29 and is operated to extend and retract to control the vertical tilt of the fluid flow control device 10 with respect to the turntable 18. The air directional cowl actuators are mounted between the sleeves 106 and the extending members 101 to allow the housing 63 to extend towards and away from air flow fan cover 103 to control the air stream from the motor assemblies 50.

The direction control unit 140 also incorporates a power supply 145 and limit switches 143. The limit switches 143 limits the travel of the flow control device 10, 200 in both the horizontal and vertical directions and the housing 63 on the flow control device 10 in the longitudinal direction. The actual control device for the turntable motor 141, 214, the tilt table motor 142, the air directional cowl actuators and the actuating assembly 230 could be a simple joystick used as an input device consisting of a stick that pivots on a base and reports its angle or direction to the device it is controlling. Alternatively any other input device could be used for example, rotary or momentary switches, or any other directional pad. Alternatively, when using hydraulic fluid pressure to power the fluid flow control device 10 extra components may be required to monitor hydraulic oil pressure, temperature and oil levels. Likewise, the hydraulic system may also include a hydraulic pump, hydraulic fluid reservoir and associated valves and pipes.

The fluid flow control system 110 may consist of a single controller incorporating the main control panel 111, the microcontroller 120 and the direction control unit 140 for providing remote operation of the fluid flow control device 10, 200. The controller may be a wired or a wireless controller and is designed to provide remote operation of the turntable drive assembly 141, 214, the actuating assembly 230, tilt table motor 142, the motor assemblies 50, and the fluid flow assembly 80.

The fluid flow control system 110 is designed for controlling each one of: i) a motor speed of each or all motor assemblies 50; ii) an angular position of the annular outer housing 40, 240 with respect to the supporting structure by controlling the actuating assembly 230 or tilt table motors 142; iii) a rotational position of the fluid flow control device 10, 200 by controlling the turntable drive assembly 141, 214; and iv) a flow rate of fluid by controlling the first pump of the fluid flow assembly 80.

In use, the fluid flow control device 10, 200 is provided with a power source to power the turntable 18, 210, the fan motors 54 of the motor assemblies 50, the actuating assembly 230 or tilt table motors 142, the air directional cowl actuators and the actuating assembly 19. Also the power source is used to provide power for the fluid flow control system 110 including, the microcomputer 120, the main control panel 111 and the direction controller 140. Once the master power switch 113 is powered on, power is available to all of the above components or systems. Each fan motor 54 is then powered on by switching the fan motor on/off switches 118 to the on position. Once the switch 118 is in the on position the speed of the motors 54 can then be controlled by the speed control switch 112. The speed of each motor 54 is gradually increased and once stabilised or set to a predetermined speed air flow will be generated from the input air region to an output air region on the fluid flow control device 10, 200 at a high velocity. For the fluid flow control device 10, the air cowl directional actuators can also be adjusted at this time in order to create the desired air stream from the motors assemblies 50.

In order to ensure the fluid flow control device 10, 200 is positioned in the correct direction for operation, both the turntable motor 141, 214 and the actuator 231 of the actuating assembly 230 or tilt table motor 142 are energised to move the fluid flow control device 10, 200 to point in the required direction. That is using the direction controller 140 to firstly adjust the turntable 18, 210 to move the fluid flow control device 10, 200 in a clockwise or an anti-clockwise direction around the circular arc about a vertical axis of the fluid flow control device 10 200. Secondly, adjusting the actuating assembly 19 to adjust the vertical position, up or down of the fluid flow control device 10 or the actuator 231 of the actuating assembly 230 for the fluid flow control device 200. Once oriented in the correct position or direction the fluid flow assembly 80 is supplied a fluid by energising a first pump which is mechanically coupled to a fluid container and configured to at least partially pump the fluid from the container into the fluid inlet 84 at a first pressure to provide the fluid to the fluid outlet 82 located adjacent the centreline 35 and within the air output region of the fluid flow control device 10, 200 to produce an output from the fluid flow control device 10, 200 which combines an forced air flow produced from the thrust of the fan motors 54 and fluid from the fluid outlet 82.

The fluid supplied by the fluid flow control device 10, 200 is dispersed at a high velocity which is particularly useful in fighting fires. The thrust produced by the fan motors 54 and the motor assemblies 50 forces the fluid coming from the fluid outlet 82 to be dispersed into fine droplets or as a mist over a large distance. The potential surface area which can be covered by the fluid flow control device 10, 200 is enormous and provides a fire-fighting capacity which significantly improves the current abilities of the fire-fighter. The nature of the fluid dispersed from the fluid flow control device 10, 200 also significantly reduces the amount of fluid required to extinguish a fire. The fluid flow control device 10, 200 provides the ability to regulate air-flow and retardant. For example, water and foam for different situations that may occur.

As previously discussed the number of applications to which the present invention can be applied is considerable. While we have predominantly only provided an exemplary application to the field of fire fighting, we also provide the following summary of example uses, which are by no way the only limited uses of the present invention. The fluid flow control device 10, 200 of the present invention could be utilised in:

1. Dust suppression: The fluid flow control device 10 could be used to suppress or reduce dust, and also reducing odours. Dust suppression is important in heavy industry especially those that reside in open environments such as mines, roads, airstrips or construction sites that readily pollute the air.
2. Positive pressure ventilation: The present invention can provide a portable positive pressure ventilation blower for use in fighting fires associated with large structures such as tunnels, mines, halls, warehouses, high-rise buildings, shopping malls and the like.
3. Chemical and aerosol spraying: The portable nature of the present invention lends itself to the application of chemicals and aerosols such as for the spraying of mosquitoes.
4. An area denial weapon for crowd control: The ability to mount the present invention on or in a vehicle allows the fluid flow control device 10 to be utilised in the area of crowd control. The jet of air combined with a fluid such as water or in some cases pepper spray can be readily utilised to disperse a crowd or an unruly riot.
5. Industrial cleaning: The combination of high velocity air and fluid can be designed to clean maintain equipment and facilities in a safe, environmentally sustainable and responsible way.
6. Cooling ambient temperatures: As discussed above the fluid flow control device can also include a number of nozzles connected to the fluid outlet for the dispersion of a fine mist. This is particularly useful for the outdoors at such events as concerts to cool the participants.
7. Making artificial snow: The present invention can also be utilised in the field of snowmaking that is, the production of snow by forcing water and pressurized air through the fluid control device at low temperatures.
8. A propulsion source for light aircraft or other vehicles: A number of different vehicles can be powered by the present invention. For example a light aircraft could be powered by attaching the fluid flow control device to the wing or fuselage of the aircraft. Likewise other vehicles such as jet boats, hovercraft and automobiles could be modified to allow the addition of the fluid flow control device to power the respective vehicle.

The fluid flow control device 10, 200 is manufactured largely from steel, aluminium and composite materials such as Aramid Kevlar. For example, the motor collar 70, the base assembly 20, the support structure 220 and turntable 18, 210 are all manufactured from steel or other suitable material such as aircraft aluminium grade alloy. The motor assemblies 50 are also mostly manufactured from steel with the exception of the fan air directional cowl 60 or air delivery assembly 250 which can be manufactured from aluminium or even fibreglass. Likewise the outer cowl or housing 40, 240 can be manufactured from aluminium or fibreglass.

The fan motor 54, turntable motor 141, 214, and tilt table motor 142 or actuator 231 have been described as being powered by either electric current either AC or DC or hydraulic fluid, it is also understood that the systems could be powered by a high pressure fluid or pneumatic pressure. As such, any components or systems required for the alternative powering is also included within the scope of the present invention. For example, a hydraulic power system would suitably require a reservoir, pump, an assortment of valves and hydraulic fluid transmission lines. Likewise, a pneumatic power system would also include such items as a compressor, receiver tank, regulator, valves, filters and suitable transmission lines.

The fluid flow control system 110 is designed to control all of the controllable attributes of the fluid flow control device 10, 200. As described above each of the components of the control system 110 including the microcontroller 120, main control panel 111 and the direction controller 140 are all housed in individual cases. Alternatively, all of the components may be housed in a single controller which could be wired or wirelessly connected to the fluid flow control device 10, 200.

ADVANTAGES

It will be apparent that the present invention relates generally to a device for controlling the flow of a fluid. More specifically, the present invention relates to fire fighting equipment using a fluid flow device which generates high velocity fluid useful in fighting fires.

The present invention provides a high velocity fluid stream which can be utilised for a number of different applications. The ability to control the dispersing of a fluid over considerably long distance and over a wide forming dispersion arc provides a system which is especially apt for fire-fighting. The fluid flow control device can be easily mounted to a moveable platform such as those already in use on the back of a tanker and can be directed towards a number of different fire-fighting applications. For example, the present invention develops a large heat transfer surface and therefore a higher cooling capacity on a burning object.

In comparison to the prior art the present invention can apply a fluid such as water or foam directly on flames which smother the burning object from a distance which traditional fire-fighting methods are not capable of achieving. This further enhances the safety of the firefighter as they are no longer required to come into close contact with the burning flames.

Due to the high velocity dispersion of fluid developed by the combination of high speed fans means that the amount of fluid required to fight a fire is reduced. For example, less water is used to fight a fire using the fluid flow control device of the present invention than the normal methods of fighting fires. The dispersion under high velocity creates a fine mist of water over a large distance. This fine mist has proved beneficial in fighting fires and also for dust suppression. It has also proved useful for crowd control and for simply keeping people cool. The ability to control both the air and water mixture using the fluid flow control device allows the user to provide a number of different types of dispersion patterns, type and size of dispersed droplet, the quantity of dispersed fluid and the dispersion coverage and displaced distance of the fluid.

The design of the outer housing or cowl and the air delivery assembly, in particular the positioning and shape of the central body and supporting struts concentrates and directs the compressed air flow from the fan assembly of each motor assembly out through the open rear end or outlet of the fluid flow control device where that concentrated air interacts with the fluid flow output for producing the air forced fluid. The central body has a torpedo like shape which in the present invention is utilised in reverse to that of a normal torpedo in the water. In this case and to provide the concentration of air flow the compressed air is directed around the apex and the conical shaped body in such a way that the air is directed towards the outer housing of the air delivery assembly and towards the semi-spherical body located in the output stream of each motor assembly. The shape, positioning and size of each component provides an increased thrust of compressed air which is then concentrated into an output flow which when combined with the fluid from the fluid flow assembly provides the air forced fluid from the fluid flow control device of the present invention.

The positioning of the motor assemblies within and around the outer housing and mounting collar also aids in producing a high thrust air output which interacts with the fluid flow from the fluid flow assembly to produce a high velocity concentrated dispersion of fluid for fighting fires or other applicable uses.

Fires in urban areas can be brought under control more efficiently with the present invention. The combination of the motor assemblies and nozzles generate a fine mist which is deposited directly on the flames and encases the article on fire. The mist is also useful in smothering the smoke and soot particles developed by the burning fire.

The distance obtained by the dispersed fluid of the present invention means that the firefighting crew need not be exposed to any immediate danger and the fluid flow control device can be controlled at a safe distance.

The present invention has proven their high level of effectiveness in the area of mines and tunnel fires. The fluid flow control device can be mounted on an unmanned vehicle, which can be remotely driven into the mine tunnel by remote control. Once again the firefighting crew need not be exposed to any immediate danger with this method and can be kept at a safe distance.

The present invention can be mounted to a tanker, specifically for the field of fighting fires at airports and similar fields of application. The sophisticated nozzle technology also enables more efficient firefighting than the conventional extinguisher jet. The atomization increases the surface area of the extinguishing foam and decreases its weight. Therefore the burning object is enveloped evenly all over and the entire fire source is smothered at the same time.

VARIATIONS

It will be realised that the foregoing has been given by way of illustrative example only and that all other modifications and variations as would be apparent to persons skilled in the art are deemed to fall within the broad scope and ambit of the invention as herein set forth.

Various substantially and specifically practical and useful exemplary embodiments of the claimed subject matter, are described herein, textually and/or graphically, including the best mode, if any, known to the inventors for carrying out the claimed subject matter. Variations (e.g., modifications and/or enhancements) of one or more embodiments described herein might become apparent to those of ordinary skill in the art upon reading this application. The inventors expect skilled artisans to employ such variations as appropriate, and the inventors intend for the claimed subject matter to be practiced other than as specifically described herein. Accordingly, as permitted by law, the claimed subject matter includes and covers all equivalents of the claimed subject matter and all improvements to the claimed subject matter. Moreover, every combination of the above described elements, activities, and all possible variations thereof are encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

Thus, regardless of the content of any portion (e.g., title, field, background, summary, description, abstract, drawing figure, etc.) of this application, unless clearly specified to the contrary, such as via explicit definition, assertion, or argument, or clearly contradicted by context, with respect to any claim, whether of this application and/or any claim of any application claiming priority hereto, and whether originally presented or otherwise:

(a) there is no requirement for the inclusion of any particular described or illustrated characteristic, function, activity, or element, any particular sequence of activities, or any particular interrelationship of elements;

(b) no characteristic, function, activity, or element is "essential";

(c) any elements can be integrated, segregated, and/or duplicated;

(d) any activity can be repeated, any activity can be performed by multiple entities, and/or any activity can be performed in multiple jurisdictions; and (e) any activity or element can be specifically excluded, the sequence of activities can vary, and/or the interrelationship of elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

In this specification, adjectives such as first and second, left and right, top and bottom, and the like may be used solely to distinguish one element or action from another element or action without necessarily requiring or implying any actual such relationship or order. Where the context permits, reference to an integer or a component or step (or the like) is not to be interpreted as being limited to only one of that integer, component, or step, but rather could be one or more of that integer, component, or step etc.

The invention claimed is:

1. A fluid flow control device comprising:

a plurality of motor assemblies mounted at equidistant points around a mounting collar;

an elongated annular outer casing surrounding and spaced outwardly from the plurality of motor assemblies and defining with the plurality of motor assemblies an annular air passage, the outer casing having a central longitudinal axis, a substantially open forward end for receiving ambient air and a substantially open rear end for discharging an air forced fluid;

a supporting structure on which the elongated annular outer casing is mounted;

a fluid flow assembly having a fluid inlet attached adjacent the supporting structure, and a fluid outlet located adjacent the central longitudinal axis and within the open rear end of the elongated annular outer casing;

a turntable coupled to the supporting structure to allow the supporting structure to be rotated in a circular arc; and an actuating assembly for raising and lowering the annular outer casing, the actuating assembly being coupled between the supporting structure and an outer surface of the elongated annular outer casing.

2. A fluid flow control device as claimed in claim 1, wherein the plurality of motor assemblies are powered by any one of:

a) an electric current;

b) a hydraulic fluid pressure;

c) a pneumatic pressure; or d) a high pressure fluid.

3. A fluid flow control device as claimed in claim 2, wherein the elongated annular outer casing is a cylindrical tube shaped casing designed to concentrate the flow of air through and from the fluid flow control device.

4. A fluid flow control device as claimed in claim 3, wherein the open forward end of the annular outer casing has a rear housing flange positioned to encompass an inlet flange of each one of the plurality of motor assemblies, and the open rear end of the annular outer casing has a front housing flange positioned to encompass an outlet of the air delivery housing of each one of the plurality of motor assemblies.

5. A fluid flow control device as claimed in claim 1, wherein the supporting structure comprises a pair of spaced uprights defining a recess for receiving a mounting assembly of the elongated annular outer casing and a supporting base, the elongated annular outer casing being pivotally connected to the uprights by a rotational member interposed between each upright and the mounting assembly of the outer casing.

6. A fluid flow control device as claimed in claim 5, wherein the rotational member comprises a bearing assembly coupled to each upright at opposing sides of the mounting assembly and a rotational shaft passing through both bearing assemblies and the mounting assembly, the bearing assembly comprises a journal bearing in each upright of the supporting structure to support the mounting assembly of the elongated annular outer casing on the rotational shaft for pivotal movement.

7. A fluid flow control device as claimed in claim 1, wherein the motor assemblies mounting collar is adapted to fit within the outer casing, the collar having a plurality of circumferentially spaced apart struts extending radially from a central hub to the collar for supporting the plurality of motor assemblies, and the struts are evenly spaced around the collar such that the plurality of motor assemblies are equidistantly spaced and supported around the collar.

8. A fluid flow control device as claimed in claim 1, wherein the turntable coupled to the supporting structure is mounted or mountable on a surface.

9. A fluid flow control device as claimed in claim 8, wherein the turntable is coupled to the supporting structure to allow the fluid flow control device to be rotated in a circular arc, the turntable comprising:

a first plate mounted or mountable to the surface;

a second plate mounted or mountable to the supporting base of the supporting structure;

a rotating means mounted between the first and second plates which allows the fluid flow control device to be rotated in the circular arc;

a turntable drive assembly mounted to the rotating means to allow the turntable to be driven both clockwise and anti-clockwise directions, the turntable drive assembly is powered by any one of an electric current, a hydraulic fluid pressure, a high pressure fluid, or a pneumatic pressure; and a limit switch assembly to limit the rotational movement of the turntable.

10. A fluid flow control device as claimed in claim 1, wherein the actuating assembly further comprises an actuator connected between a support base of the supporting structure and a mounting arm on the outer surface of the elongated annular outer casing to allow the actuating assembly to move the outer casing vertically up and down to adjust an angular position of the annular outer casing with respect to the supporting structure.

11. A fluid flow control device as claimed in claim 10, wherein the actuator is a linear actuator with an extending screw rod, a first end of the actuator is pivotally connected to the support base and an end of the extending screw rod is attached to the mounting arm on the outer casing such that upon extension or retraction of the screw rod will adjust the vertical angular position of the outer casing of the fluid flow control device in relation to the supporting structure.

12. A fluid flow control device as claimed in claim 10, wherein each motor assembly comprises in serial flow communication about a longitudinal center axis, a fan assembly and an air delivery assembly.

13. A fluid flow control device as claimed in claim 12, wherein the fan assembly comprises a fan motor driving on a common shaft, a fan rotor having a plurality of circumferentially spaced apart fan blades, and an outer fan housing surrounding the fan motor and fan blades.

14. A fluid flow control device as claimed in claim 13, wherein the air delivery assembly comprises:

an annular outer housing formed around the longitudinal center axis of the motor assembly, the annular outer housing having a substantially open first end for receiving the fan assembly and a substantially open second end for discharging the portion of the ambient air which is compressed by the fan blades;

a central body extending along the longitudinal center axis of the annular outer housing;

a plurality of circumferentially spaced struts extend radially between the annular outer housing and the central body; and wherein the annular outer housing, the central body and the struts are shaped to concentrate the air compressed by the fan blades of each one of the motor assemblies to provide the forced air supply for the fluid flow control device.

15. A fluid flow control device as claimed in claim 14, wherein the annular outer housing comprises:

a first cylindrical body having the substantially open first end and a second end;

a cylindrical air directing housing having an input end and the substantially open second end; and wherein the substantially open first end of the first cylindrical body is adapted to abut against an end of the fan assembly and the second end is adapted to be received within the input end of the air directing housing.

16. A fluid flow control device as claimed in claim 15, wherein the central body comprises:

a first cylindrical shaped body portion having a first end and a second end, the first body portion extends along the longitudinal center axis of the motor assembly between the input end and the substantially open second end of the air directing housing;

a first conical shaped end extends a distance from the first end of the first body portion to an apex, the first conical shaped end extends into the first cylindrical body, such that the apex of the first conical end is located adjacent the fan assembly; and a second output end extends a distance from the second end of the first body portion to form a rounded semi-spherical end, the rounded semi-spherical end extends to a point located externally of the substantially open second end of the annular outer housing.

17. A fluid flow control device as claimed in claim 16, wherein the plurality of circumferentially spaced struts have a leading edge spaced apart from a trailing edge, the leading edge and the trailing edge being formed at an angle with respect to the longitudinal center axis of each motor assembly, the angle which the leading and trailing edges are formed with respect to the longitudinal center axis of each motor assembly is in the range of 20 degrees to 90 degrees.

18. A fluid flow control device as claimed in claim 1, wherein the fluid flow assembly further comprises at least one nozzle attached to the fluid outlet, each nozzle is positioned so as to supply a spray of fluid from the fluid outlet and when combined with an air flow in the open rear end produces a concentrated stream of spray mist of fluid, or a dispersion of large droplets of fluid or any other dispersion combination achieved through the mixture of the concentrated high thrust air and fluid, and a fluid supply manifold, the manifold comprising at least one fluid container configured to hold a fluid and a first pump mechanically coupled to the at least one fluid container and configured to at least partially pump the fluid from the at least one container into the fluid inlet at a first pressure.

19. A fluid flow control device as claimed in claim 1, wherein the fluid flow control device further comprises a wired or wireless controller for providing remote operation of the fluid flow control device, the controller is designed to provide remote operation of the turntable drive assembly, the actuating assembly, the motor assemblies, and the fluid flow assembly.

20. A fluid flow control device as claimed in claim 19, wherein the controller further comprises:

a microcontroller having a central processing unit, a memory, at least one serial port and at least one digital programmable input and output and at least one analog programmable input and output;

a master control panel remotely connected to the microcontroller, the master control panel having at least one user interface, and a display configured to present at least one defined parameter used to operate or control the fluid flow control device; and a separate control device for controlling each one of:

i) a motor speed of each or all motor assemblies;

ii) an angular position of the annular outer casing with respect to the supporting structure by controlling the actuating assembly;

iii) a rotational position of the fluid flow control device by controlling the turntable drive assembly; and iv) a flow rate of fluid by controlling the first pump of the fluid flow assembly.

* * * * *